US006976283B2

(12) United States Patent
Choi

(10) Patent No.: US 6,976,283 B2
(45) Date of Patent: Dec. 20, 2005

(54) COSMETIC BRUSH ASSEMBLY

(75) Inventor: Man Soo Choi, Hyundai Apt. 301-502, Sa-Dong, Ansan-Shi, Kyungki-Do (KR)

(73) Assignee: Man Soo Choi, Ansan-shi (KR)

( * ) Notice: Subject to any disclaimer, the term of this patent is extended or adjusted under 35 U.S.C. 154(b) by 0 days.

(21) Appl. No.: 10/715,103

(22) Filed: Nov. 17, 2003

(65) Prior Publication Data

US 2004/0244813 A1 Dec. 9, 2004

(30) Foreign Application Priority Data

Nov. 15, 2002 (KR) ..... 10-2002-0071105
Oct. 4, 2003 (KR) ..... 10-2003-0069018

(51) Int. Cl.[7] ..... A46B 7/02; A46B 17/04

(52) U.S. Cl. ..... 15/184; 15/169

(58) Field of Search ..... 15/184, 168–170, 15/436; 132/313, 317; 401/29–33, 269, 131

(56) References Cited

U.S. PATENT DOCUMENTS 1,725,464 A * 8/1929 Lysons ..... 401/288
2,944,274 A * 7/1960 Hopkins ..... 401/102
5,339,483 A * 8/1994 Byun ..... 15/184
6,405,402 B1 * 6/2002 Choi ..... 15/184

FOREIGN PATENT DOCUMENTS

JP 2004-167249 A * 6/2004

* cited by examiner

*Primary Examiner*—John Kim
*Assistant Examiner*—Laura C Cole
(74) *Attorney, Agent, or Firm*—Harness Dickey & Pierce, PLC

(57) ABSTRACT

This invention relates to a cosmetic brush assembly. The cosmetic brush assembly has a brush member, which may be inserted in a case or pulled out from that by the open and close action of a protection cap. Further, the total length of the cosmetic brush assembly may be changed according to the movement of the brush. Therefore, a user may easily reserve the cosmetic brush assembly in a bag or use it for painting with cosmetic powder.

5 Claims, 66 Drawing Sheets

COSMETIC BRUSH ASSEMBLY

BACKGROUND OF THE INVENTION

1. Field of the Invention

This invention relates to a cosmetic brush assembly in which a brush inserted into a case can be exposed to the outside by the separation of a brush protection cap as well as the brush exposed can be inserted into the case by the installation of the cap, and more particularly this invention relates to a cosmetic brush assembly being capable of preventing from the exposure of the brush inserted into the case when the brush protection cap is not tightly fixed.

2. Description of the Related Art

Generally, a cosmetic brush assembly was an implement to paint with cosmetic powder, which substantially have a grasped member and a brush member mounted on the end of the grasped member. Further, a brush-protection cap was provided on the upper portion of the brush assembly. Thus, the protection cap was separated from the upper portion of the brush assembly to expose the brush for its use. After the brush is used, the protection cap was mounted on the upper portion of the brush assembly to protect the brush.

However, in the conventional cosmetic brush assembly, since the grasped member and the brush member were united to make its length become long, it was inconvenience to hold the cosmetic brush assembly in the interior of a handbag. Also, since the brush was covered with only the protection cap, the brush get damaged or the interior of the handbag was contaminated when the protection cap was missed to expose the brush member outside.

Thus, in order to resolve the above problems, it has requested a cosmetic brush assembly of which the brush member is protected in the interior of the grasped member and then the brush was exposed to the outside of the grasped member for its use.

Meanwhile, in order to prevent the easy separation of the protecting cap from the upper portion of the brush assembly, a projection was provided on the outer surface of the brush assembly's upper portion that was covered by the protecting cap. However, the projection and the interior surface of the protection cap contacted each other were worn away to make a scrap when the protecting cap was repeatedly open and closed. The scrap acted as a source of the brush's contamination. Further, result of the above abrasion, the external shape of the brush assembly was deteriorated.

SUMMARY OF THE INVENTION

This invention is designed to resolve the above problems, it is an object of the present invention to provide a cosmetic brush assembly of which a keeping length is maintained relatively short when a brush for painting with a cosmetic powder is inserted into a grasped portion whereas of which a using length is maintained relatively long when the brush inserted into the grasped portion is exposed to the outside, and in which the brush is exposable when a protection cap is removed from the grasped portion of the brush assembly.

Furthermore, according to the preferred embodiment of this invention, it is an object of the present invention to provide a cosmetic brush assembly wherein the brush is prevented from its exposing to the outside by the careless manipulation of the protection cap.

It is another object of this invention to provide a cosmetic brush assembly wherein a scrap will not be made when protecting cap repeatedly covering or is removed from a first cylindrical member.

In order to achieve the above purposes, according to a embodiment of this invention, a cosmetic brush assembly having a first cylindrical member of which both ends are open, and a second cylindrical member into which the lower portion of the first cylindrical member is slidably inserted, wherein the cosmetic brush assembly further comprises, a supporting disc fixed on the inner bottom surface of the second cylindrical member and having a cylindrical projection extending therefrom;

a gear-coupling structure slidably received into the first cylindrical member, a plurality of inner projections are formed at its upper interior, the lower end of the inner projections is formed with a coupling groove, its lower portion is provided with a base plate having a cylindrical projection formed with a penetrating hole through which the cylindrical projection of the supporting disc passes, elastic member and circular element are provided between the base plate and the inner projections;

a hollow gear-association member slidably inserted with the gear-coupling structure, having a first gearing element formed with a plurality of first outward projections and a second gearing element formed with a plurality of second outward projections at its outer surface, the second outward projections are selectively detached or coupled to the coupling groove of the inner projections of the gear-coupling structure, said first and second gearing elements are movably coupled each other; said first and second gearing element arc formed with gear teeth being opposite, a downward extending projection is provided therein;

a brush member established on the upper portion of the gear-association member and including a brush having a binding portion tightened by a binder and a penetrating member passing through the binding portion of the brush;

a length variable member of which both ends are coupled with the downward projection of the gear-association member and the cylindrical projection of the supporting disc, respectively and being capable of elongating or constricting;

a first elastic member surrounding the length variable member and being interposed between the hollow upper interior of the gear-association member and the upper surface of the cylindrical projection of the gear-coupling structure; and a protection cap into which the upper portion of the first cylindrical member is slidably received and of which upper interior is provided with a pressing projection;

wherein, when the upper portion of the first cylindrical member is received in the protection cap and the brush structure is received in the first cylindrical projection, the pressing projection presses the penetrating member of the brush structure to release the coupling state between the second outward projection and the coupling groove.

According to another embodiment of this invention, a cosmetic brush assembly having a first cylindrical member of which both ends are open, and a second cylindrical member into which the lower portion of the first cylindrical member is slidably inserted, wherein the cosmetic brush assembly further comprises;

a length variable member comprising a supporting disc fixed on the bottom interior of the second cylindrical member and a plurality of cylindrical segments extending upward from the supporting disc and being capable of elongating or constricting, the end portion of the innermost segment is screw machined and a gap is formed between the upper portion of the outermost segment and the upper surface of the innermost segment;

a gear-coupling structure including a cylindrical housing slidably involved in the first cylindrical member and a base plate coupled with the lower portion of the cylindrical housing and having a cylindrical projection formed with a penetration hole through which the segments of the length variable member are capable of passing, the upper interior of the cylindrical housing is formed with a plurality of inner projections spaced a given length away from each other, the lower end of each inner projection is formed with a coupling groove, a circular element supported by a first elastic element is provided between the base plate and the inner projections;

a hollow gear-association member slidably inserted with the gear-coupling structure, having a cylindrical mounting portion formed with a hole at its lower portion, a first gearing element coupled with the lower portion of the mounting portion and formed with a plurality of first outward projections on its outer surface and a second gearing element movably provided under the first gearing element and formed with a plurality of second outward projections at its outer surface, the second outward projections are selectively detached or coupled to the coupling groove of the inner projections of the gear-coupling structure, said first and second gearing elements are formed with gear teeth being opposite, respectively;

a brush member established on the mounting portion of the gear association member, having a brush with a binding portion fastened at its lower portion by a binder and a hole at the center of the binding portion, and a penetration element comprising an extending portion passing through the hole of the binding portion, a coupling element mounted on the upper portion of the extending portion and formed with an opening, and a circular plate positioned at the lower portion of the extending portion, the center of the lower side of the circular plate is formed with a groove exposed through the hole of the mounting and screw coupled with the end portion of the innermost segment, and the center of the lower side of the circular plate is provided with an outward projection extending downward adjacent to the groove and then protruds outward to detachably insert into the gap formed on the upper portion of the outermost segment;

a second elastic member surrounding the segments of the length variable member, and interposed between the lower portion of the circular plate exposed through the hole of the mounting portion and the upper portion of the cylindrical protrusion; and a brush protection cap into which the upper portion of the first cylindrical member is slidably received, having a pressing projection extending downward therefrom, the lower portion of the pressing projection has a relatively small diameter;

wherein, when the protection cap covers the upper portion of the first cylindrical member to make the end portion of the pressing projection insert and couple with the opening of the coupling member, the outward projection exposed through the hole formed at the mounting portion is inserted into the gap formed on the upper end of the outermost segment, the second outward projections of the the second gearing element is positioned between the inner projections after its separation from the coupling groove formed at the lower portion of the inner projection of the cylindrical housing.

According to the another embodiment of the invention, a cosmetic brush assembly comprising a brush having a binding portion of which central is formed with a penetration hole on its lower part, a first cylindrical member projectably inserted with the brush, a second cylindrical member slidably received with the lower portion of the first cylindrical member, and a protection cap covering over the upper portion of the first cylindrical member; characterized in that the cosmetic brush assembly further comprises, a length variable member having a supporting disc fixed on the bottom interior of the second cylindrical member and having a given length cylindrical outermost segment extending upward, a plurality of cylindrical segments involved in the hollow portion of the outermost segment and having a different diameter, respectively, a gap is formed between the upper inner periphery of the outermost segment and a upper outer periphery of a innermost segment among the segments when the length variable member is constricted; and a brush-supporting structure having a circular plate involved in the first cylindrical member, the brush member is mounted on the circular plate, the lower surface of the circular plate is provided with a groove coupled with the end portion of the innermost segment and an outward projection extending downward adjacent to the groove and being capable of strongly fitted into the gap formed on the upper end of the outermost segment;

wherein, the circular plate of the brush-supporting structure is provided with a upward extending member penetrating the hole formed in the center of the binding portion and having a coupling groove at its upper end portion, the interior of the protection cap is provided with a pressing projection being capable of strongly fitting with the coupling groove of the extending portion; and when the upper portion of the first cylindrical member is covered with the protection cap and the length variable member is constricted to its shortest length, the pressing projection provided in the protection cap is tightly fitted with the coupling groove and the outward projection of the brush-supporting structure is strongly fitted with the gap formed on the upper portion of the outermost segment.

Further, according to the other embodiment of the invention, a cosmetic brush assembly comprising a brush having a binding portion of which central is formed with a penetration hole on its lower part, a first cylindrical member into which the brush is projectably inserted, a second cylindrical member into which the lower portion of the first cylindrical member is slidably received, and a protection cap covering over the upper portion of the first cylindrical member; characterized in that the cosmetic brush assembly further comprises;

a brush-supporting structure having a circular plate on which the brush is mounted and a tubular body integrally manufactured with both a mounting portion on which the circular plate is mounted and a tubular portion projecting downward from the mounting portion, the bottom of the mounting portion is formed with an aperture communication with the hollow portion of the penetrating portion, the circular plate is provided with a upward extending member projecting upward to pass through the penetration hole formed in the central of the brush and having a groove formed under on its lower surface and a coupling groove formed on its upper portion;

a cylindrical guiding member having an aperture on its bottom, into which the tubular body separably tightly fit, and which is fixed at the lower hollow portion of the first cylindrical member; and a length variable member having a supporting disc fixed on the lower interior of the second cylindrical member and having a cylindrical outermost segment being capable of penetrating through the aperture of the guiding member, and a innermost segment slidably held in the hollow portion of the outermost segment and engaged with the groove of the circular plate;

wherein the inner side of the protection cap is provided with a pressing projection being capable of tightly fitting with the coupling groove of the upward extending portion;

the pressing projection of the protection cap tightly fits with the coupling groove and the basic piece member is engaged with the aperture of the cylindrical guiding member when the upper portion of the first cylindrical member is covered with the protection cap and the length variable member is constricted to its shortest length.

According to another embodiment of the invention, a cosmetic brush assembly comprising a brush member having a brush with a binding portion of which central is formed with a penetration hole on its lower part, a first cylindrical member into which the brush is projectably inserted, a second cylindrical member into which the lower portion of the first cylindrical member is slidably received, and a protecting cap covering over the upper portion of the first cylindrical member; characterized in that the cosmetic brush assembly further comprises, a brush-supporting structure having a tubular body comprising a mounting portion seated with the brush on its upper portion and formed with a groove at its lower portion and a tubular portion extending downward from the mounting portion, the mounting portion is provided with a hollow cylindrical tube extending upward to insert into the penetration hole of the brush and formed with a penetration opening having a locking step at its upper end portion, the hollow portion of the cylindrical tube is movably contained with cylindrical element elastically supported by a spring, the mounting portion is formed with a hole communicating with the hollow portion of the cylindrical tube;

a cylindrical guiding member having an aperture on its bottom, into which the tubular body separably tightly fit, and which is fixed at the lower interior of the first cylindrical member; and a length variable member comprising a supporting member having a supporting disc fixed on the lower interior of the second cylindrical member and a cylindrical outermost segment extending upward from the supporting disc to pass the aperture of the guiding member and formed with a upper opening at its upper portion, a cylindrical middle segment being slidably capable of involving in the outermost segment and formed with a upper opening at its top, a hollow coupling segment being slidably capable of involving in the middle segment and having a coupling portion at its upper portion engaged with the groove of the mounting portion and a cutout portion at its lower side, and an innermost segment having a horizontal element transversely installed at the cutout portion of the coupling segment to be caught the upper interior of the middle segment and a perpendicular element extending upward from the horizontal element and coupling with the cylindrical element through both the interior of the coupling segment and the hole of the mounting portion;

wherein the inner side of the protecting cap is provided with a pressing projection being inserted into the interior of the cylindrical tube through the penetration opening of the cylindrical tube and having an insertion end provided with a step portion being capable of engaging with the locking step;

the step portion of the insertion end portion of the pressing projection provided in the protection cap become caught at the locking step by the upper force of the cylindrical element exerted with the elastic force of the spring in the hollow portion of the cylindrical tube when the upper portion of the first cylindrical member received with the brush member is covered with the protection cap and the length variable member is constricted to its shortest length;

when the protection cap is separated from the upper portion of the first cylindrical member, the horizontal element being caught at the upper interior of the middle segment is pulled downward as the length variable member is elongated to its maximum length, resulting in that the upward force of the cylindrical element exerting on the insertion end portion of the pressing projection is disappeared and the step portion of the insertion end portion is released from the locking step.

BRIEF DESCRIPTION OF THE DRAWINGS

The accompanying drawings, which are included to provide a further understanding of the present invention and are incorporated in and constitute a part of this specification, illustrate embodiments of this invention and serve to explain the principles of the gist of this invention together with the following description.

In the drawings.

DETAILED DESCRIPTION OF THE PREFERRED EMBODIMENT

Figure 1:
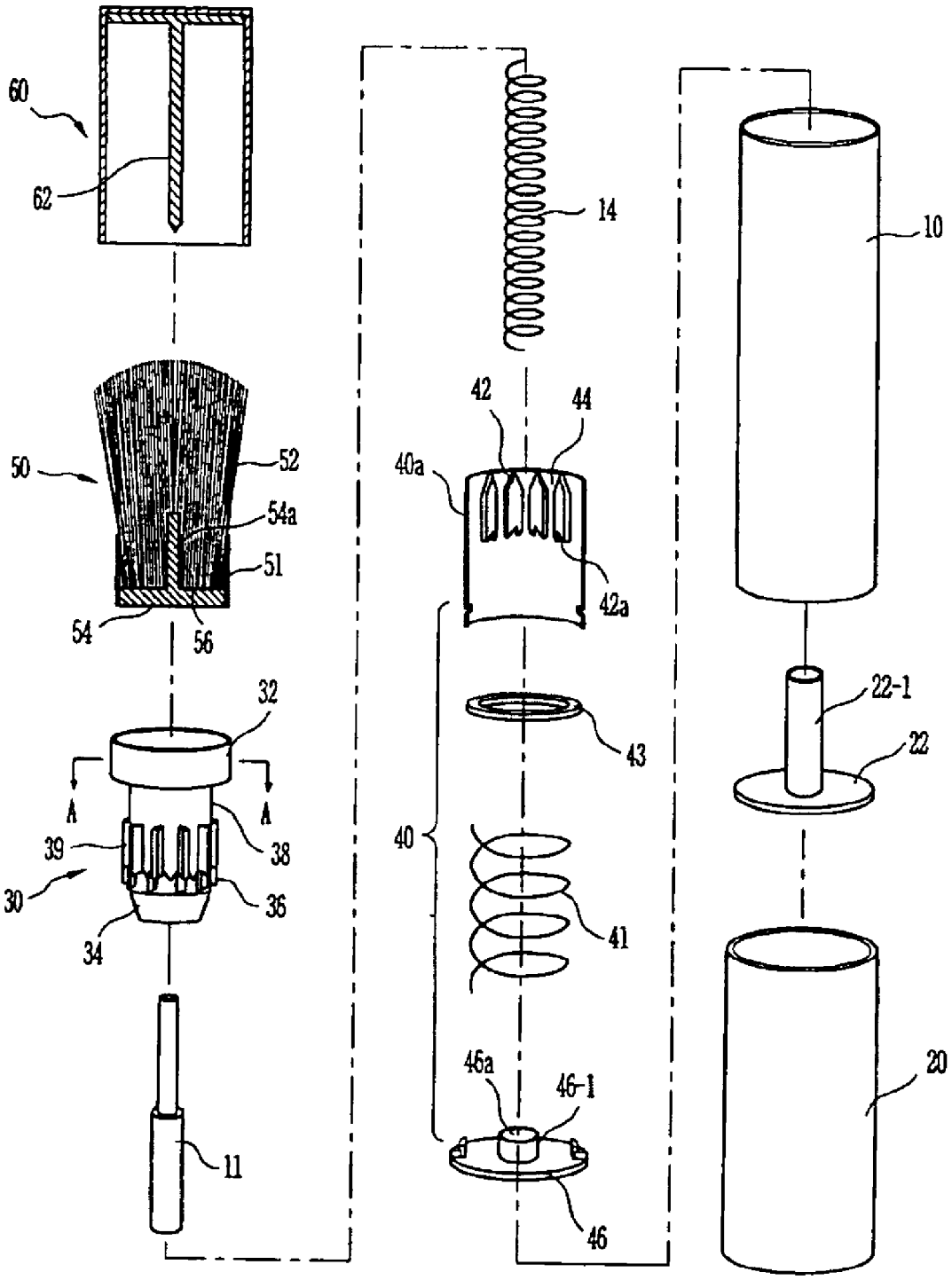
FIG. 1 is an exploded view showing a cosmetic brush assembly according to a first embodiment of this invention.
Figure 2:
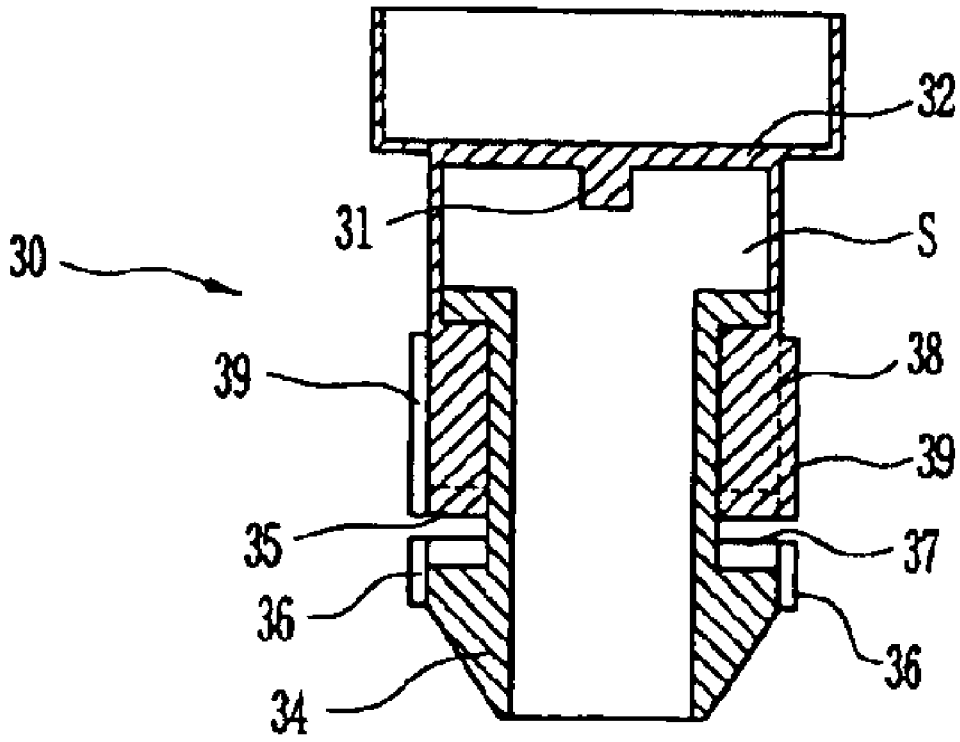
FIG. 2 is a sectional view along the line A—A shown in FIG. 1.

A cosmetic brush assembly according to this invention will be explained in reference with the accompanying drawings, as follows.

Example 1

As shown in FIGS. 1 to 6, a cosmetic brush assembly according to the first embodiment of this invention has a first cylindrical member 10 into which a brush 52 is inserted to be pulled out and of which both ends are open and a second cylindrical member 20 into which the lower portion of the first cylindrical member 10 is received and of which the lower end is closed. A supporting disc 22 is fixed onto the lower interior of the second cylindrical member 20 and a cylindrical projection 22-1 centered on which is extended upward. The cylindrical projection 22-1 of the supporting disc 22 is inserted with one end of a length variable member 11 which will be explained below. The length variable member 11 is extended therefrom. A third cylindrical member 40 is seated on the disc 22 in the interior of the first cylindrical member 10.

A base plate 46 is detachably provided at the lower end of the third cylindrical member 40, the plate 46 has a cylindrical protrusion 46-1 through which the cylindrical projection 22-1 of the disc 22 is capable of passing. A plurality of inner projections 42 spaced a given distance away from each other are provided on the upper interior of the third cylindrical member 40. A circular element 43 is slidably provided between the base plate 46 and the inner projections 42. A first elastic member 41 is provided between the base plate 46 and the circular element 43 to exert an elastic force on the circular element 43 in the upper direction.

A hollow gear-association member 30 be explained below is provided in the interior of the third cylindrical member 40. A plurality of outward projections 36, 39 separated a given distance from each other are provided on the outer surface of the hollow gear-association member 30, of which the upper interior is provided with a downward projection 31 extending therefrom.

The downward projection 31 is coupled with the other end of the length variable member 11. A second elastic member 14 is provided around the length variable member 11. The second elastic member 14 is interposed between the lower interior of the gear-association member 30 and the upper surface of the cylindrical protrusion 46-1 of the third cylindrical member 40.

Meanwhile, the inside diameter of the second elastic member 14 is kept to be smaller than that of the first elastic member 41, thus the interference between the first elastic member 41 and the second elastic member 14 is prevented. And, the upper portion of the gear-association member 30 is provided with a mounting portion 32 into which a brush member 50 is seated.

The brush member 50 comprises a brush 52 having a binding portion compacted by a binder 51 and the center of the binding portion is formed with a given-sized hole. The lower surface of the binding portion is attached with a circular plate 54 on which a penetration member 54*a* having a given-length bar shape and passing through the hole is vertically installed. The penetration member 54*a* preferably has a length so that it may be buried in the brush without its exposure.

Also, the cosmetic brush assembly according to the first embodiment further comprises a protection cap 60 covering the upper opening of the first cylindrical member 10 into which the brush member 50 is inserted. The upper interior of the protection cap 60 is provided with a pressing projection 62 extending downward therefrom. With the installation of the protection cap 60 into the upper portion of the first cylindrical member 10, the lower end of the pressing projection 62 contacts with the upper portion of the penetration member 54*a* of the brush member 50 to exert a pressing force downward. The lower end of the pressing projection 62 is preferably formed into a sharp shape to reach into the upper end of the penetration member 54*a* buried in the brush 52 without the damage of the brush 52.

Below, the structure and function of each component for the brush assembly according to the first embodiment of this invention will be explained.

1-1) First and Second Cylindrical Members 10 and 20

The first and second cylindrical members 10, 20 are hollow, both ends of the first cylindrical member 10 are open and the second cylindrical member 20 is open only at its upper end. The second cylindrical member 20 is long about half of the first cylindrical member 10. Thus, only a part of the first cylindrical member 10 is slidably received into the second cylindrical member 20. The lower interior of the second cylindrical member 20 is fixed with a supporting disc 22 from which a cylindrical projection 22-1 is extending upward.

1-2) Third Cylindrical Member 40

Both ends of third cylindrical member 40 is open, the lower end thereof is installed with a base plate 46 which attached with a cylindrical protrusion having a penetration hole 46*a* through which a cylindrical projection 22-1 is capable of passing. Third cylindrical member 40 is slidably inserted into the interior of the first cylindrical member 10 to seat on the supporting disc 22. The upper interior of the third cylindrical member 40 is provided with a plurality of inner projections 42 spaced a given distance away from each other. The space between the inner projections 42 acts as a guide groove 44 through which the outward projections 36, 39 of the gear-association member 30 is capable of sliding in the ups and downs direction as explained below. Lower end of each inner projection 42 is formed with a coupling groove 42*a* with which the upper end of the second outward projection 36 of the gear-association member 30 is capable of coupling.

Circular element 43 is interposed between the inner projections 42 and the base plate 46 in the third cylindrical member 40. The circular element 43 is elastically supported by the first elastic member 41 surrounding the cylindrical projection 46-1 and positioned over the base plate 46.

1-3) Gear-Association Member 30

Gear-association member 30 is formed into a hollow housing, which is slidably inserted into the interior of the first cylindrical member 10. The housing is comprised of a first gearing element 38 having a first teeth 35 at its lower end and a second gearing element 34 having a second teeth 37 opposite to the first teeth 35. The upper portion of the first gearing element 38 is provided with a mounting portion 32 on which the brush member 50 is seated, as explained below. The mounting portion 32 is defined with the cylindrical edge vertically extending upward from the upper edge of the first gearing element 38. The lower surface of the mounting portion 32 is provided with a downward projection 31 extending a given length in the hollow portion of the housing. The downward projection 31 is fixed with the upper portion of the length variable member 11.

The first gearing element 38 is categorized into a large part and a small part according to its inner diameter size. The outer periphery of the small part is formed with a plurality of first outward projections 39 spaced a given distance away from each other, and the first teeth 35 forms on the lower end of the small part. Also, the second gearing element 34 is classified into a large portion and a small portion according to its outer diameter size. The outer periphery of the large portion is formed with a plurality of second outward projections 36 spaced a given distance away from each other, and the lower portion of the second outward projections 36 is formed with an inclined surface. The upper end of the small portion is provided with a flange extending outward. Substantially, the outer diameter and the inner diameter of the small portion are preferably kept to be same.

When the flange is inserted into the large part of the first gearing element 38 to seat on the upper portion of the small part, the first gearing clement 38 and the second gearing element 34 are engaged each other. And, since a given-sized space S is formed between the upper surface of the flange and the lower surface of the mounting portion 32 to form a gap corresponding to the space S between the first teeth 35 and the second teeth 37, the first gearing element 38 and the second gearing element 34 coupled together are capable of sliding each other.

As mentioned above, the gear-association member 30 in which the first gearing element 38 and the second gearing element 34 is inserted into the first cylindrical member 10 and is further inserted into the third cylindrical member 40. The downward projection 31 of the gear-association member 30 and the cylindrical projection of the supporting disc 22 are connected each other through the length variable member 11, the length variable member 11 is surrounded by the second elastic member 14 having a relatively small diameter to that of the first elastic member 41. Specially, the second elastic member 14 is interposed between the lower surface of the mounting portion 32 and the upper surface of the cylindrical protrusion 46-1 of the third cylindrical member 40.

In the meshing state of the first gear teeth 35 and the second gear teeth 37, the first outward projection 39 is crossed with the second outward projection 36 by ½ pitch.

1-4) Brush Member 50 and Protection Cap 60

Brush member 50 seated on the mounting portion 32 of the first gearing element 38 comprises a binder 51 fastening the lower portion of the brush 52, a cylindrical member 56 passing through the central hole of the brush's binding portion formed by the binder 51, and a circular plate 54 fixed on the lower end of the brush's binding portion and having a bar-shaped penetration member 54*a* passing through the circular plate 54. The penetration member 54*a* has enough length to be buried in the brush 52 after passing the cylindrical member 56. The upper portion of the penetration member 54*a* is contacted with a pressing projection 62 extending downward from the upper interior of the protection cap 60 which will be explained below. The pressing projection 62 has a sharp shape to reach into the penetration member 54*a* without the damage of the brush 52. The protection cap 60 is formed with the cylindrical shape covering the upper portion of the first cylindrical member 10.

1-5) Length Variable Member 11

As mentioned above, one end of the length variable member 11 is inserted and fixed with the cylindrical projection 22-1 of the supporting disc 22 provided on the lower portion of the first cylindrical member 10, the other end thereof is coupled to the downward projection 31 provided on the lower portion of the mounting portion 32 of the gear-association member 30 after passing through the penetrating hole 46*a* formed in the cylindrical protrusion 46-1 of the base plate 46 provided on the lower portion of the cylindrical member 40 and extending upward. The first elastic member 41 having large diameter and the second elastic member 14 having small diameter are provided around the length variable member 11.

After the gear-association member 30 is slid upward by the elastic force of these elastic members, the length variable member 11 is elongated, on the other hand the length variable member 11 is constricted by outer force, for example a force exerting downward to the gear-association member 30. The length variable member may be an antenna member of which plural cylindrical units are slidably joined to each other, a flexible coupling member such as a string or wire, or a fragmentary coupling member of which a plurality of fragmentary units are slidably joined to each other.

The actuating state of the cosmetic brush assembly according to the first embodiment of this invention will be explained as follows.

Figure 3A:
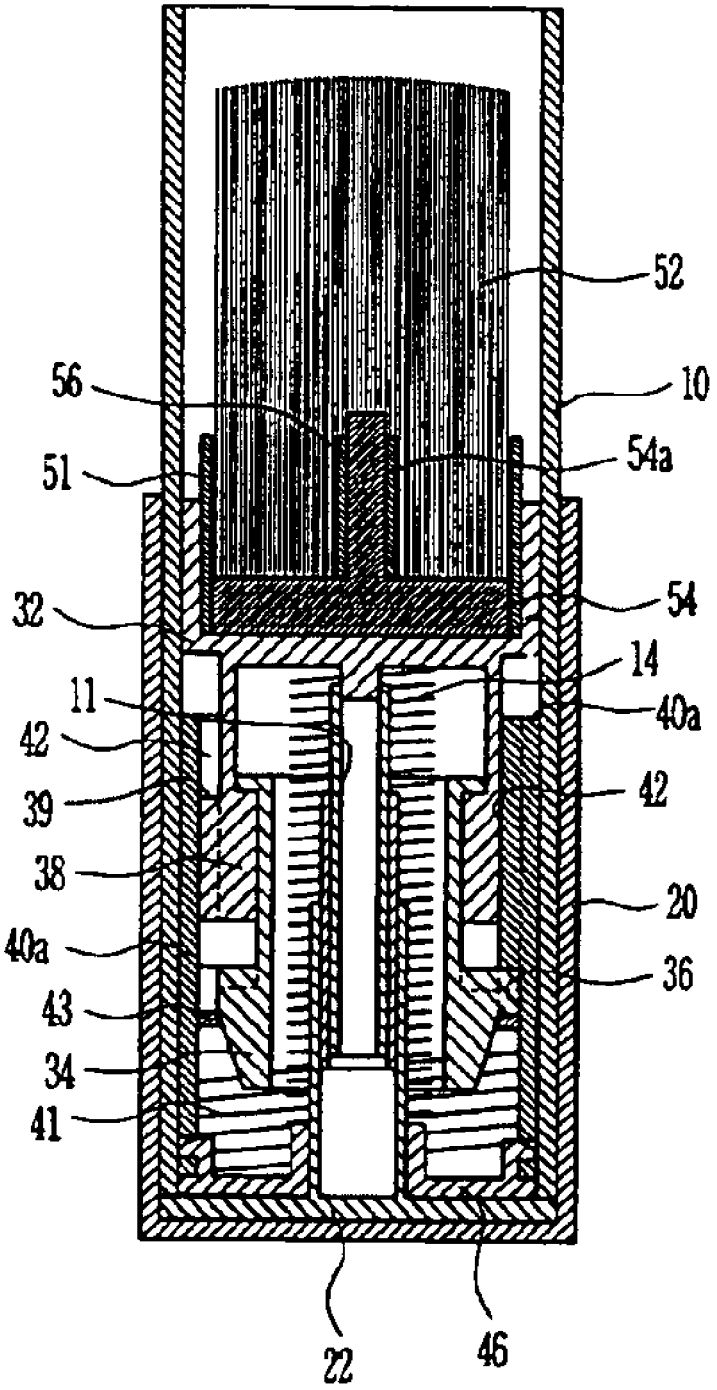
FIG. 3*a* is a sectional view showing the elongation state of an antenna element according to the first embodiment of this invention.
Figure 3B:
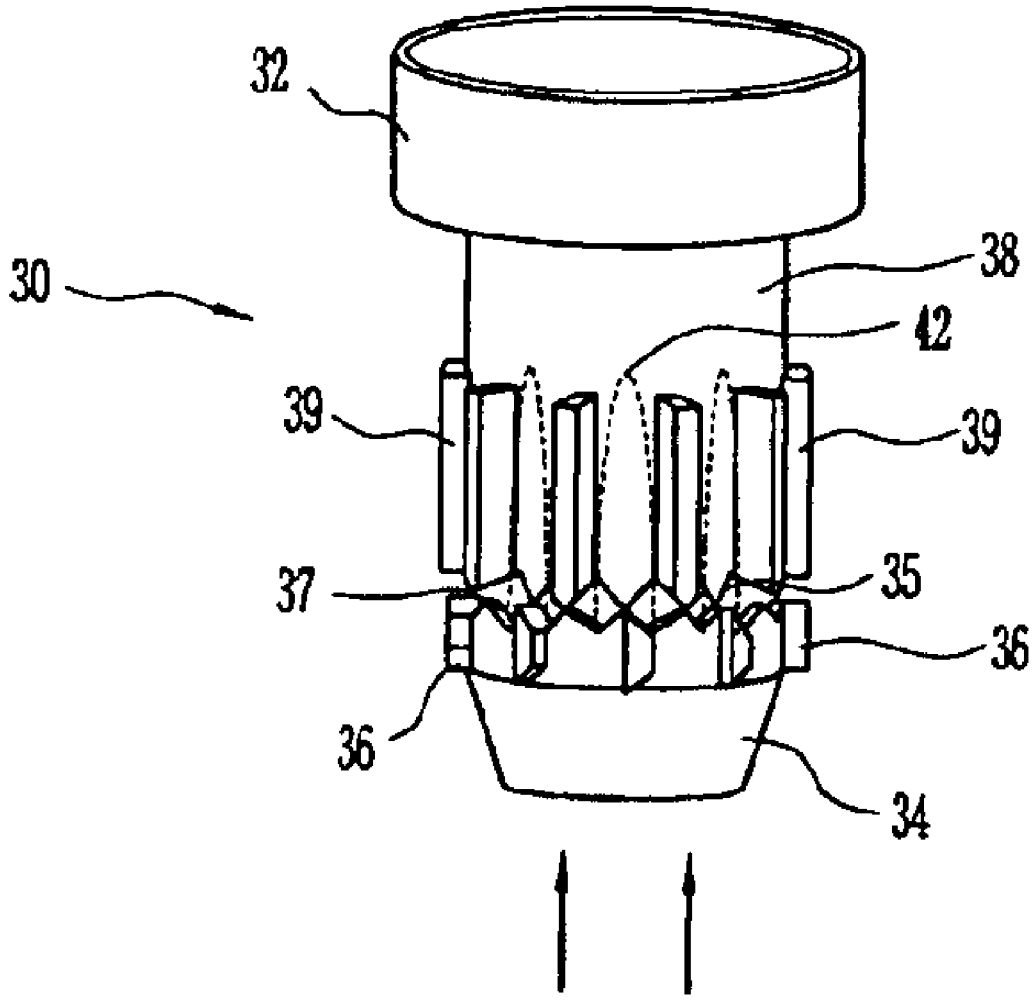
FIG. 3*b* is a sectional view showing the constricted state of the antenna element.

Firstly, referring to FIGS. 3*a* and 3*b*, the lower portion of the first cylindrical member 10 is inserted into the interior of the second cylindrical member 20 of which the inner lower surface is fixed with the supporting disc 22, the third cylindrical member 40 is received into the first cylindrical member 10, the gear-association member 30 is inserted into the third cylindrical member 40, and the mounting portion of the gear-association member 30 is seated with the brush member 50. At this time, the brush 52 of the brush member 50 is maintained to be completely received into the first cylindrical member 10, and both ends of the length variable member 11 is coupled to the downward projection 31 of the gear-association member 30 and the cylindrical projection 22-1 of the supporting disc 22, respectively. The first and second elastic members 41 and 14 surround the length variable member 11.

When the second outer protrusions 36 provided on the outer surface of the second gearing element 34 are combined into the coupling groove 42*a* formed on the lower portion of the inner projections 42, the upward movement of the second gearing element 34 elastically supported via the circular element 43 by the first elastic member 41 is restricted. And, since the flange of the second gearing element 34 is run over the step portion between the large portion and small portion of the first gearing element 38, the upward movement of the first gearing element 38 elastically supported by the second elastic member 14 is also restricted. Then, there is formed with a gap corresponding to the space on the upper portion of the flange between the first teeth 35 and the second teeth 3.

That is, referring to FIG. 3*b*, when the first and second gearing elements 38, 34 are received into the third cylindrical member 40, the plurality of the first outward projections 39 of the first gearing element 38 are positioned in the guiding grooves 44 formed between the inner projections 42 (indicated by the dotted line for convenience sake) of the third cylindrical member 40, the upper end of the second outward projections 36 of the second gearing element 34 are coupled into the coupling grooves 42*a* formed on the lower ends of the inner projections 42, respectively. At this time, the first outward projections 39 and the second outward projections 36 are adjacently separated each other by ½ pitch.

In the restriction state of the upward movement of the gear-association member 30, the length variable member 11 is maintained to have its least length.

Figure 4A:
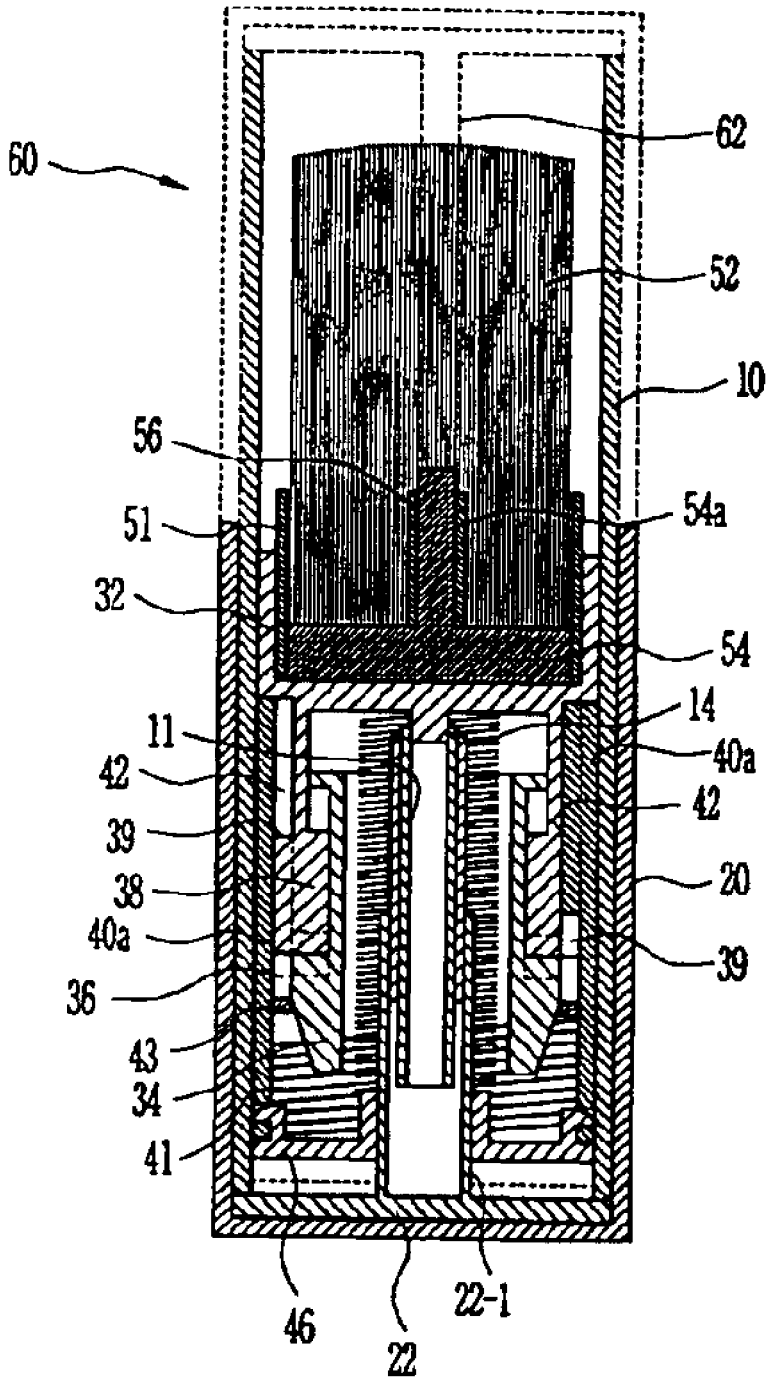
FIG. 4*a* is a sectional view showing the cosmetic brush assembly according to a first embodiment of this invention prior to be used.
Figure 4B:
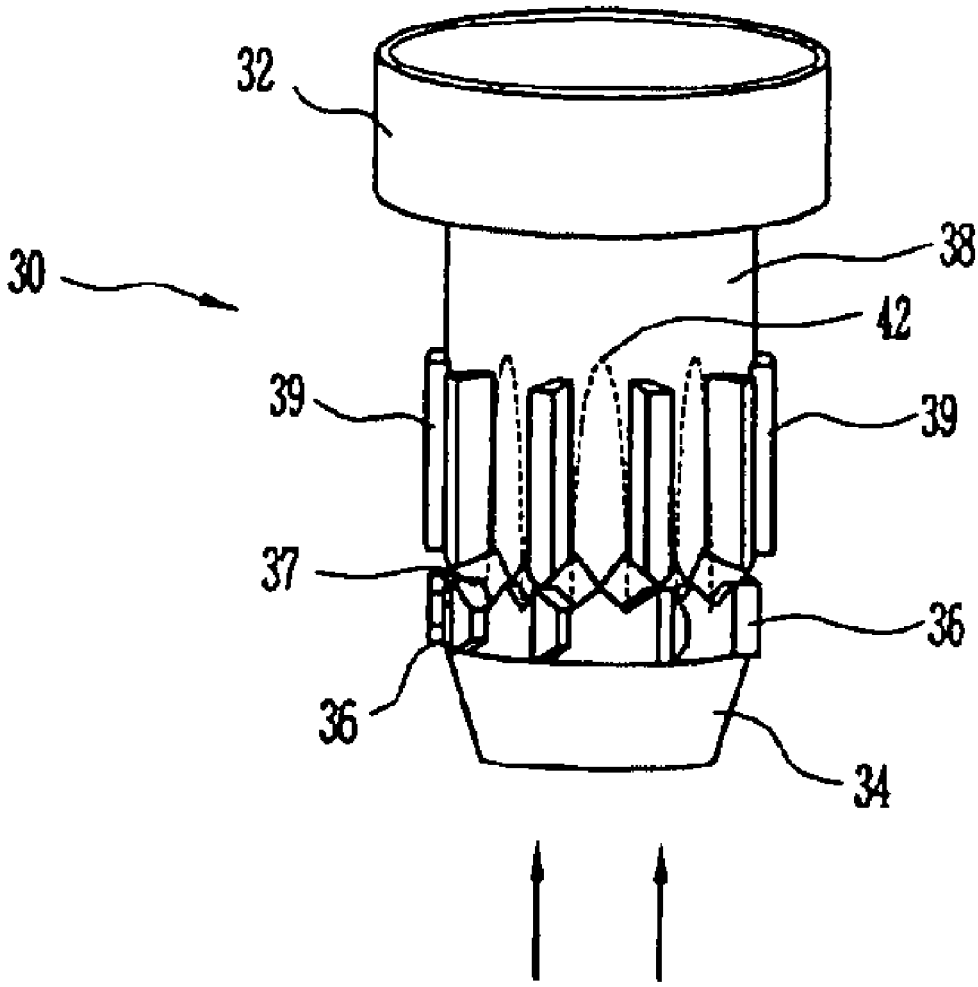
FIG. 4*b* is a sectional view showing the gear engaging state of a gear association member in the state of FIG. 4*a;*

Referring to FIGS. 4*a* and 4*b*, the upper portion of the first cylindrical member 10 is received into the protection cap 60 to be closed, in which the brush 52 of the brush member 50 is completely accepted. That is, the protection cap 60 covering the upper portion of the first cylindrical member is prevent the brush 52 from being contaminated or damaged.

The pressing projection 62 provided on the interior of the protection cap 60 contacts and compresses the penetration member 54*a* buried in the brush 52. And, the pressing force exerting to the penetration member 54*a* and the circular plate 54 through the pressing projection 62 acts to the gear-association member 30. When the first gearing element 38 is pressed to couple the first teeth 35 and the second teeth 37, the second outward projection 36 of the second gearing element 34 is detached from the coupling groove 42*a* formed on the inner projection 42 of the third cylindrical member. That is, the second gearing element 34 is turned around the center of the first gearing element 38 by ½ pitch, thereby the first outward projections 39 and the second outward projections 36 are aligned each other. Under such circumstance, the elastic force of the first and second elastic members 41, 14 are exerted into the gear-association member 30, however since the protection cap firmly holds the first cylindrical member 10 the brush of the brush member 50 is prevented from being drawn out from the first cylindrical member 10.

The supporting disc 22 is moved downward to make its lower surface contact with the lower interior of the second cylindrical member 20.

And then, the protection cap 60 is removed from the first cylindrical member 10 to pull out the brush 52 of the brush member 50 from the first cylindrical member 10 in order to use the cosmetic brush assembly according to the first embodiment of this invention.

Figure 5A:
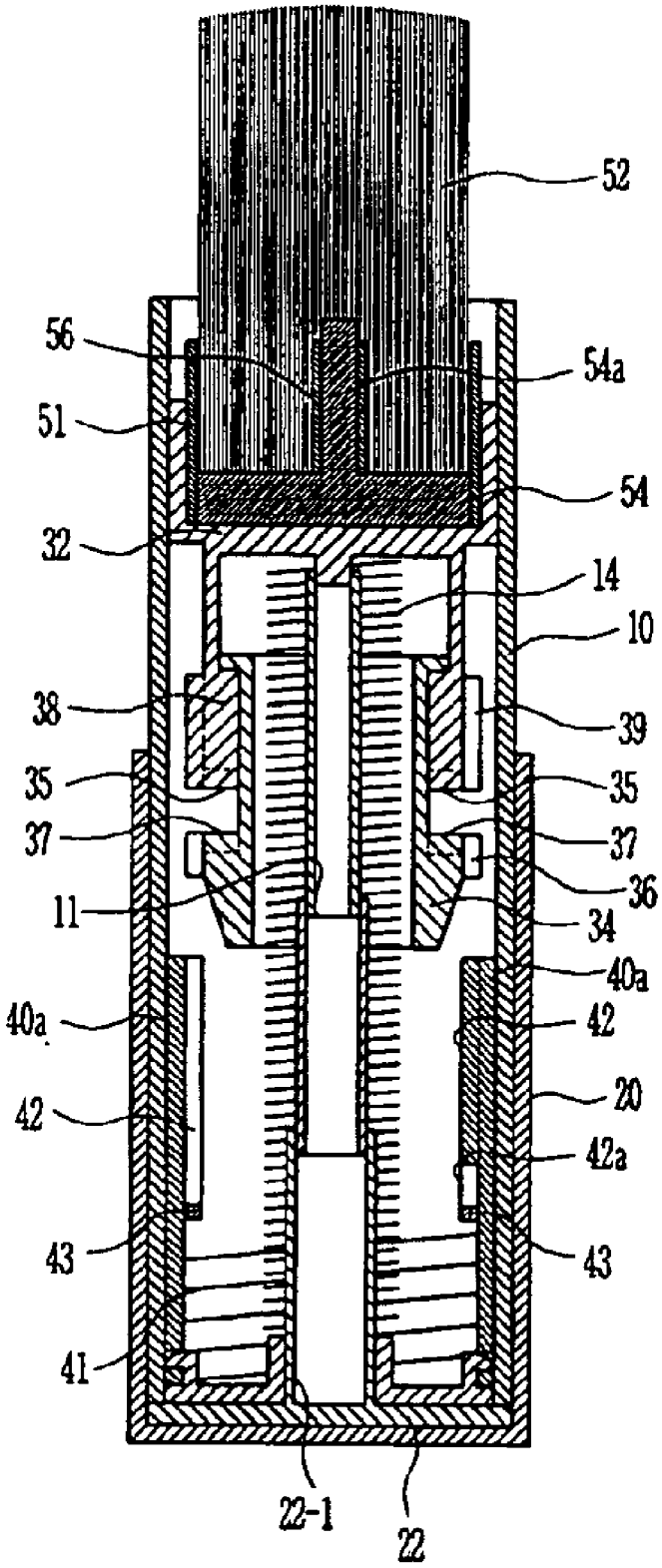
FIG. 5*a* is a sectional view showing the elongation state of the antenna element by the removal of a protection cap according to this invention.
Figure 5B:
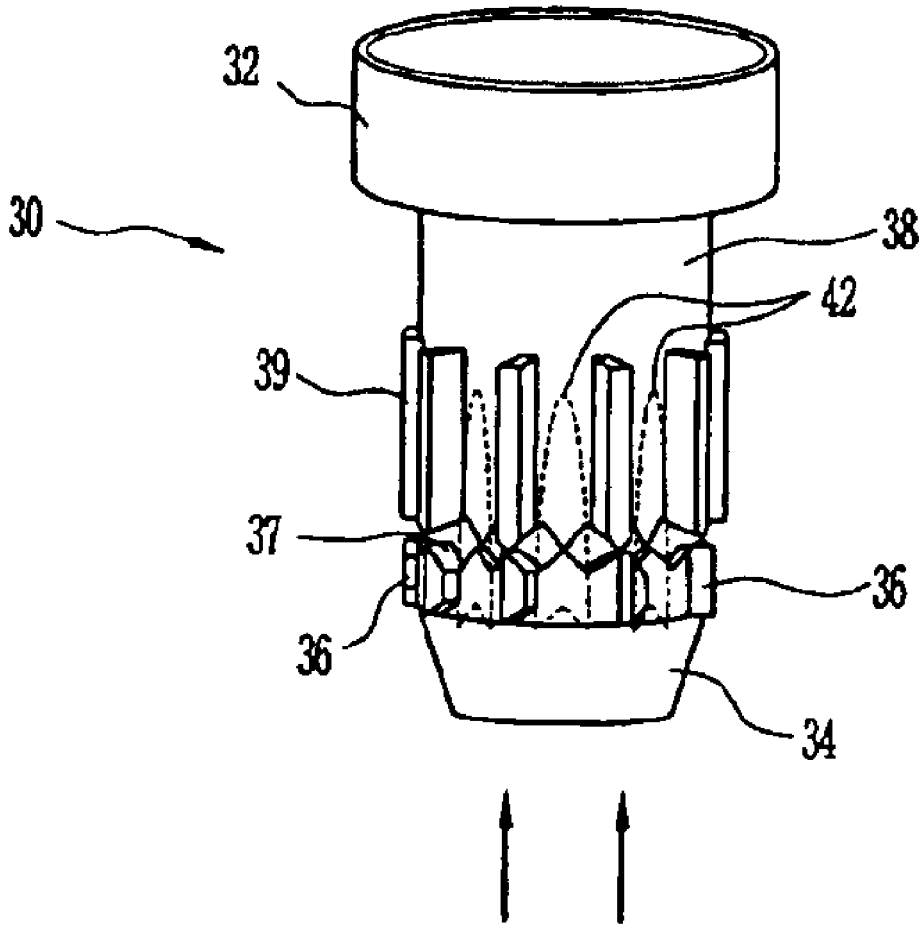
FIG. 5*b* is a sectional view showing the gear engaging state of a gear association member in the state of FIG. 5*a;*

As shown in FIGS. 5*a* and 5*b*, after the protection cap 60 is removed from the first cylindrical member 10, the gear-association member 30 is exerted with the elastic force of the first and second elastic members 41, 14 in the upward direction. Since the second outward projections 36 of the second gearing element 34 is aligned with the first outward projections 39 of the first gearing element 38 positioned in the guiding groove 44 between the inner projections 42 of the third cylindrical member 40, the second outward projection 36 is moved upward along the guiding groove 44 in combination with the first outward projections 39 are moved upward along the guiding groove 44 by the elastic force of the second elastic member 14.

And, after the second outward projections 36 are moved to the upper portion of the guiding groove 44 and further moved over the third cylindrical member 40, the brush 52 of the brush member 50 is exposed outside. If the elastic force of the elastic members 14 and 41 is exerted to the upper portion of the gear-association member 32 as depicted by the arrow in FIG. 5*b*, the first outward projections 39 of the first gearing element 38 and the second outward projections 36 of the second gearing element 34 are passing through the guiding groove 44 between the inner projections 42 of the third cylindrical member 40. At this time, the first teeth 35 of the first gearing element 38 and the second teeth 35 of the second gearing element 34 are meshed together.

The lower end of the first outward projections 39 is contacted with the upper end of the second outward projections 36. In such state, the second elastic member 14 is completely elongated and the length variable member 11 is also elongated to its maximum length. And, since the elongated length of the length variable member 11 is fixed, the brush 52 of the brush member 50 may be prevented from pulling out completely from the first cylindrical member 10.

Since the circular element 43 is also put under the lower end of the inner projection 42 of the third cylindrical member 40, the first elastic member 41 has a constant elastic force between the circular element 43 and the base plate 46.

The following description concerns the process of inserting the brush into the first cylindrical member 10 after using the brush 52 exposed outside by removing the protection cap 60 from the first cylindrical member 10.

Figure 6:
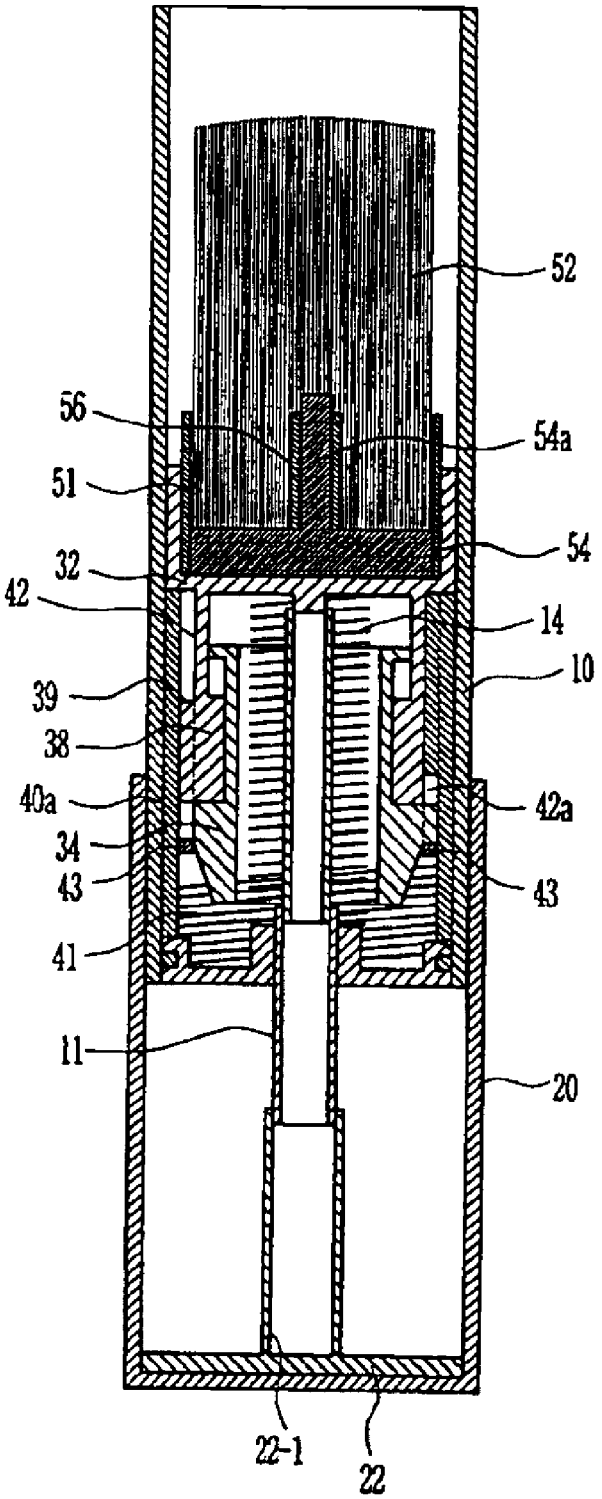
FIG. 6 is a sectional view showing the actuation state to retain the exposed brush into the first cylindrical member.

As depicted in FIG. 6, users grips the second cylindrical member 20 and moves the first cylindrical member 10 upward to insert the brush 52 of the brush member 50 into the first cylindrical member 10. The third cylindrical member 40 is moved upward in connection with the upward movement of the first cylindrical member 10, thereby the second outward projections 36 of the gear-association member 30 are coming in the guiding groove 44 formed between the inner projections 42 of the third cylindrical member and then the first outward projections are also coming in the guiding groove. When the second outward projections 36 are free from the lower portion of the guiding groove 44 of the third cylindrical member 40, the elastic force of the first cylindrical member 41 is exerted into the second gearing element 34 via the circular element 43.

As the result, the second gearing element 34 is turned around the center of the first gearing element 38 by ½ pitch. Thus, the second outward projections 36 of the second gearing element 34 is positioned in the lower portion of the coupling groove 42*a* formed in the inner projections 42 of the third cylindrical member 40.

In the above described state, if the force exerting to the first cylindrical member 10 upward is eliminated, the second gearing element 34 is moved upward by the elastic force of the first elastic member 41 acting to the second cylindrical member 34 upward. However, since the second outward projections 36 of the second gearing element 34 is joined with the coupling groove 42*a* formed in the inner projections 42 of the third cylindrical member 40, the upward movement of the second gearing element 34 is restricted. And, the upward movement of the first gearing element 38 affected by the elastic force of second elastic member 14 is also restricted. As the result, the brush 52 is inserted into the first cylindrical member 10.

In the above described state, when the second cylindrical member 20 is moved upward the cosmetic brush assembly according to the first embodiment of this invention have the same state as FIG. 3*a*.

Example 2

Below, the cosmetic brush assembly according to the second embodiment of this invention will be explained with reference to FIGS. 7 to 20.

A cosmetic brush assembly has a first hollow cylindrical member 110 into which a brush 152 is inserted to be drawn out and of which both ends are open, and a second cylindrical member 120 into which the lower portion of the first cylindrical member 110 is slidably inserted and of which the lower end is closed. The interior of the second cylindrical member 120 is provided with a length variable member 122 being capable of elongating and contracting. The length variable member 122 comprises a supporting disc 122-1 provided on the lower interior of the second cylindrical member 120, a first cylindrical segment 122*a* positioned on the central of the supporting disc 122-1 and extending upward therefrom, a second cylindrical segment 122*b* slidably provided in the interior of the first cylindrical segment 122*a*, and a third rod-type segment 122*c* passing through the interior of the second segment 122*b*. The first segment 122*a* of the length variable member 122 is coupled with a outward projection 154*c* provided under the lower surface of the penetrating member 154 explained below.

A cylindrical gear-coupling member 140 is seated on the supporting disc 122-1 of the length variable member 122 in the interior of the first cylindrical member 110. The gear-coupling member 140 comprises a cylindrical housing 145, and a base plate 146 detachably provided on the lower end of the cylindrical housing 145 and having a penetrating hole h through which the first segment 122*a* of the supporting disc 122-1 is capable of passing. The base plate 146 is provided with a cylindrical projection 146*a*. The upper surface of the base plate 146 is also provided with at least a pair of first coupling projection 146*b* around its edge. The lower portion of the cylindrical housing 145 is provided with a first catching hole 145*a* corresponding to the first coupling projection 146*b*.

As the first coupling projection 146*b* is coupled and separated with the catching hole 145*a*, the cylindrical housing 145 may be coupled and separated with the base plate 145. A plurality of inner projections 142 spaced a given distance away from each other are provided on the upper interior of the cylindrical housing 145.

A circular element 143 is slidably provided between the base plate 146 and the lower portion of the inner projection 142 in the interior of the cylindrical housing 145. A first elastic member 141 is provided between the base plate 146 and the circular element 143, a elastic force by the first elastic member 141 is exerted on the circular element 143 upward. Further, the interior of the gear-coupling member 140 is provided with a second elastic member 114 relatively longer than the first elastic member 141. And, the second elastic member 114 is interposed between the lower surface of the penetrating member 154 exposing via a hole formed in the mounting portion 132 of the gear-association member 130 and the upper surface of the cylindrical projection 146*a* of the gear-coupling member 140. At this state, the inner diameter of the second elastic member 114 is smaller than that of the first elastic member 141 to prevent the interference between the first elastic member 141 and the second elastic member 114.

The interior of the gear catching body 140 is provided with gearing elements 134, 138 of a hollow gear-association member 130 explained below. The gear-association member 130 comprises a mounting portion 132 positioned on the upper end of the gear catching body 140 and mounted with a Brush member 150 explained below, a first gearing element 138 detachably provided under the lower portion of the mounting portion 132, and a second gearing element 134 positioned under the lower portion of the first gearing element 138. The mounting portion 132 is manufactured into a cylindrical shape to have a lower plate of which central is formed with a give-sized hole. The lower surface of the lower plate of the mounting portion 132 is provided with a second coupling projection 132*a* opposite each other around the hole. And, a second catching hole 138*a* corresponding to the second coupling projection 132*a* is formed on the upper side of the first gearing element 138. As the second coupling projection 132*a* couples to the second catching hole 138*a*, the first gearing element 138 couples to the mounting portion 132.

The Brush member 150 mounted on the mounting portion 132 comprises a brush 152 having a binding portion tightened by the binder 151 at its lower portion. The central portion of the binding portion of the brush 152 is formed with a given-sized hole into which the cylindrical member 156 is inserted. The lower surface of the binding portion is provided with the penetrating member 154 having a given-length extending portion 154*a*, which penetrates the cylindrical member 156. The penetrating member 154 has a circular plate 154-1 to be established on the mounting portion 132.

Figure 7:
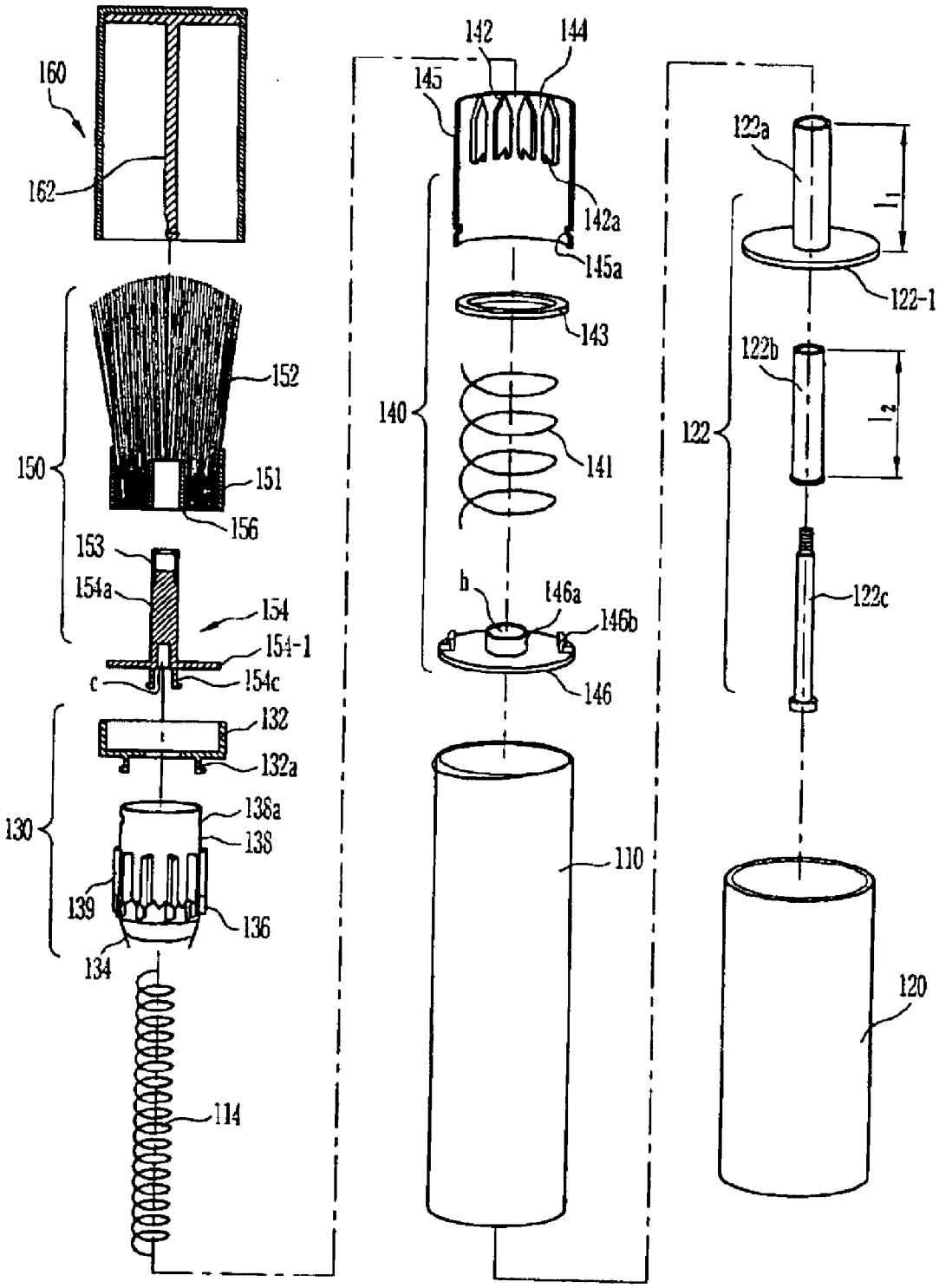
FIG. 7 is an exploded view showing a cosmetic brush assembly according to a second embodiment of this invention.
Figure 19:
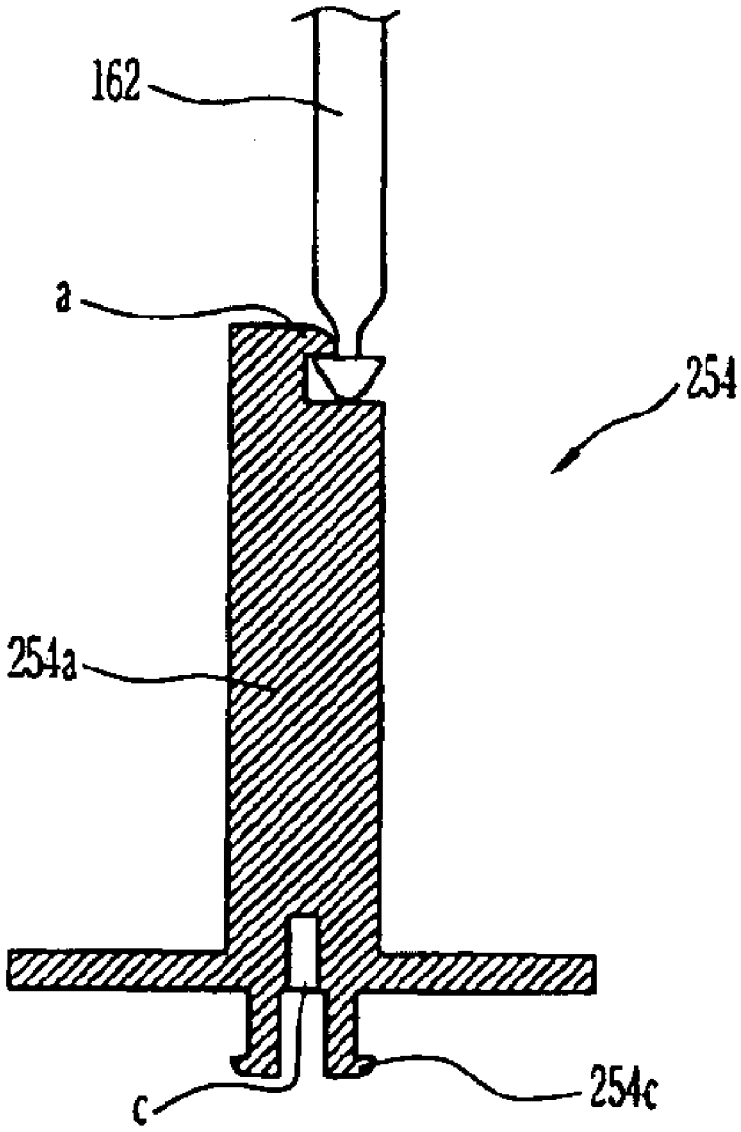
FIG. 19 is a view showing that the pressing projection is engaged with the penetration element according to the other embodiment of this invention.

The center of the lower portion of the circular plate 154-1 is formed with a groove c into which the upper end of the third segment 122*c* of the length variable member 122 may be inserted. Further, the lower surface of the circular plate 154-1 is provided with an outward projection 154*c* extending downward and then protruding outward around the groove c. The outward projection 154*c* is inserted and coupled to a gap g formed on the upper end of the first segment 122*a* when the length variable member 122 penetrating through the hollow portion of the gear-association member 130 is contracted. The extending portion penetrating the cylindrical member 156 preferably has a length to be buried in the brush without its exposure. The upper end of the extending portion 154*a* is provided with a catching member 153 to which the end of a pressing projection 162 of a protection cap 160 is coupled as explained below. The catching member may be a cylindrical member 153 having a hole at its upper surface as shown in FIG. 7, or an elongated element a treated to have a groove at its upper end of the extending portion 154*a* as shown in FIG. 19.

The cosmetic brush assembly according to the second embodiment further comprises a protection cap 160 covering the upper opening of the first cylindrical member 110 into which the brush structure is involved. The upper interior of the protection cap 160 is provided with a pressing projection 162 extending downward therefrom. With the installation of the protection cap 160 into the upper portion of the first cylindrical member 110, the lower end of the pressing projection 162 couples to the catching member 153 provided on the upper end of the extending portion 154*a* of the penetrating member 154 to exert a pressing force downward. The lower end of the pressing projection 162 is preferably formed into a sharp shape to reach into the upper end of the penetrating member 154*a* buried in the brush 152 without the damage of the brush 152. Further, the lower end of the pressing projection 162 is manufactured to any shape having a recessed waist, which is inserted and fixed to a hole formed in the catching member 153. At this state, the central shaft of the lower end is biased to one side from the center of the pressing projection 162.

Figure 8:
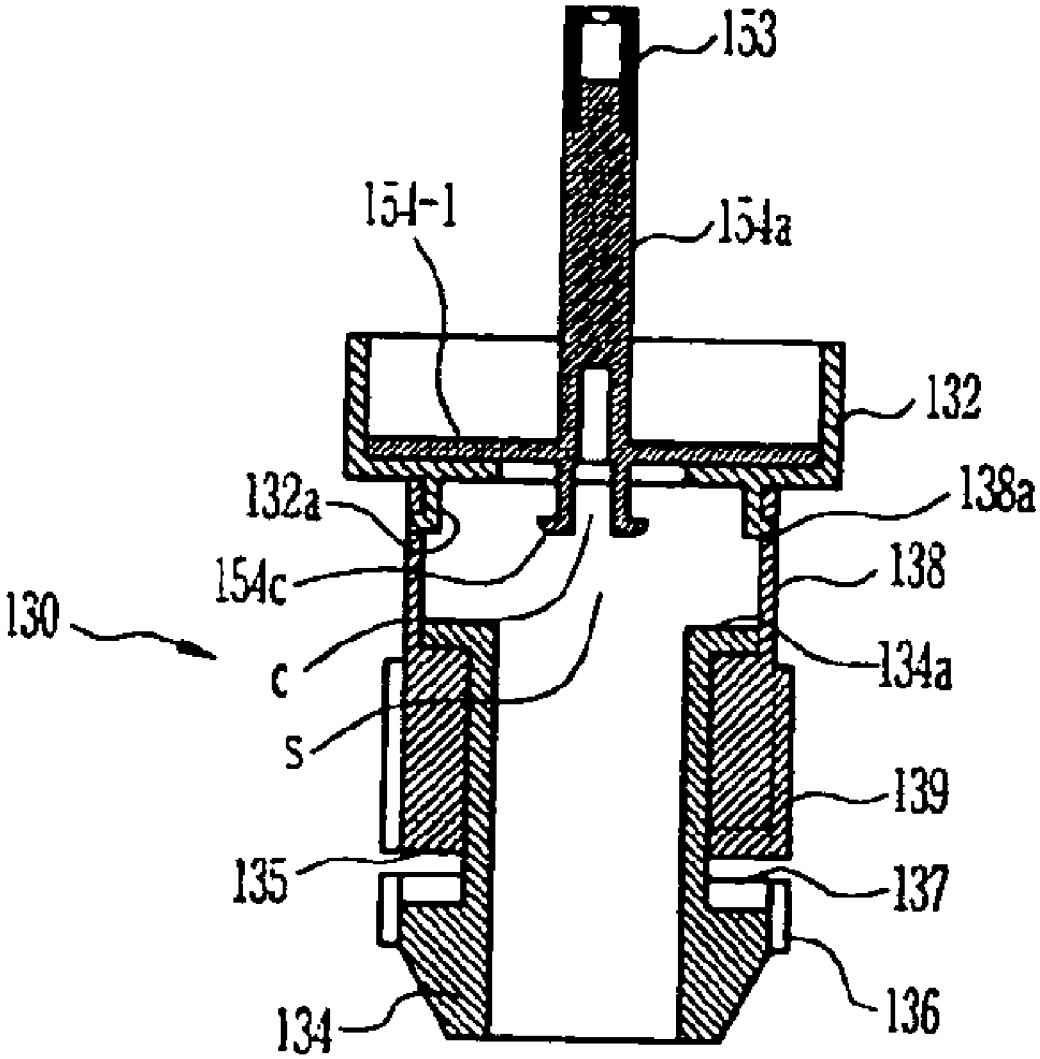
FIG. 8 is a sectional view showing that a penetration element of the brush member is mounted on the mounting portion of the gear association member according to a second embodiment of this invention.
Figure 9A:
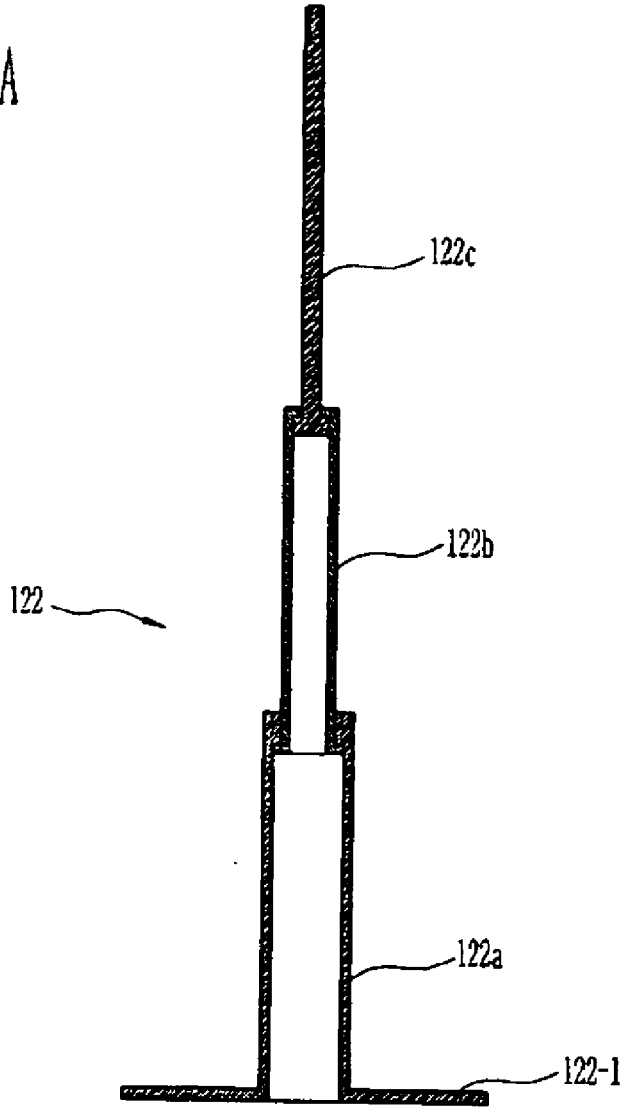
FIG. 9*a* is a sectional view showing the elongation state of a length variable member according to a second embodiment of this invention.
Figure 9B:
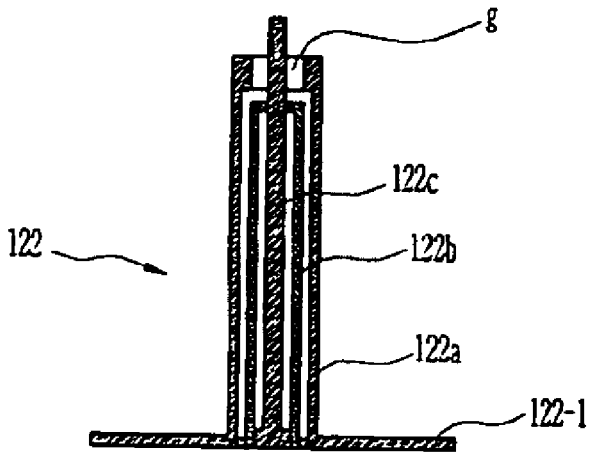
FIG. 9*b* is a sectional view showing the constriction state of a length variable member.

The structure and function of each component for the brush assembly according to the second embodiment of this invention will be explained with reference to FIGS. 7 to 9.

2-1) First and Second Cylindrical Members 110 and 120

The first and second cylindrical members 110, 120 are hollow, both ends of the first cylindrical member 110 are open and the second cylindrical member 120 is open only at its upper end. The length of the second cylindrical member 120 is about half of that of the first cylindrical member 110. Thus, only a part of the first cylindrical member 110 is slidably received into the second cylindrical member 120. The interior of the second cylindrical member 120 is provided with a length variable member 122.

2-2) Length Variable Member 122

Length variable member 122 has a supporting disc 122-1 formed with a given-sized hole at its central portion and seated on the bottom surface of the second cylindrical member 120, and a first cylindrical segment 122*a* vertically established on its upper surface to communicate with the hole of the supporting disc 122-1. The upper end of the first segment 122*a* is formed with an opening of which the diameter is relatively smaller than that of its main body. The interior of the first segment 122*a* is provided with a second cylindrical segment 122*b* passing through the supporting disc 122-1 upward. The lower end of the second segment 122*b* is provided with a flange radially extending outward, the top end of the second segment 122*b* is formed with a hole having a relatively smaller diameter than that its main body. At this state, although the second segment 122*b* is elongated upward to pass through the hole formed in the upper end of the first segment 122*a*, the second segment 122*b* will not be separated from the first segment 122*a* by the flange.

A third segment 122*c* passes through the interior of the second segment 122*b* upward. The lower end of the third segment 122*c* is provided with a flange radially extending outward. Likewise, although the third segment 122*c* is elongated upward to pass through the hole formed in the upper end of the second segment 122*b*, the third segment 122*c* will not be separated from the second segment 122*b* by the flange of the third segment 122*c*. The upper end of the third segment 122*c* has a relatively small outer diameter and its outer periphery is spiral machined. Such upper end of the third segment 122*c* is screw coupled with a groove c formed in the lower center of the circular plate 154-1 of a Brush member 150 explained below. As a result, the length variable member 122 is elongated or constricted in combination with the up-down motion of the Brush member 150.

The length 11 of the first segment 122*a* is relatively longer than that 12 of the second segment. When the length variable member 122 is completely constricted, the second segment 122*b* is completely received in the interior of the first segment 122*a*. At this state, a given-sized receiving space is formed between the upper end of the second segment 122*b* and the opening of the first segment 122*a*, a gap is formed between the edge of the opening of the first segment 122*a* and the outside of the third segment 122*c*. When the Brush member 150 is completely descended, the outward projection 154*c* provided under the lower surface of the penetrating member 154 is inserted into the gap g by the outer force exerting on the Brush member 150 downward as explained below, as a result the Brush member 150 on which an elastic force is exerted by the second elastic member 114 will not be pull out.

The length variable member may be an antenna member of which plural cylindrical units are slidably joined to each other, a flexible coupling member such as a string or wire, or a fragmentary coupling member of which a plurality of fragmentary units are slidably joined to each other.

The supporting disc 122-1 of the length variable member 122 is provided with a cylindrical gear-coupling structure 140 through which the segments of the length variable member 122 penetrate.

2-3) Gear-coupling Structure 140

Gear-coupling structure 140 has a cylindrical housing 145 of which both ends are open. The lower end of the cylindrical housing 145 is provided with a circular base plate 146 having a penetrating hole h through which the segments of the length variable member 122 pass and attached with a cylindrical projection 146*a* extending upward. The base plate 146 also has a first coupling projection 146*b* provided at its upper surface around its edge. And, the lower side of the housing 145 is provided with a first catching hole 145*a* corresponding to the first coupling projection 146*b*. As the first catching hole is inserted with the first coupling projection 146*b*, the base plate 146 is engaged with the lower portion of the cylindrical housing 145. The gear-coupling structure 140 slidably inserted into the interior of the first cylindrical member 110 and seated on the supporting disc 122-1. The lower portion of the first cylindrical member 110 inserted into the second cylindrical member 120 is fixed with the edge of the base plate 146 by adhesive et al.

The upper interior of the cylindrical housing 145 of the gear-coupling structure 140 is provided with a plurality of inner projections 142 spaced a given distance away from each other. The space between the inner projections 142 acts as a guide groove 144 through which the outward projections 136, 139 of the gear-association member 130 is capable of sliding in the ups and downs direction as explained below. Lower end of each inner projection 142 is formed with a coupling groove 142*a* into which the upper end of the second outward projection 136 is coupled in the gear-association member.

Circular element 143 is interposed between the inner projections 142 and the base plate 146 in the cylindrical housing 145, the circular element 143 is elastically supported by the first elastic member 141 surrounding the cylindrical projection 146*a* to be seated on the base plate 146.

The interior of the cylindrical housing 145 of the gear-coupling structure 140 is provided with a gear-association member 130 through which the segments of the length variable member 122 are capable of penetrating.

2-4) Gear-Association Member 130

Gear-association member 130 is formed into a hollow housing, which is slidably inserted into the interior of the first cylindrical member 110. The housing is comprised of a first gearing element 138 having a first teeth 135 at its lower end, and a second gearing element 134 having a second teeth 137 opposite to the first teeth 135. The upper portion of the first gearing element 138 is provided with a mounting portion 132 on which the Brush member 150 is seated. The mounting portion 132 is manufactured into a cylindrical shape and has a bottom plate formed with a hole through which an outward projection 154*c* provided under the lower surface of the penetrating member 154 of the Brush member 150 is capable of protruding. The lower surface of the bottom plate of the mounting portion 132 is provided with a second coupling projection 132*a* extending downward and protruding outward.

And, the upper wall of the first gearing element 138 positioned below the mounting portion 132 is formed with a second catching hole 138*a* corresponding to the second coupling projection 132*a*. As the second coupling projection 132*a* engages to the second catching hole 138*a*, the mounting portion couples to the first gearing element 138.

A plurality of straight-lined outward projections 139, 136 spaced a given length away from each other are provided between the first gearing element 138 of the gear-association member 130 and the outer side of the second gearing element 134. The first gearing element 138 is categorized into a large part and a small part according to its inner diameter size. The outer periphery of the small part is formed with a plurality of first outward projections 139 spaced a given distance away from each other, and the first teeth 135 are formed on the lower end of the small part.

Also, the second gearing element 134 is classified into a large portion and a small portion according to its outer diameter size. The outer periphery of the large portion is formed with a plurality of second outward projections 136 spaced a given distance away from each other, an inclined surface is formed on the lower portion of the second outward projections 36. The outer diameter of the small portion and the inner diameter of the small part are preferably kept to be same.

The upper end of the small portion is provided with a flange 134*a* extending outside therefrom. When the flange is inserted into the large part of the first gearing element 138 to be seated on the upper end of the small part, the first gearing element 138 and the second gearing element 134 are combined each other. And, a given-sized space S is formed between the upper surface of the flange 134*a* and the lower surface of the mounting portion 132 to form a gap corresponding to the vertical height of the space S between the first teeth 135 and the second teeth 137. Thus, the first gearing element 138 and the second gearing element 134 are capable of sliding each other in the ups and downs direction within the clearance corresponding to the gap.

In the meshing state of the first gear teeth 135 and the second gear teeth 137, the first outward projection 139 is crossed with the second outward projection 136 by ½ pitch.

2-5) Brush Member 150

Brush member 150 seated on the mounting portion 132 of the gear-association member 130 has a brush 152 of which lower portion is fastened by a binder 151, and a penetrating member 154 positioned under the brush 151 and seated on the bottom portion of the mounting portion 132. The center of the binding portion of the brush 152 formed by the binder 151 is formed with a given-sized hole, to which a cylindrical member 56 is inserted and fixed. The penetrating member 154 has a circular plate 154-1 seated on the bottom surface of the mounting portion 132, and an extending portion 154*a* elongated upward from the circular plate 154-1. And, the extending portion 154*a* of the penetrating member 154 has enough length to be buried in the brush 152 after passing the cylindrical member 156.

The upper portion of the extending member 154*a* is provided with a relatively small coupling portion. The coupling portion is equipped with a catching member 153, which extends over the upper end of the extending member 154*a*. The upper end of the catching member 153*a* is extended inward to form an given-sized opening. As explained below, a pressing projection 162 of the protection cap 160 is inserted and coupled via the opening.

Figure 20:
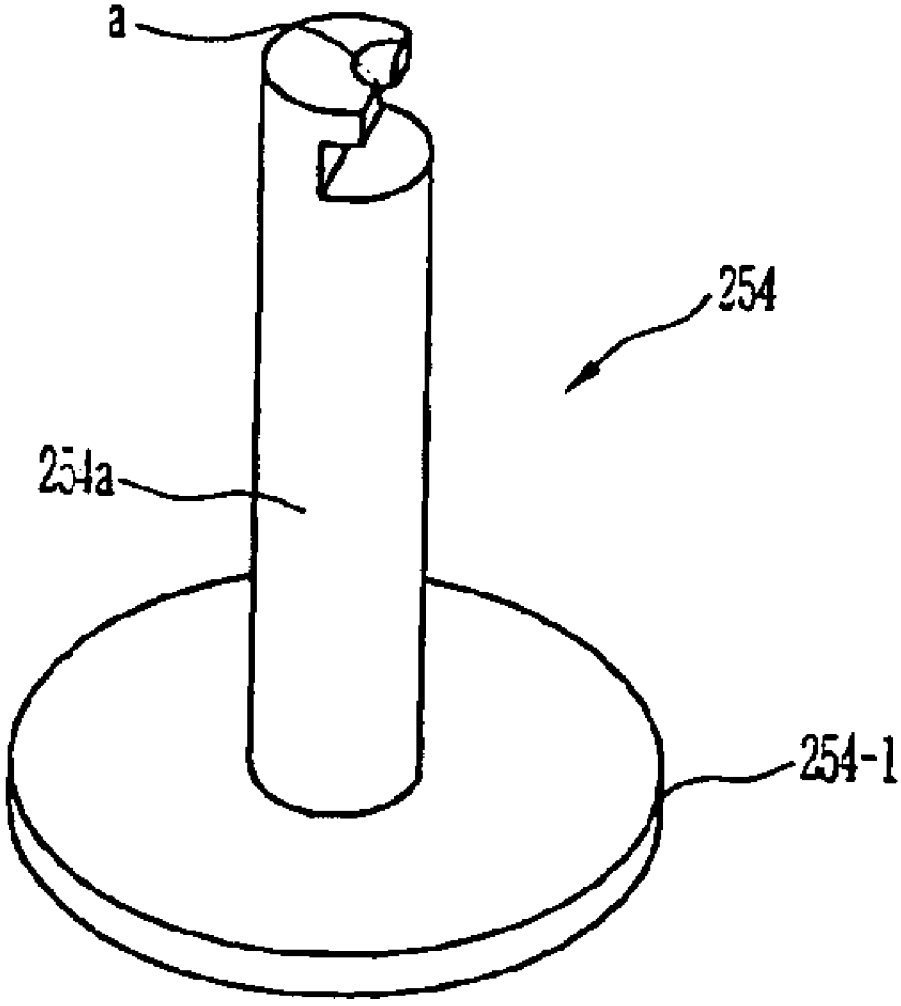
FIG. 20 is a perspective view showing the penetration member according to the other embodiment of this invention.

Referring to FIG. 20, a penetrating member 254 fabricated according to the other embodiment of this invention is shown. The penetrating member 254 has a circular plate 254-1 seated on the bottom surface of the mounting portion 232 (see FIG. 7), and an extending portion 254*a* extending upward therefrom. The upper end of the extending portion 254*a* is integrally manufactured with a catching member a formed by a partial cutting. The pressing projection 162 of the protection cap 160 is coupled with the catching member a. That is, the structure and function of the penetrating member 254 except its end structure shown in FIG. 20 is identical with those of the penetrating member 154 shown in FIG. 7.

Again, referring to FIG. 7, the lower center of the circular disc 154-1 is formed with a given-depth groove c. As mentioned above, the groove c is inserted with the upper end of the third segment 122*c* of the length variable member 122. The outward projection 154*c* extending downward and then protruding outward is provided around the groove c. The outward projection 154*c* is exposed via a hole formed in the bottom surface of the mounting portion 132.

When the gear-coupling structure 140 is inserted with the gear-association member 130 in which the first gearing element is coupled with the second gearing element 134, the third segment 122*c* of the length variable member 122 is inserted into the groove c of the penetrating member 154 of the brush structure via the interior of the gear-association member 130. The second elastic member 114 having the relatively smaller diameter than that of the first elastic member 141 is provided around the segments of the length variable member 122.

Especially, the second elastic member 114 is interposed between the lower surface of the circular plate 15-1 exposed via the hole formed in the mounting portion 132 of the gear-association member 130 and the upper surface of the cylindrical projections 146*a* of the gear-coupling structure 140 to exert the elastic force on the Brush member 150 upward. However, as mentioned above, when the outward projections 154*c* provided under the lower portion of the circular plate 154-1 of the penetrating member 154 is inserted into the gap g formed in the upper opening of the first segment 122*a* of the length variable member, the Brush member 150 on which the elastic force of the second elastic member 114 exerts upward will not be drawn out.

The opening of the catching member 153 is contacted with a pressing projection 162 extending downward from the upper interior of the protection cap 160 which will be explained below.

2-6) Protection Cap 160

When the brush 152 of the Brush member 150 is involved in the first cylindrical member 110, the upper end of the first cylindrical member 110 is covered with the cylindrical protection cap 160. The protection cap 160 has a supporting circular plate attached on its interior and the pressing projections 162 extending downward from the side of the supporting circular plate. The pressing projection 162 moves downward to reach to the opening of the catching member 153 during the protection cap 160 is covering on the upper end of the first cylindrical member 110.

The pressing projection 162 has a sharp shape to reach into the opening of the catching member 153 without the damage of the brush 152. The end portion of the pressing projection 162 is manufactured to any shape having a relatively small diameter waist. The center of the opening provided in the catching member 153 is coaxial with the center of the pressing projection 162, whereas the center of the small diameter waist is biased from the center of the pressing projection 162.

As a result, after the end portion of the pressing projection 162 passes through the opening of the catching member 153, the narrow width waist portion interlocks with the edge of the opening of the catching member 153. In this state, when the protection cap 160 is pulled out upward, the engagement of the outward 154*c* and the length variable member 122 is released as the Brush member 150 is moved upward, and the end portion of the pressing projection 162 is detached from the opening of the catching member 153.

The actuation of the cosmetic brush assembly according to the second embodiment of this invention will be explained as follows.

Figure 10:
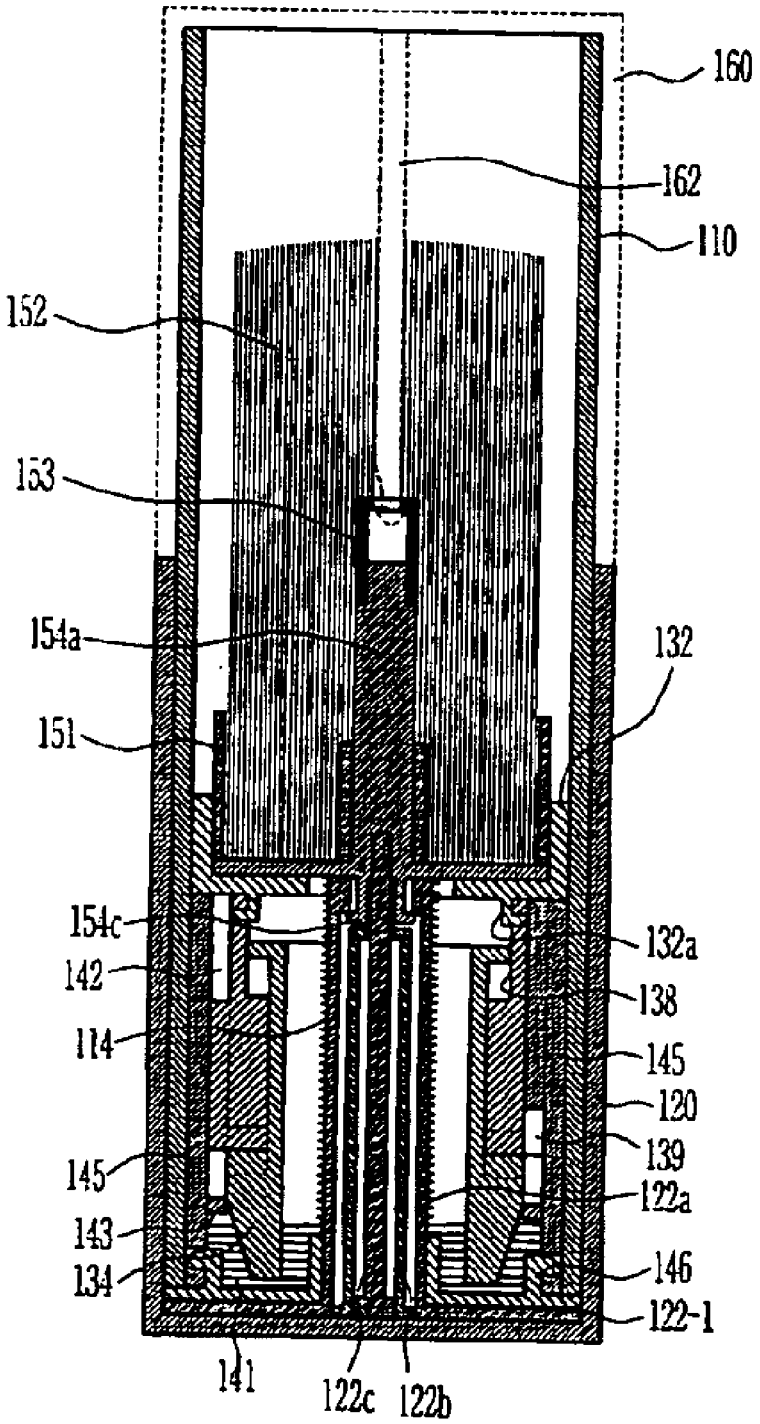
FIG. 10 is a sectional view showing the engagement state of the cosmetic brush assembly according to a second embodiment of this invention.

Referring to FIG. 10, the lower interior of the second cylindrical member 120 is fixed with the supporting disc 122-1 of the length variable member 122 and segments 122*a*, 122*b*, 122*c* are vertically established. The base plate 146 of the gear-coupling structure 140 is seated on the supporting disc 122-1. The lower portion of the first cylindrical member 110 is inserted into the interior of the second cylindrical member 120, of which the end portion is attached on the edge of the base plate 146 by the adhesive. At this time, the interior of the cylindrical housing 145 of the gear-coupling structure 140 is inserted with the gear-association member 130 of which the mounting portion 132 is seated with the Brush member 150.

The upper end of the third segment 122*c* of the length variable member 122 is screw coupled with the groove c of the penetrating member 154 exposed via the hole formed at the bottom plate of the mounting portion 132. The brush 152 of the Brush member 150 is maintained to be completely received into the first cylindrical member 110, and the first and second elastic members 141 and 114 surround the segments of the length variable member 122. The second elastic member 114 is interposed between the top surface of the cylindrical projection 146*a* established on the base plate 146 and the circular plate 154-1 exposed via the hole formed at the bottom plate of the mounting portion 132 to exert the elastic force on the Brush member 150 upward.

The brush 152 of the Brush member 150 is maintained to be completely received into the first cylindrical member 110, and the upper opening of the first cylindrical member 110 is covered with the protection cap 160. The pressing projection 162 provided in the protection cap 160 is inserted into the opening of the catching member 153 placed at the coupling portion of the extending portion 154*a* buried in the brush 152, the outward projections 154*c* of the penetrating member 154 exposed via the hole formed at the mounting portion 132 of the gear-association member 130 is inserted into the gap g formed at the top end of the first segment 122*a* of the length variable member 122. The brush 152 is completely received in the first cylindrical member 110 the gear-association member 130 is positioned under the first cylindrical member 110.

Figure 11:
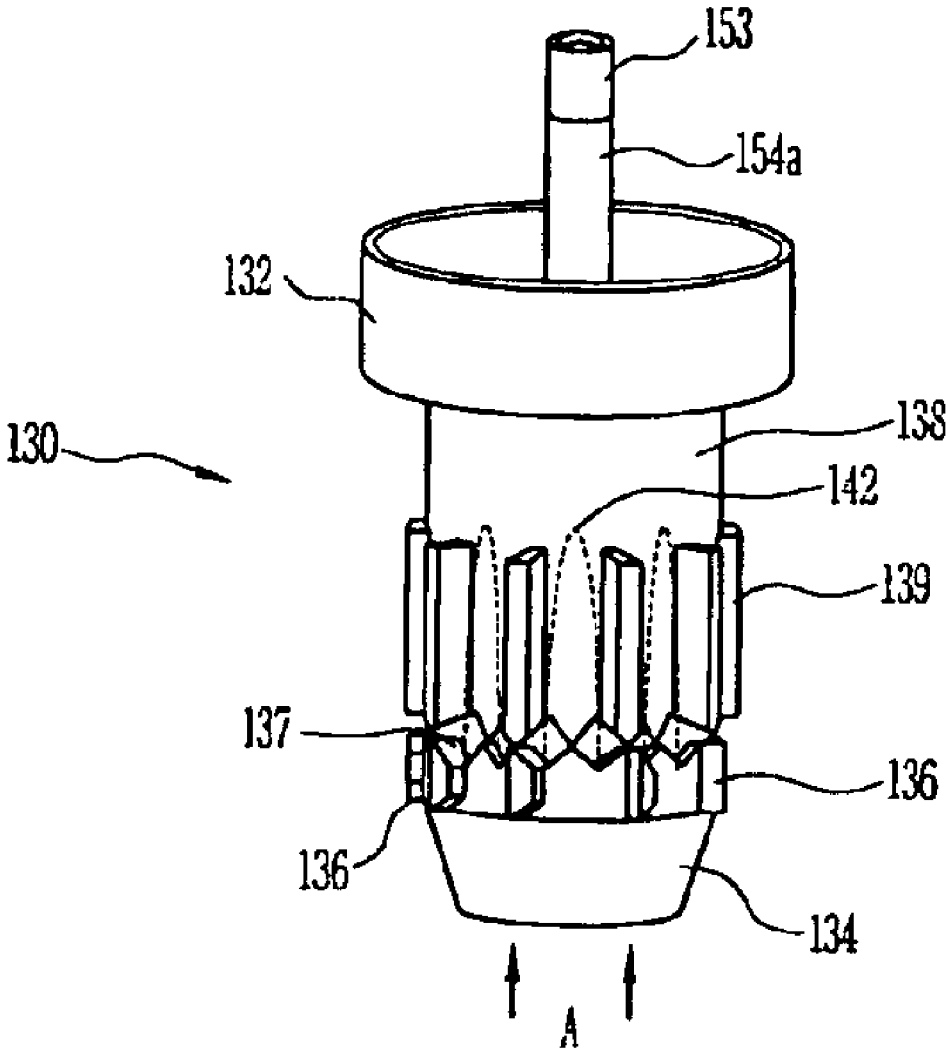
FIG. 11 is a sectional view showing the engagement state of both the gear association member and a gear-coupling structure in the engagement state of FIG. 10.

As shown in FIG. 11, the first and second outward projections 136, 139 are positioned in the guide groove 144 formed between the inner projections of the gear-coupling structure 140. Although the elastic force of the first and second elastic member 141, 114 exerts on the gear-association member 130 along the arrow A, the Brush member 150 will not be pulled out because the outward projections 154*c* of the penetrating member 154 are inserted and fixed to the gap g formed at the upper end of the first segment 122*a* of the length variable member 122.

Figure 12:
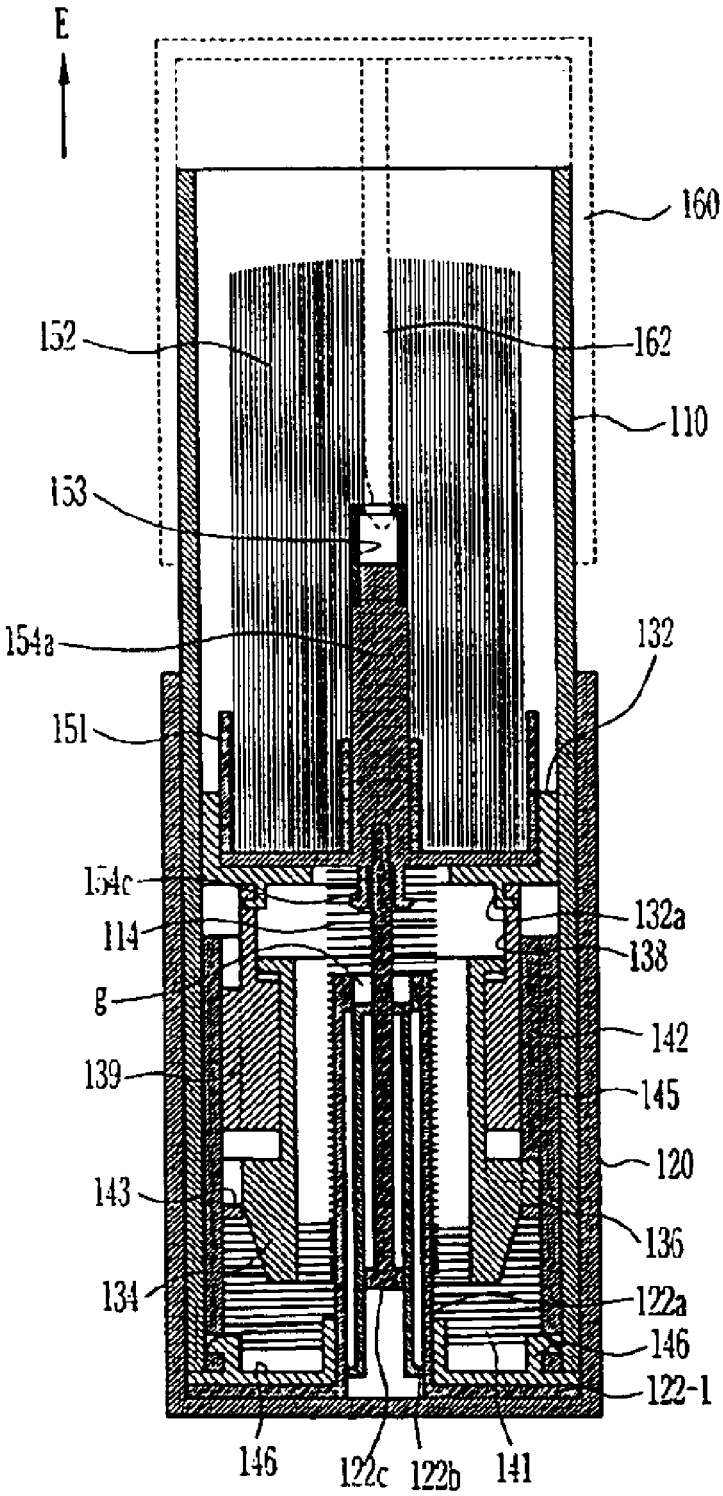
FIG. 12 is a view showing the separation state of the brush protection cap from the first cylindrical member according to a second embodiment of this invention.

Referring to FIG. 12, the protection cap is pulled out along the arrow E in order to draw out the brush 152 received in the first cylindrical member 110. As the Brush member 150 moves upward the outward projection 154*c* of the penetrating member 154 is detached from the gap g provided in the first segment 122*a* of the length variable member 122 in connection with the upward movement of the protection cap 160 because the pressing projection 162 of the protection cap 160 is interlocked to the catching member 152 established at the coupling portion of the extending portion 154*a*.

Figure 13:
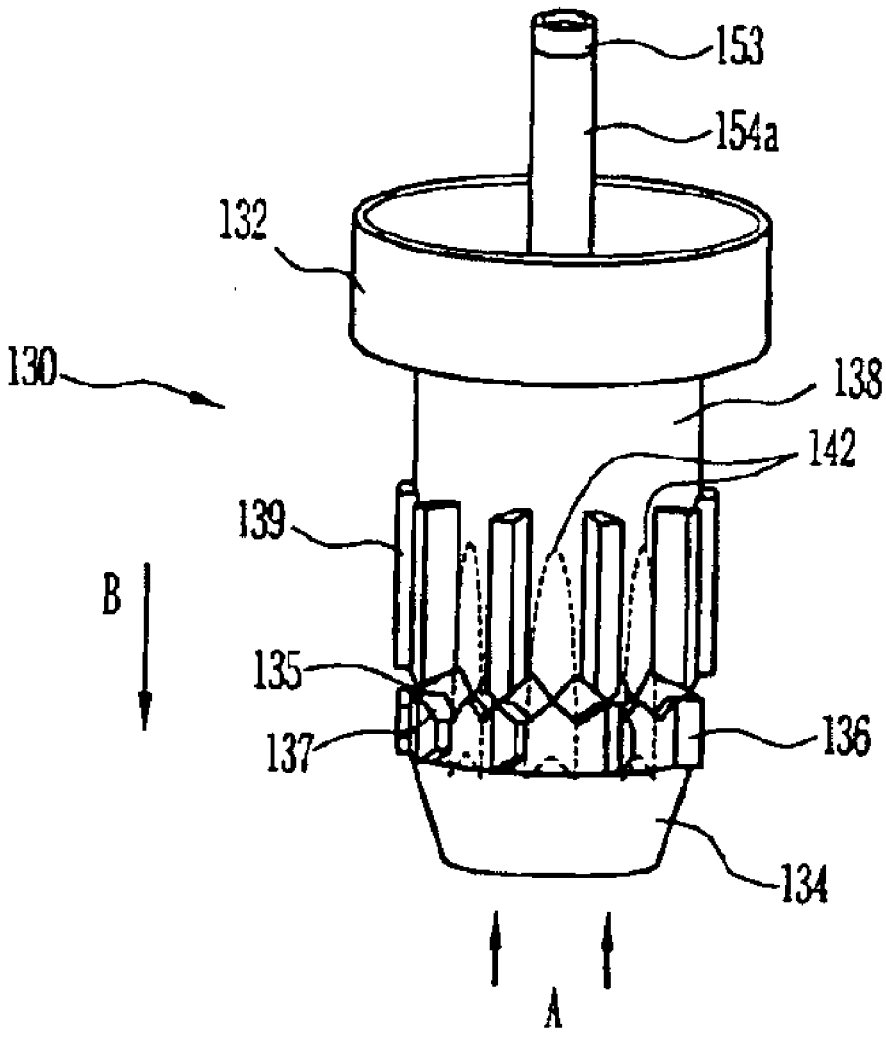
FIG. 13 is a sectional view showing the engagement state of both the gear association member and a gear-coupling structure in the state of FIG. 12.

As depicted in FIG. 13, because of the elastic force of the second elastic member 114 exerting on the gear-association member 130, the first and second outward projections 136, 139 are moved upward along the guide groove 144 formed on the inner surface of the gear-coupling structure 140 in the direction of arrow A.

Since the protection cap 160 is tightly fitted into the outer surface of the cylindrical member 110, the upward movement of the gear-coupling structure 140 is stopped when the upward movement of the protection cap 160 is stopped and then the upward movement of the brush structure is stopped. However, the protection cap 160 is further pulled out in the direction of arrow E, the pressing projection 162 is detached from the catching member 153.

Figure 14:
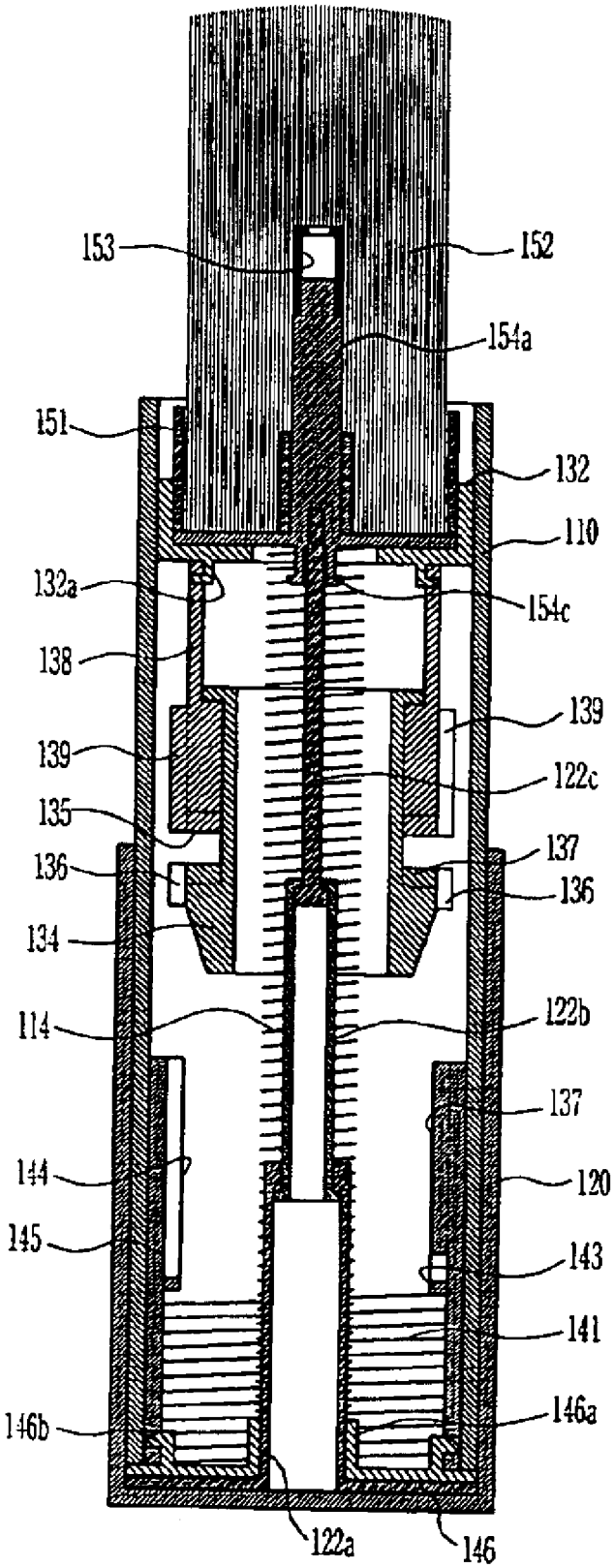
FIG. 14 is a view showing after the separation of the brush protection cap from the first cylindrical member according to a second embodiment of this invention.
Figure 15:
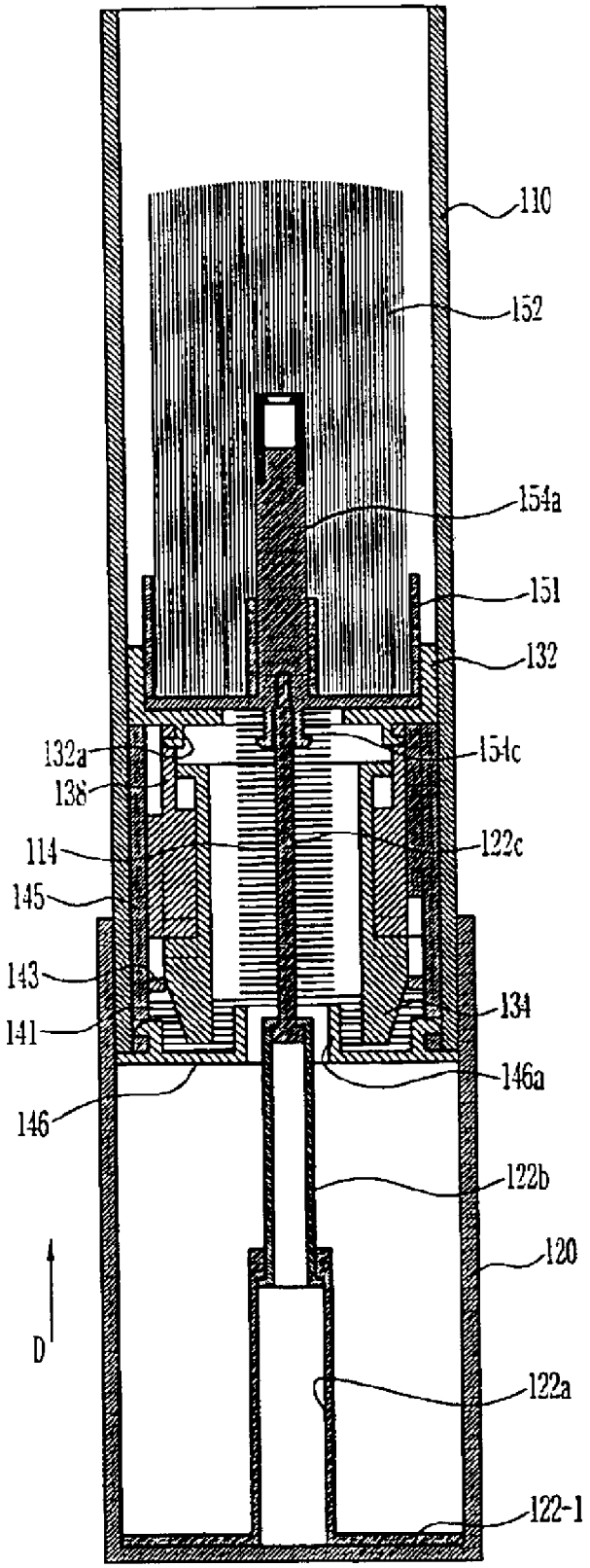
FIG. 15 is a sectional view showing the actuation state to retain the exposed brush into the first cylindrical member according to a second embodiment of this invention.

As shown in FIG. 14, when the protection cap 160 is departed from the first cylindrical member 110, the gear-association member 130 and the Brush member 150 is moved upward by the elastic force of the second elastic member 114 to expose the brush 152 outside. At this state, the length variable member 122 is elongated to its maximum length. Since the gear-association member 130 is completely separated from the gear-coupling structure 140, the elastic force of the first elastic member 141 does not exert on the second gearing element 134. As a result, the first teeth 135 provided at the lower portion of the first gearing element 138 is separated from the second teeth 137 provided at the upper portion of the second gearing element 134 by its maximum distance.

As mentioned above, after the brush 152 exposed outside by the detachment of the protection cap 160 from the first cylindrical member 110, the user grips the second cylindrical member 120 and then moves the first cylindrical member 110 upward in order to receive again the brush in the first cylindrical member 110. Since the lower end of the first cylindrical member 110 is attached on the edge of the base plate 146, the gear-coupling structure 140 moves upward in connection with the upward movement of the first cylindrical member 110. And, since only the base plate 146 is detached from the supporting disc 122-1 of the length variable member 122, the length variable member 122 is extended to its maximum length.

Referring again to FIG. 13, the first and second outward projections 139, 136 of the gear-association member 130 is inserted into the guide groove 144 formed between the inner projections 142 of the gear-coupling structure 140 along the arrow B direction.

Figure 16:
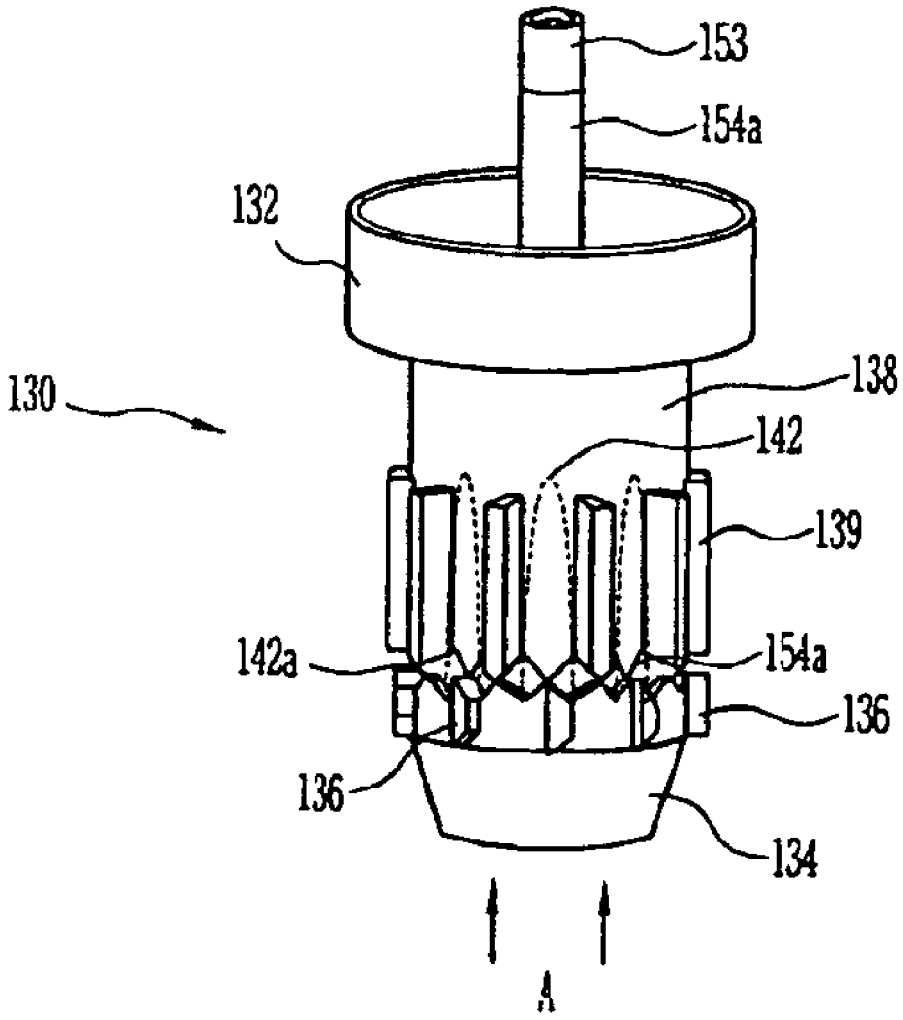
FIG. 16 is a sectional view showing the engagement state of both the gear association member and a gear-coupling structure in the state of FIG. 15.

When the second outward projections 136 are completely separated from the lower portion of the guide groove 144 of the gear-coupling structure 140, the first elastic member 141 exerts the elastic force on the second gearing element 134 via the circular element 143. The second gearing element 134 turns on its axis by ½ pitch to position the second outward projections 136 of the second gearing clement 134 under the coupling groove 142*a* of the inner projections 142 of the gear-coupling structure 140 as shown in FIG. 16.

When the upward movement of the first cylindrical member 110 is stopped, the second gearing element 134 will be slid upward by the elastic force of the first elastic member 141 upwardly exerting on the second gearing element 134. However, as mentioned above, since the second outward projections 136 of the second gearing element 134 couples to the coupling groove 142*a* of the inner projections 142 of the gear-coupling structure 140, the upward movement of the second gearing element 134 is restricted. The upward movement of the first gearing element 138 exerted with the elastic force of the second elastic member 114 is also restricted. As a Result, the brush is kept being received in the first cylindrical member 110.

Figure 17:
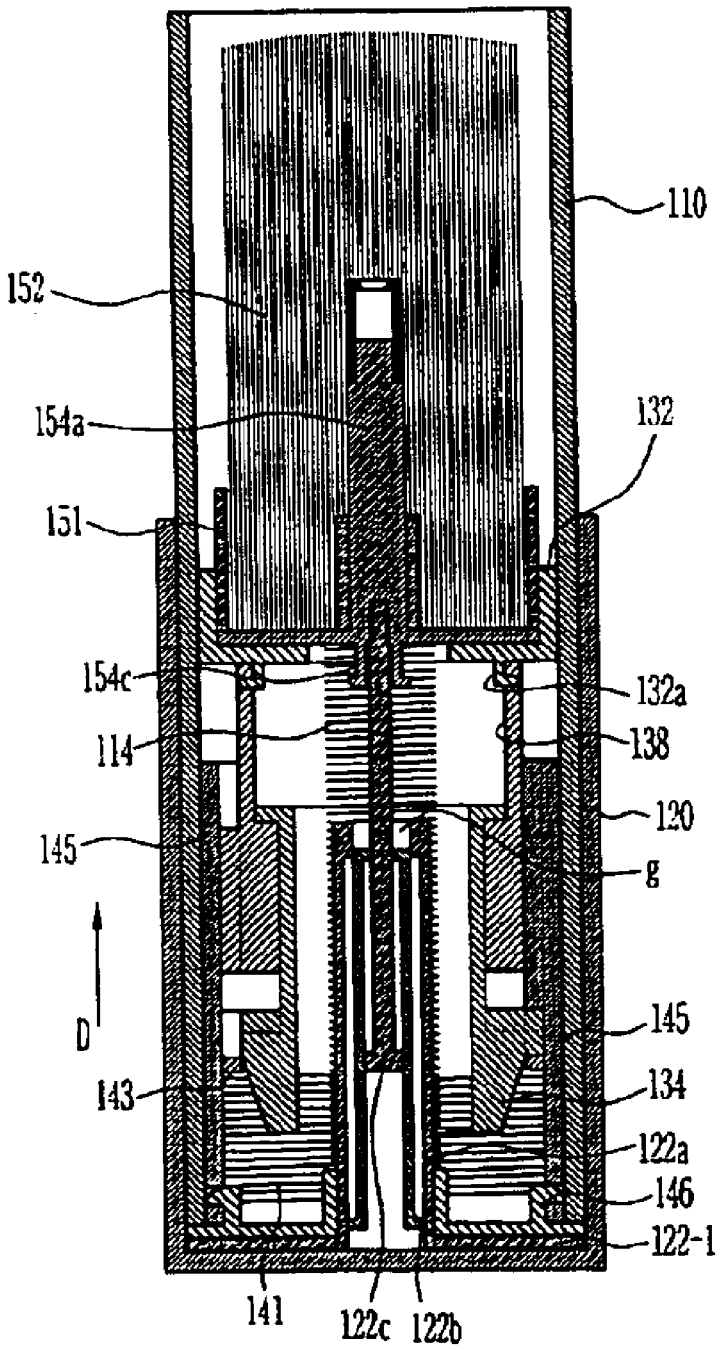
FIG. 17 is a sectional view showing the constriction state of the length variable member after the brush is involved into the first cylindrical member.

As shown in FIG. 17, when user grips the first cylindrical member 110 and moves the second cylindrical member 120 along the arrow D, the length variable member 122 is kept at minimum length. When the second segment 122*b* is completely received in the first segment 122*a*, the gap g is formed between the upper opening of the first segment 122*a* and the upper portion of the third segment 122*c*. However, the outward projections 154*c* exposed through the hole formed in the mounting portion 132 of the gear-association member 130 is positioned on the gap g formed on the upper opening of the first segment 122*a* because the elastic force of the second elastic member 114 upwardly exerts on the Brush member 150.

Figure 18:
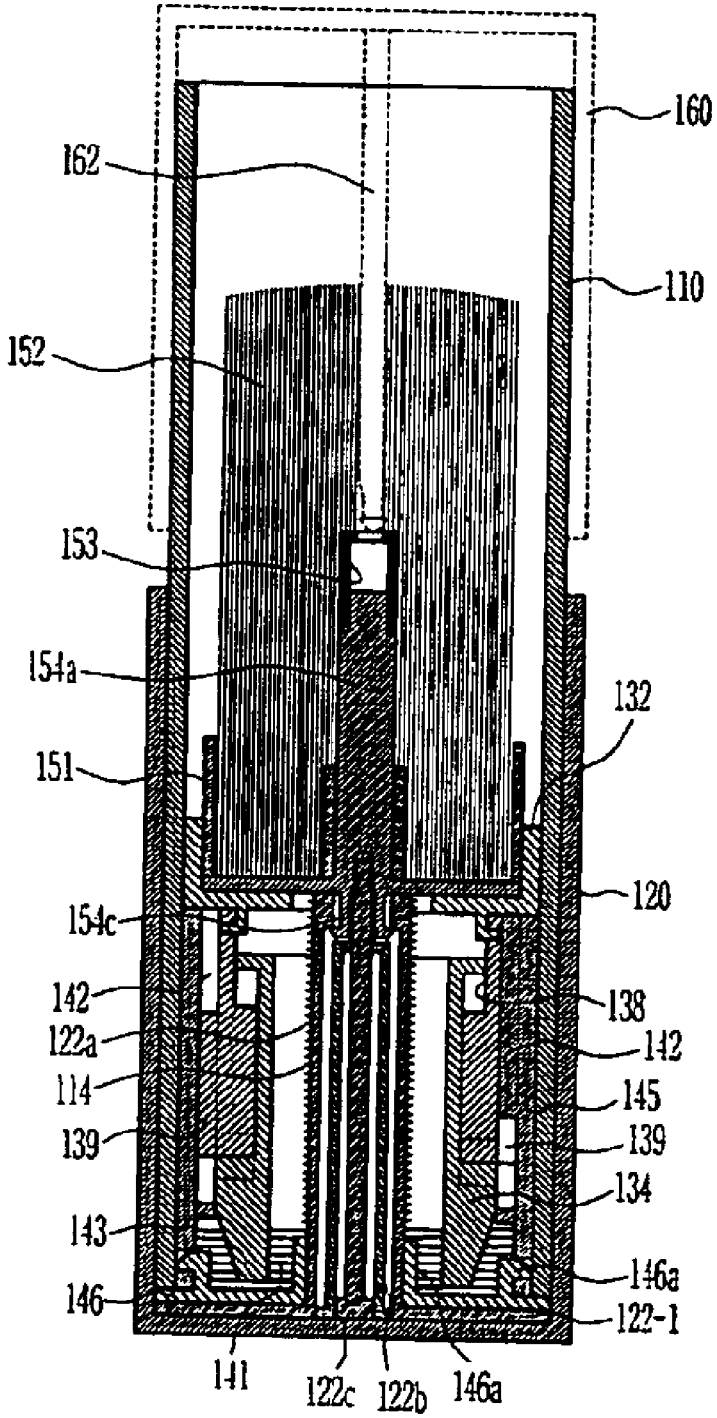
FIG. 18 is a sectional view showing that the upper portion of the first cylindrical member is covered with the brush protection cap.

The protection cap 160 is covered over the opened top portion of the first cylindrical member 110 to protect the brush 152 received in the first cylindrical member 110. That is, as shown in FIG. 18, during the protection cap 160 covers the upper portion of the first cylindrical member 110 and then moves downward, the pressing projection 162 involved in the protection cap 160 is kept descending through the brush 152 so that its distal end reaches to the catching member 153 established on the coupling portion of the extending portion 154*a* of the penetrating member 154 buried in the brush 152. And, as the protection cap 160 is further moved downward, the pressing projection 162 suppresses the penetrating member 154 and the circular plate 154-1 via the catching member 153.

As the Brush member 150 descends during the pressing force of the pressing projection 162, the outward projection 154*c* provided under the penetrating member 154 also descend to insert into the gap g formed at the upper opening of the first segment 122*a* of the length variable member 122.

And, the pressing projection 162 further exert the pressing force, the end of the pressing projection 162 is inserted into the opening provided on the end portion of the catching member 153 as shown in FIG. 10. At this state, the protection cap 160 covers the first cylindrical member 110.

When the pressing force of the pressing projection 162 is transmitted into the gear-association member 130 to press the first gearing element 138, the first and second teeth 135, 137 are engaged each other and the second outward projections 136 of the second gearing element 134 is detached from the coupling groove 142*a* of the inner projection 142 of the gear-coupling member. That is, as shown in FIG. 11, the second gearing element 134 turns on its axis by ½ pitch, thereby the first and second outward projections 136, 139 are aligned each other.

As a result, the cosmetic brush assembly according to the second embodiment of this invention keeps the pulling out standby state of the brush 152 as the first cylindrical member 110 is completely covered with the protection cap. Thus, as discussed above, the brush 152 may be drawn out from the first cylindrical member 110 by removing the protection cap 160.

Example 3

A cosmetic brush assembly according to the third embodiment of this invention has a predetermined length of a first cylindrical member 220 of which both ends are open. The lower portion of the first cylindrical member 220 is received into a second cylindrical member 230 of which lower end is closed. The upper portion of the first cylindrical member 220 is covered with a cylindrical protection cap 240.

The first cylindrical member 220 is projectably involved with a brush 210 of which lower portion is fastened by a binder 212 to become a binding portion. The center of the binding portion is formed with a given-sized penetration hole h. The aperture h is installed with a tube member 214. The hollow portion of the first cylindrical member 220 is slidably received with a brush-supporting structure 260 having a circular plate 262 on which the brush 210 is mounted. The lower surface of the circular plate 262 is provided with a groove 262*a* and an outward projection 262*b* extending downward and then protruding outward around the groove 262*a*. The upper portion of the circular plate 262 is provided with an upward extending member 262*c* of which the upper end is provided with a coupling groove 262*d*.

The lower portion of the brush-supporting structure 260 is provided with a length variable member 250 having a smallest diameter innermost segment 256 of which end portion is coupled with the groove 262*a* of the circular plate 262. In drawings, the end portion of the innermost segment 256 is drawn to be screw machined and the end portion is screw coupled with the groove 262*a*. However, the end portion is not restricted to this. For example, the end portion of the innermost segment 256 is not screw worked and may be attached to the groove 262*a* with adhesive et al.

The length variable member 250 has a supporting disc 258 fixed on the bottom surface of the second cylindrical member 230 into which the first cylindrical member 220 is received. The supporting disc 258 is perforated to make a hole and is provided with a given length cylindrical outermost segment 252, which has a hollow portion communicating with the hole and extends upward. The upper end of the outermost segment 252 is formed with a relatively small aperture compared with the hole. The hollow portion of the outermost segment 252 is received with a plurality of segments inserting upward from down to penetrate the hole and having different diameter. An innermost segment 256 having a smallest diameter is provided adjacent to the center of the length variable member 250.

In drawings, only one middle segment 254 is positioned between the outermost segment 252 and innermost segment 256. However, the number of the middle segment 254 is not limited to this. On the other hand, only the outermost segment 252 and innermost segment 256 are provided without the middle segment.

Figure 28A:
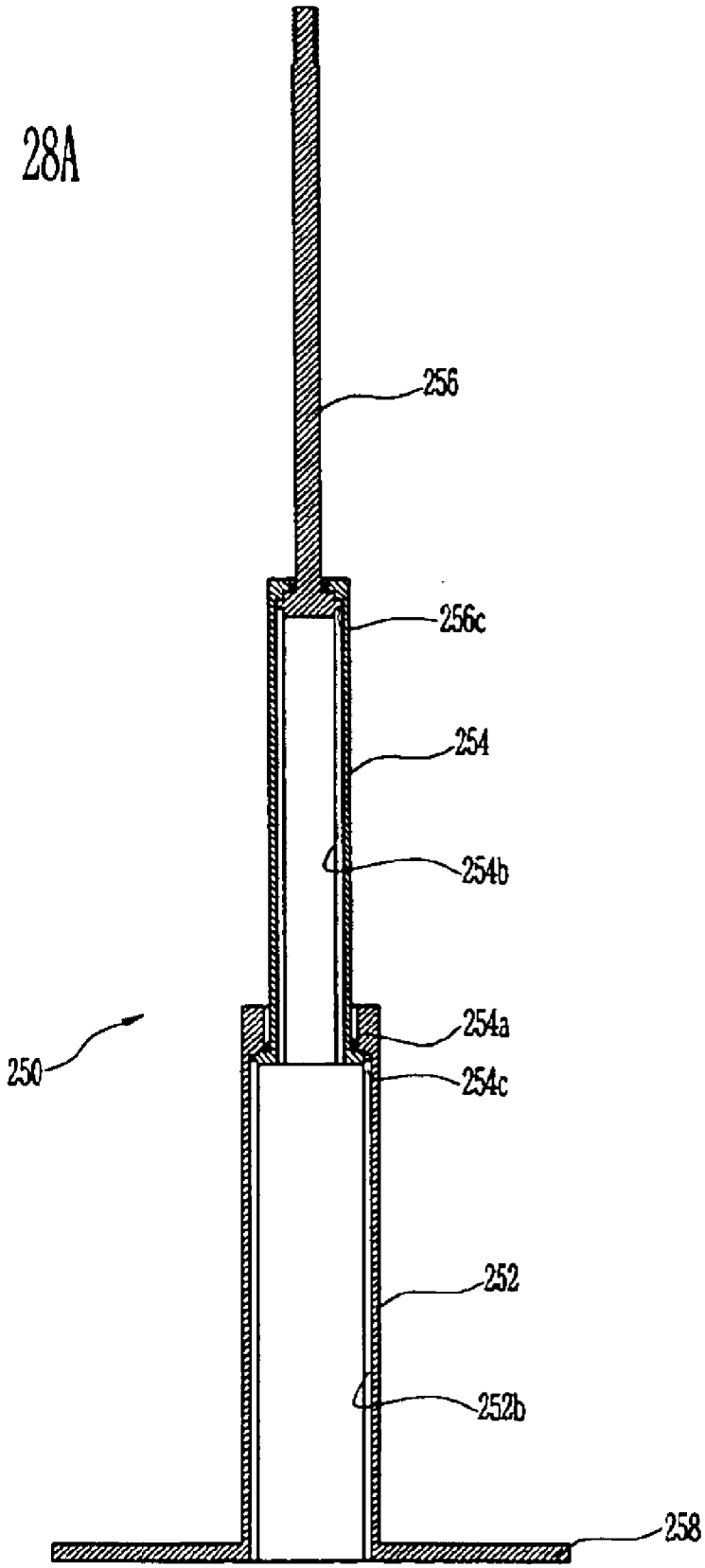
FIG. 28*a* is a sectional view showing the elongated state of a length variable member, FIG. 28*b* a sectional view showing the constricted state of a length variable member.

The lower ends of both the outermost segment 252 and innermost segment 256 is provided with a flange extending outward, and the upper end of the segments except the innermost segment 256 is formed with an opening through which any segment may be capable of being pulled out upward. As shown in FIG. 28, the flange helps the length variable member 250 be elongated to its maximum length without the separation of the segments 254, 256. Further, the flange of the segments 254, 256 is provided with a bump 254*a* having a slope surface which is tilt downward and outward. When the length variable member 250 is elongated to its maximum length, the bump 254*a* is interference fitted with the opening of the segments to maintain the length variable member 250 on its elongation.

Figure 28B:
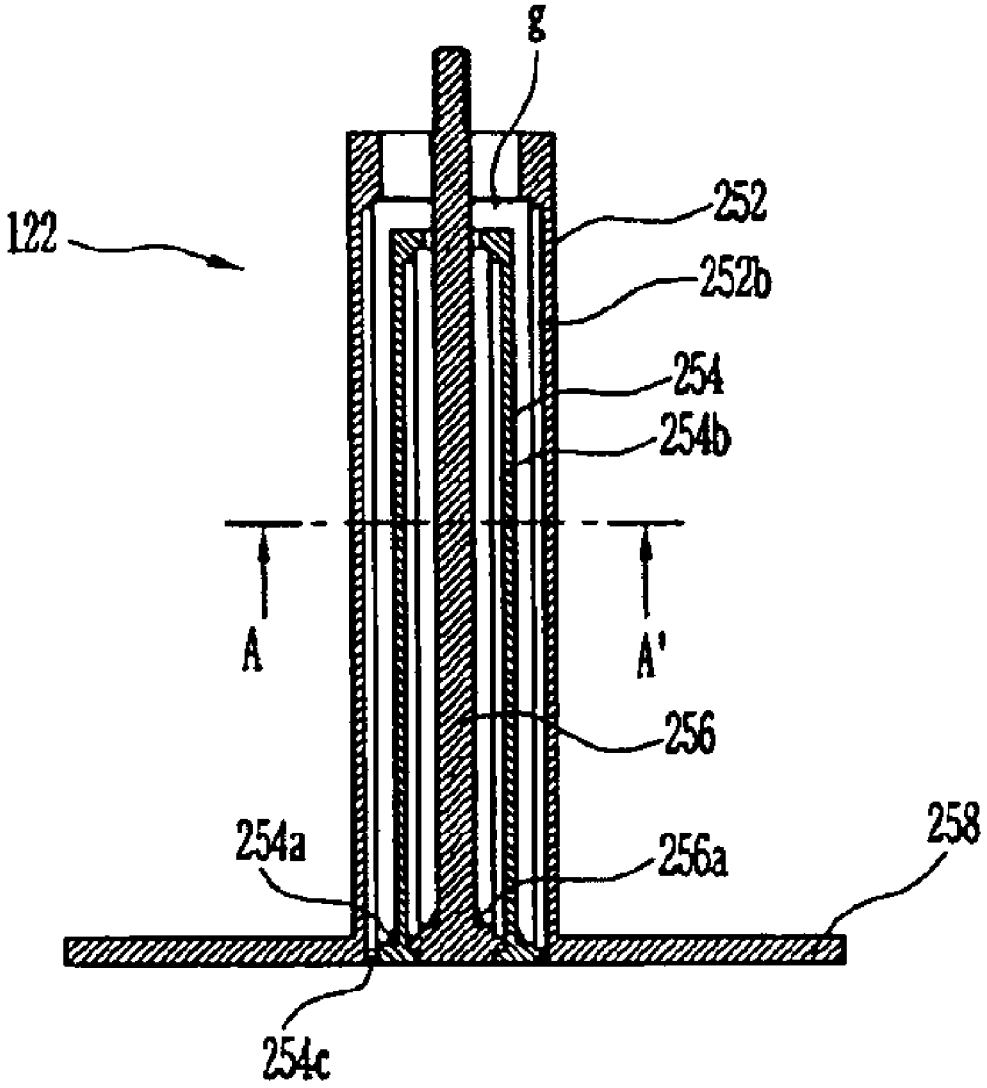
Figure 29:
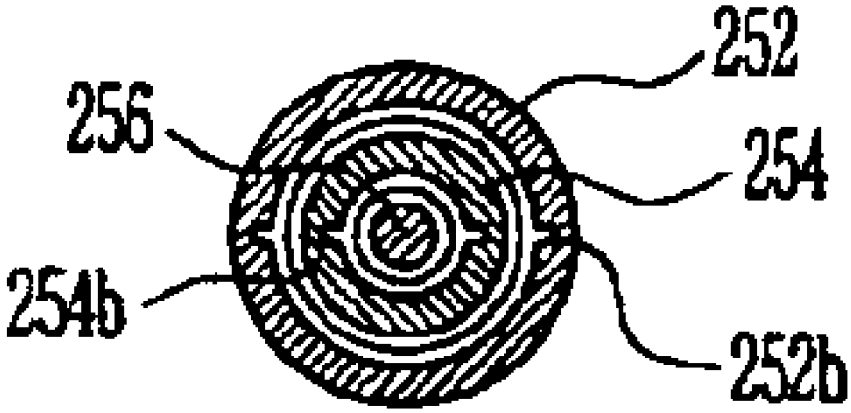
FIG. 29 is a sectional view taken along the line A-A' in FIG. 28*b;*

Referring to FIG. 28*b*, the innermost segment 256 has such a length that its screw portion may protrude over the opening formed in the upper portion of the outermost segment 252. The middle segment 254 except the innermost segment 256 has a relatively short length compared with the outermost segment 252. Thus, when the length variable member 250 is constricted to its minimal length, a gap g is formed between the inner periphery of the outermost segment 252 and the innermost segment 256. As explained below, when a protection cap 240 completely covers the upper portion of the first cylindrical member 220 to constrict the length variable member 250 to its minimal length, the outward projection 262*b* of the brush-supporting structure 260 is strongly fitted with the gap g.

The protection cap 240 has a cylindrical structure being capable of covering the upper portion of the first cylindrical member 220. The upper interior of the protection cap 240 is provided with a circular attaching plate, the attaching plate is provided with a pressing projection 242 which extends downward therefrom and separably engage with the coupling groove 262*d* of the brush-supporting structure 260. The end portion 242*a* of the pressing projection 242 has a sharp structure. The sharp structure prevents the crush of the brush when the protection cap 240 covers the upper portion of the first cylindrical member 220.

The following description relates to the operation of the cosmetic brush assembly in accordance with the third embodiment of the present invention.

Figure 22:
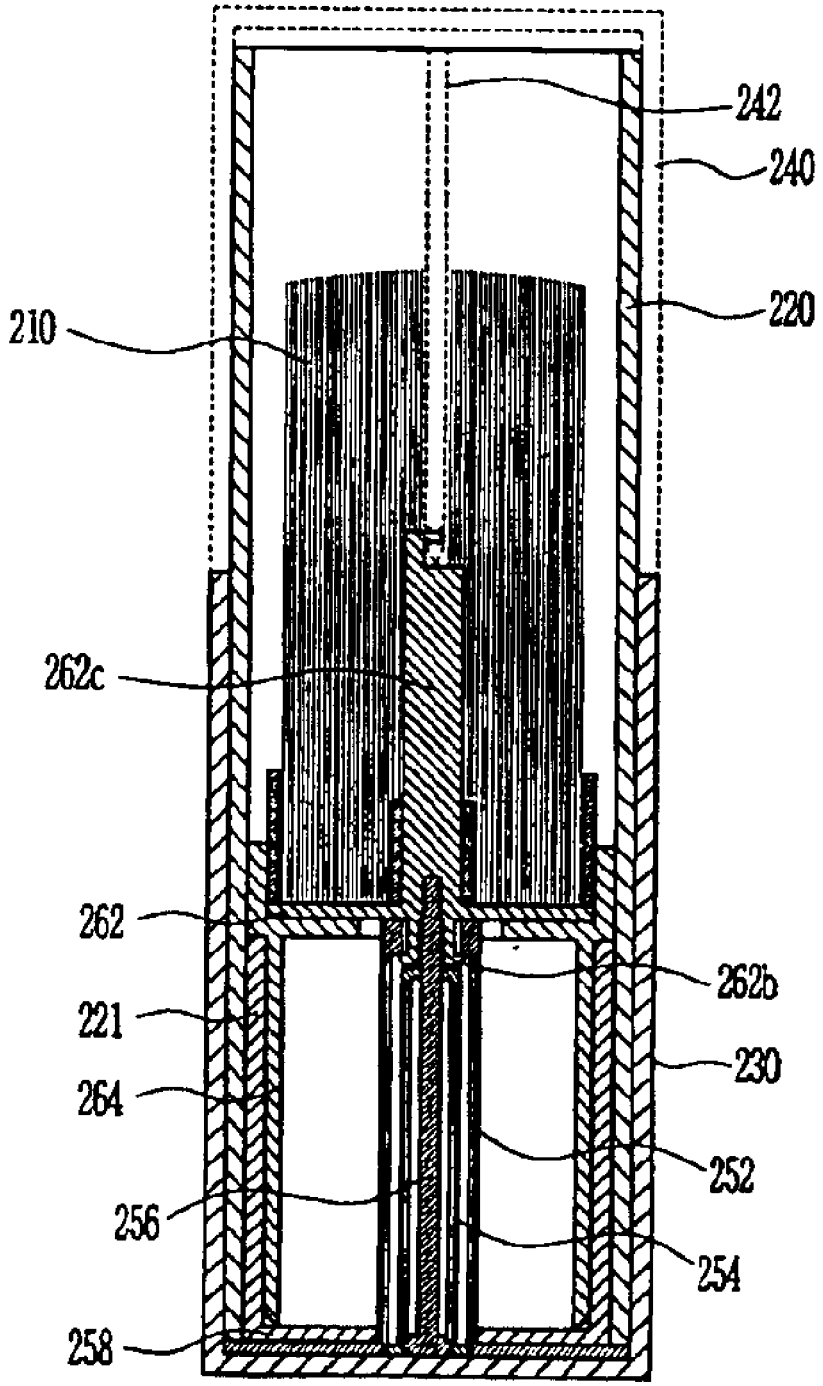
FIG. 22 is a sectional view showing the engaging state of the cosmetic brush assembly according to the invention.

Referring to FIG. 22, the lower portion of the second cylindrical member 230 is fixed with the supporting disc 258 of the length variable member. The middle segment 254 and the innermost segments are positioned in turn in the hollow portion of the outermost segment 252. The second cylindrical member 230 is involved with the lower portion of the first cylindrical member 220. The lower interior of the first cylindrical member 220 is fixed with the cylindrical guiding member 221 with a hole at its lower plate.

The outermost segment 252 of the length variable member 250 is penetrating the hole of the cylindrical guiding member 221.

The upper end of the cylindrical guiding member 221 is seated with the brush supporting structure 260 having an extension part 264 extending downward, in which the extension part 264 is involved in the guiding member 221. The screw part of the innermost segment 256 is penetrating the hole of the extension part 264 and then screw coupled to the groove 262*a* formed the lower portion of the circular plate 262. The outward projection 262*b* of the brush supporting structure 260 is press fitted to the gap g formed on the outermost segment 252. The brush 210 is fixed on the brush supporting structure 260, in which the upward extending member 262*c* is passing through the penetration hole h.

The upper portion of the first cylindrical member 220 is covered with the protection cap 240 of which lower end is opposite to the upper end of the second cylindrical member 230. The pressing projection 242 of the protection cap 240 is penetrating the penetration hole h and then is tightly fitted into the coupling groove 262*d* of the upward extending member 262*c* involved in the brush 210. Due to the tightly fitting, the protection cap 240 is firmly grasped not to be optionally detached from the first cylindrical member 220.

Now, the following description relates to the operation pulling out the brush 210 being kept in the first cylindrical member 220.

Figure 23:
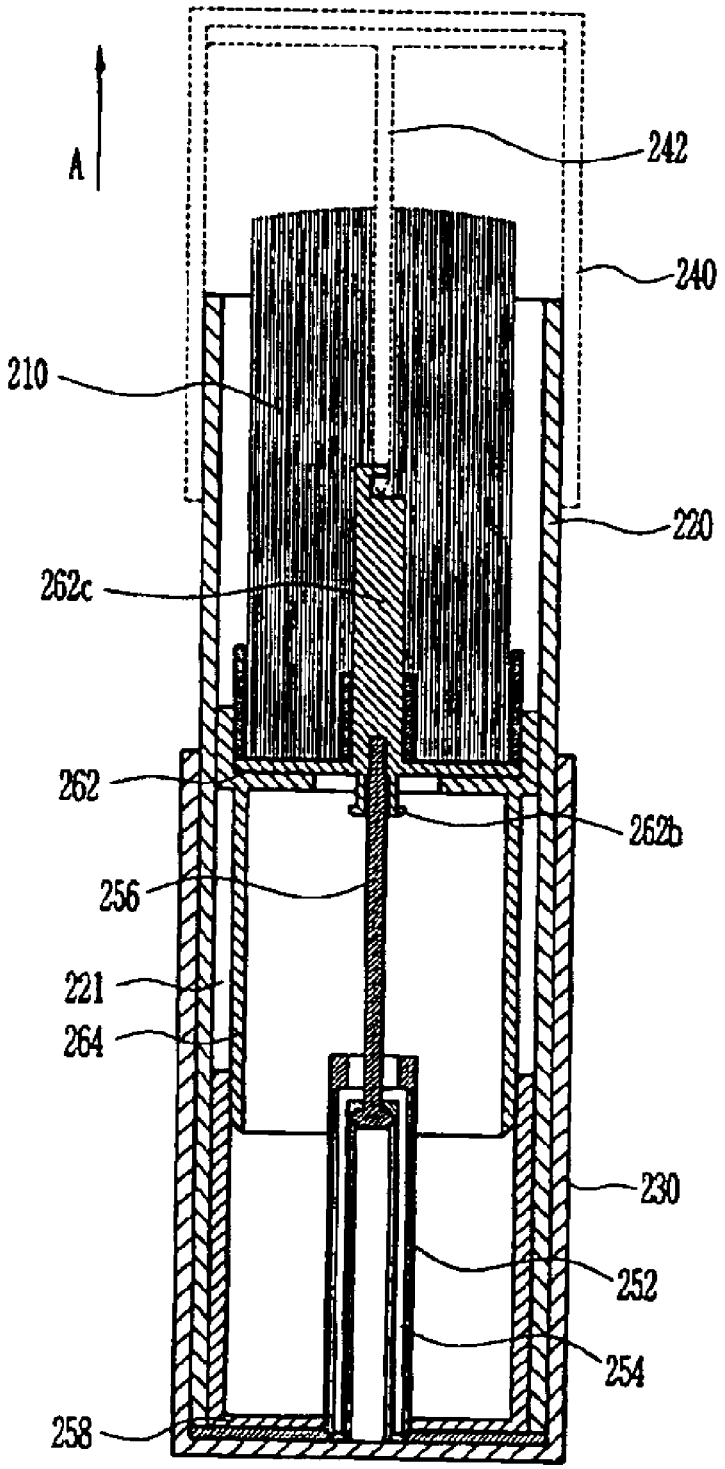
FIG. 23 is a sectional view showing that a protection cap is moved upward.

Referring to FIG. 23, if a user (not shown) moves the protection cap 240 in the direction of the arrow A after gripping the second cylindrical member 230, the outward projection 262*b* of the brush-supporting structure 260 is separated from the gap g formed in the length variable member 250 and then the brush supporting structure 260 moves in the upward direction identical to the upward movement of the innermost segment 256 since the pressing projection 242 is firmly coupled in the coupling groove 262*d*. The innermost segment 256 moves upward through the hollow portion of the middle segment 254. After the completion of the upward movement of the innermost segment 256, the middle segment 254 also moves upward through the hollow portion of the outermost segment 252.

Figure 24:
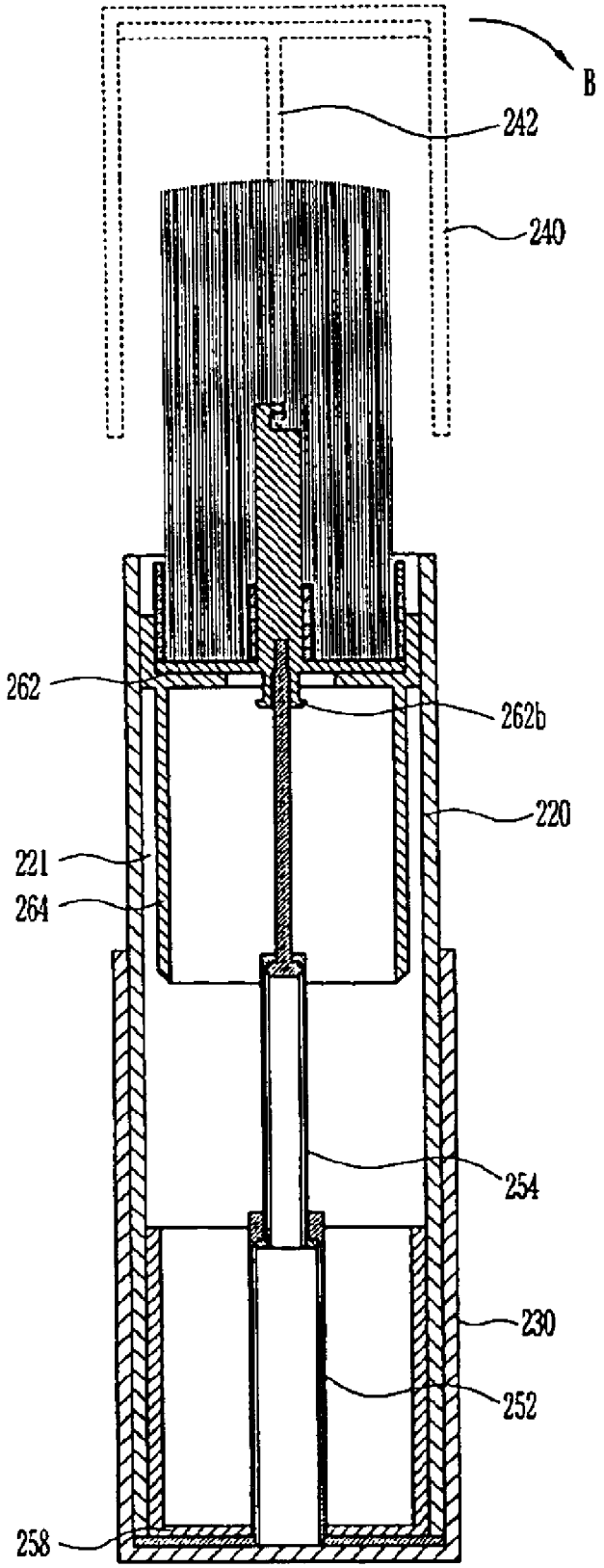
FIG. 24 is a sectional view showing that a brush member is completely exposed to the outside.

And, if the protection cap 240 is further moved upward so that the lower portion thereof is completely separated from the upper portion of the first cylindrical member 220, the length variable member 250 is elongated to its maximum length and the brush 210 is wholly pulled out from the first cylindrical member 220. At this state, if the protection cap 240 is moved along the direction of the arrow B as shown in FIG. 24, the tight fitting state between the coupling groove 262*d* of the upward extending member 262*c* and pressing projection 242 will be loose to separate each other Meanwhile, when the length variable member 250 is elongated to its maximum length, the bump 256*a* provided on the lower portion of the innermost segment 256 is press fitted into the aperture of the middle segment 254 and the bump 254*a* provided on the lower portion of the innermost segment 256 is press fitted into the aperture of the outermost segment 252. Therefore, although the protection cap 240 is separated from the first cylindrical member 220, the elongated length of the length variable member 250 will not be constricted.

The operation of reinserting the brush 210 into the first cylindrical member 220 after the use of the brush will be explained, as follows.

Figure 25:
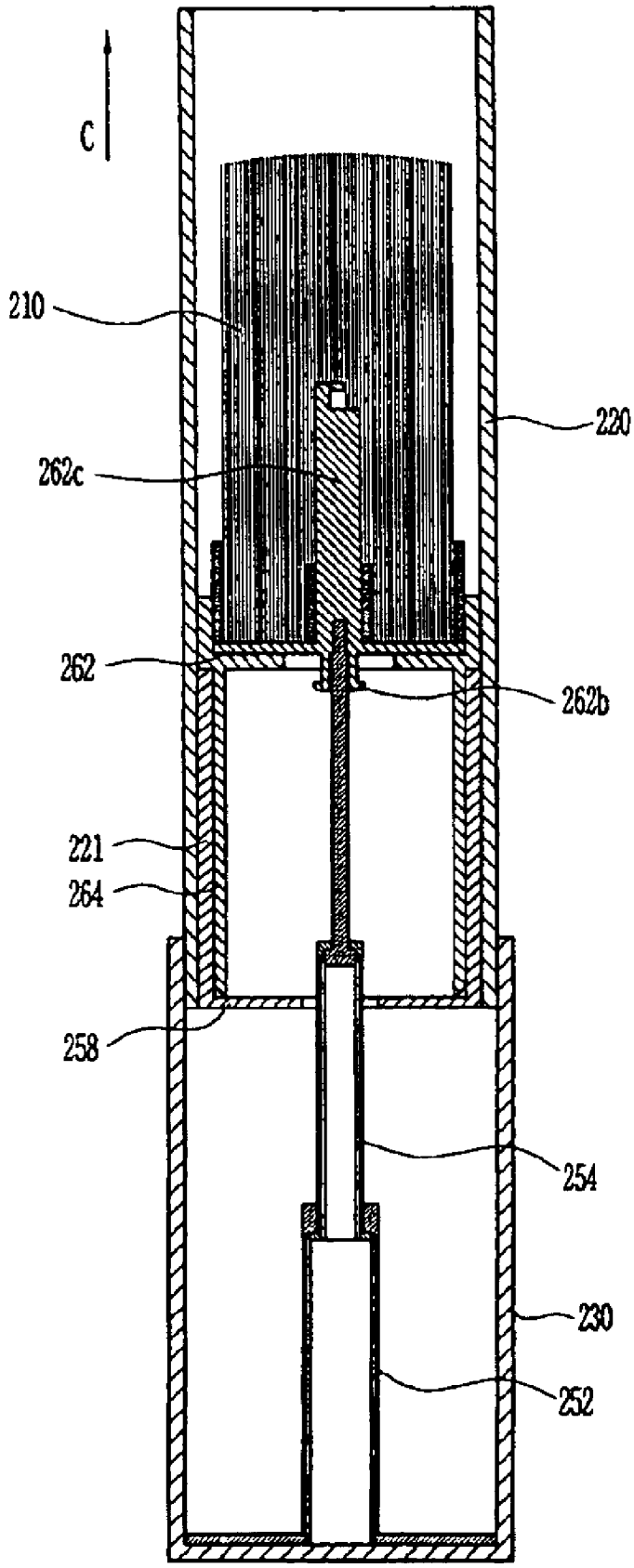
FIG. 25 is a sectional view showing that the brush member is again retained in the cylindrical member.

Referring to FIG. 25, when the user (not shown) moves the first cylindrical member 220 in the direction of the arrow C after gripping the second cylindrical member 230, the brush 210 is inserted into the first cylindrical member 220. Since the length variable member 250 is elongated to its maximum length and the supporting plate is fixed on the lower plate of the second cylindrical member 230, the first cylindrical member 220 will move upward until the upper portion of the cylindrical guiding member 221 contacts to the step portion provided in the body of the brush-supporting structure 260. Thus, the body 64 of the brush-supporting structure 260 and the guiding member 221 help the second cylindrical member 230 not be separated when the first cylindrical member 220 moves upward as well as the brush smoothly slide.

Figure 26:
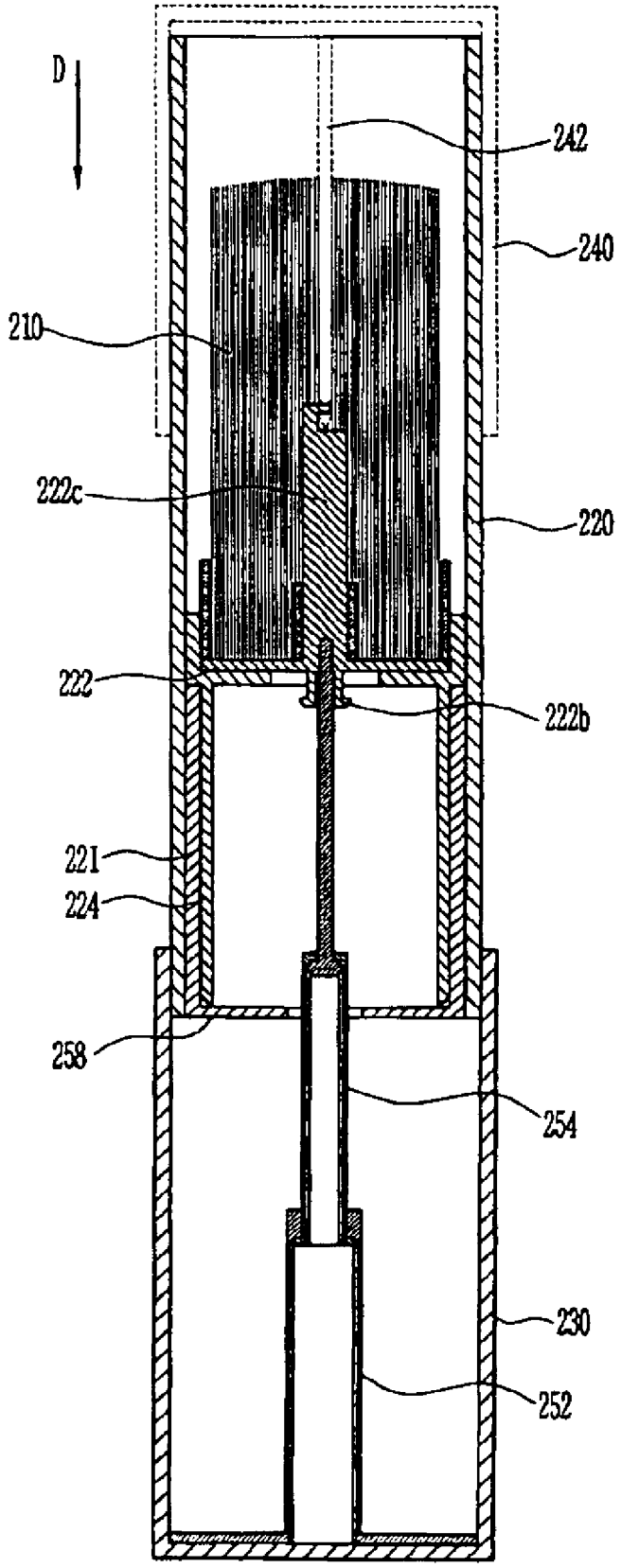
FIG. 26 is a sectional view showing the protection cap covers the upper portion of the cylindrical member.
Figure 27:
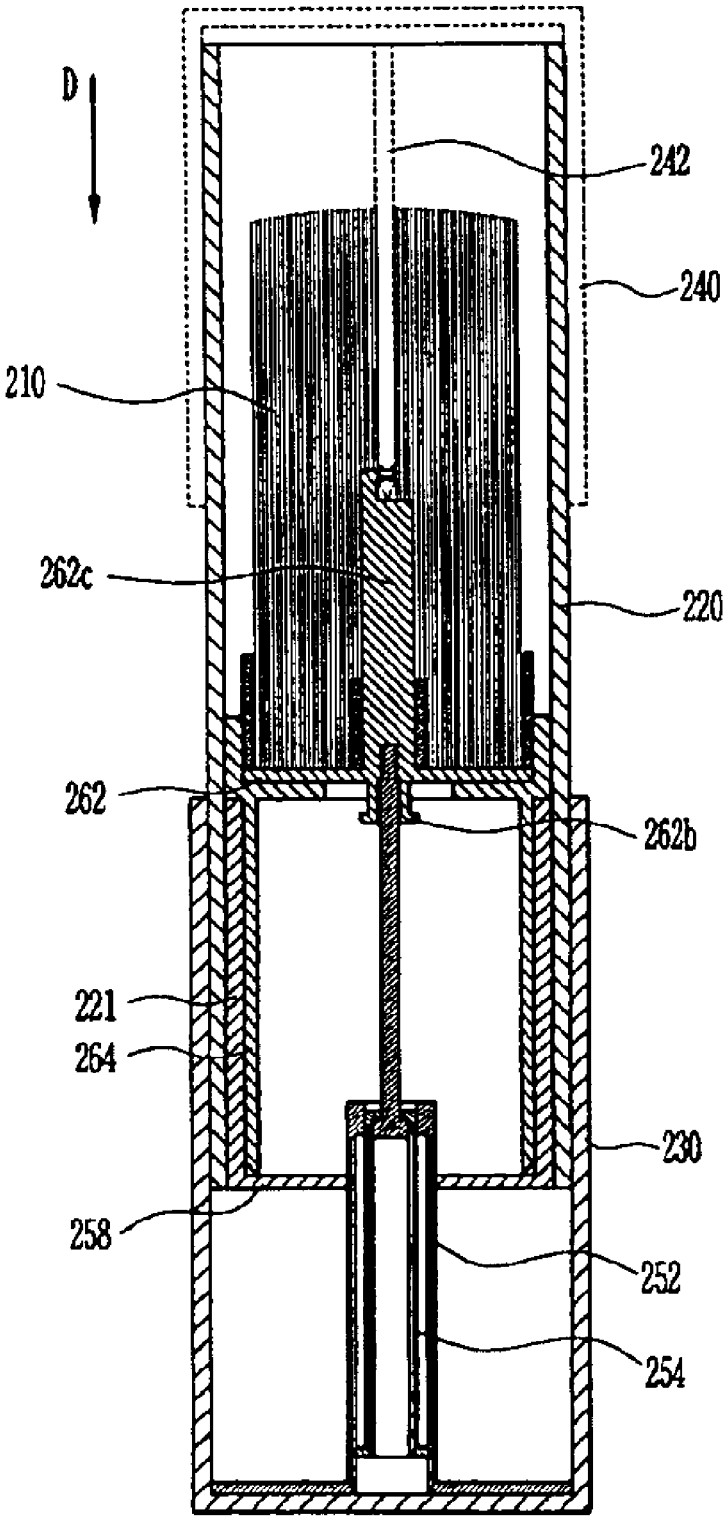
FIG. 27 is a sectional view showing that the protection cap moves downward.

And then, referring to FIGS. 26 and 27, the protection cap 240 covering the upper portion of the first cylindrical member 220 is moved in the direction of the arrow D. When the upper portion of the first cylindrical member 220 contacts the attaching plate provided inside of the protection cap 240, the pressing projection 242 is tightly fitted into the coupling groove 262*d* of the upward extending member 262*c*. If the protection cap 240 is further moved downward, the first cylindrical member 220 and the brush-supporting structure 260 also moves downward. And, the tight fitting state of bumps 254*a*, 256*b* to the corresponding apertures of the outermost segment 252 and the middle segment 254 is released; the elongated length of the length variable member 250 is constricted.

When a force exerts on the protection cap 240 downward for constricting the length variable member 250 to its shortest length, the outward projection 262*b* of the brush-supporting structure 260 is penetrating through the hole provided in the lower plate of the cylindrical guiding member 221 to be tightly fitted into the gap formed on the upper portion of the outermost segment 252.

Example 4

Figure 21:
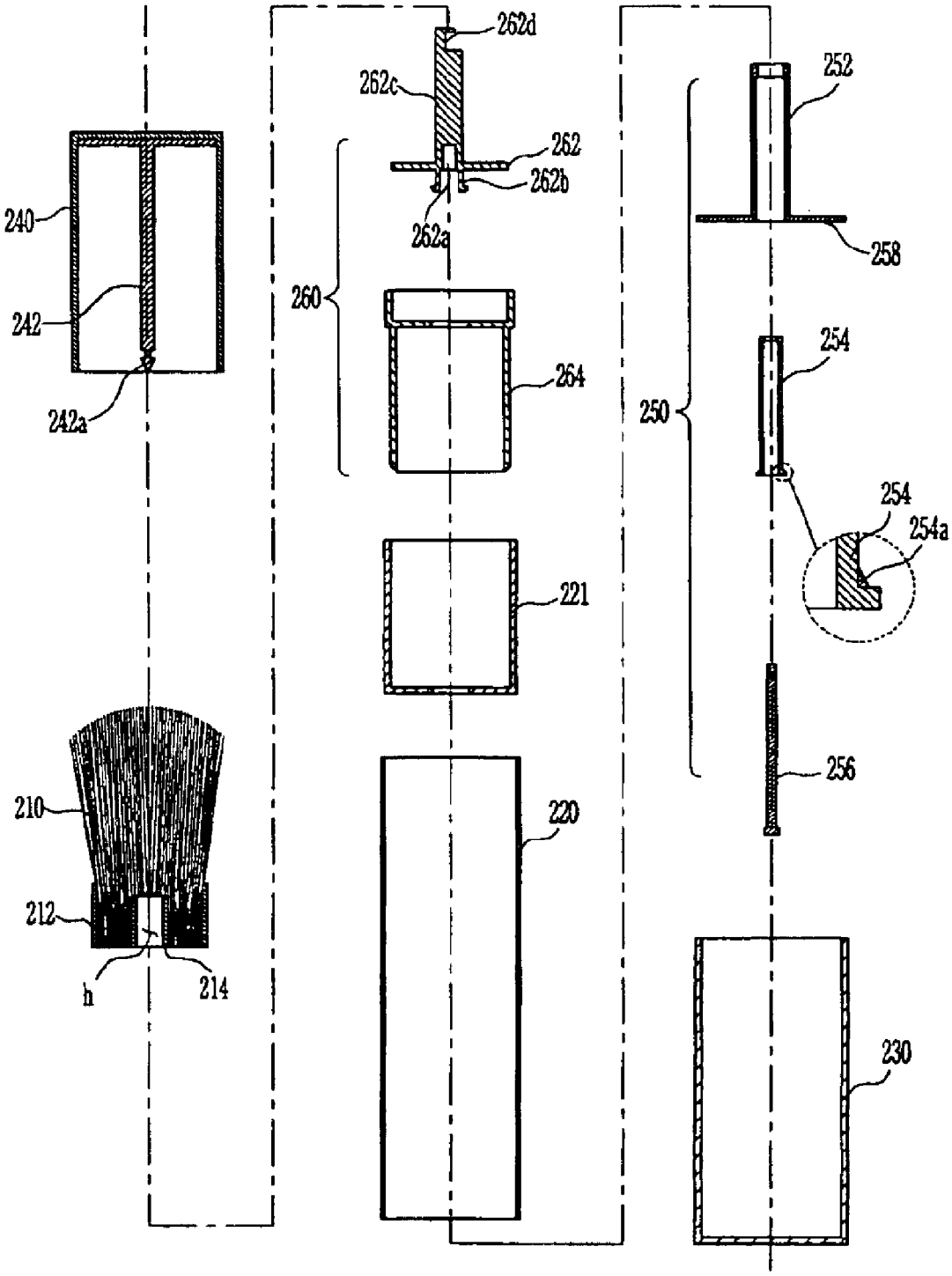
FIG. 21 is an exploded sectional view showing a cosmetic brush assembly according to the invention.
Figure 30:
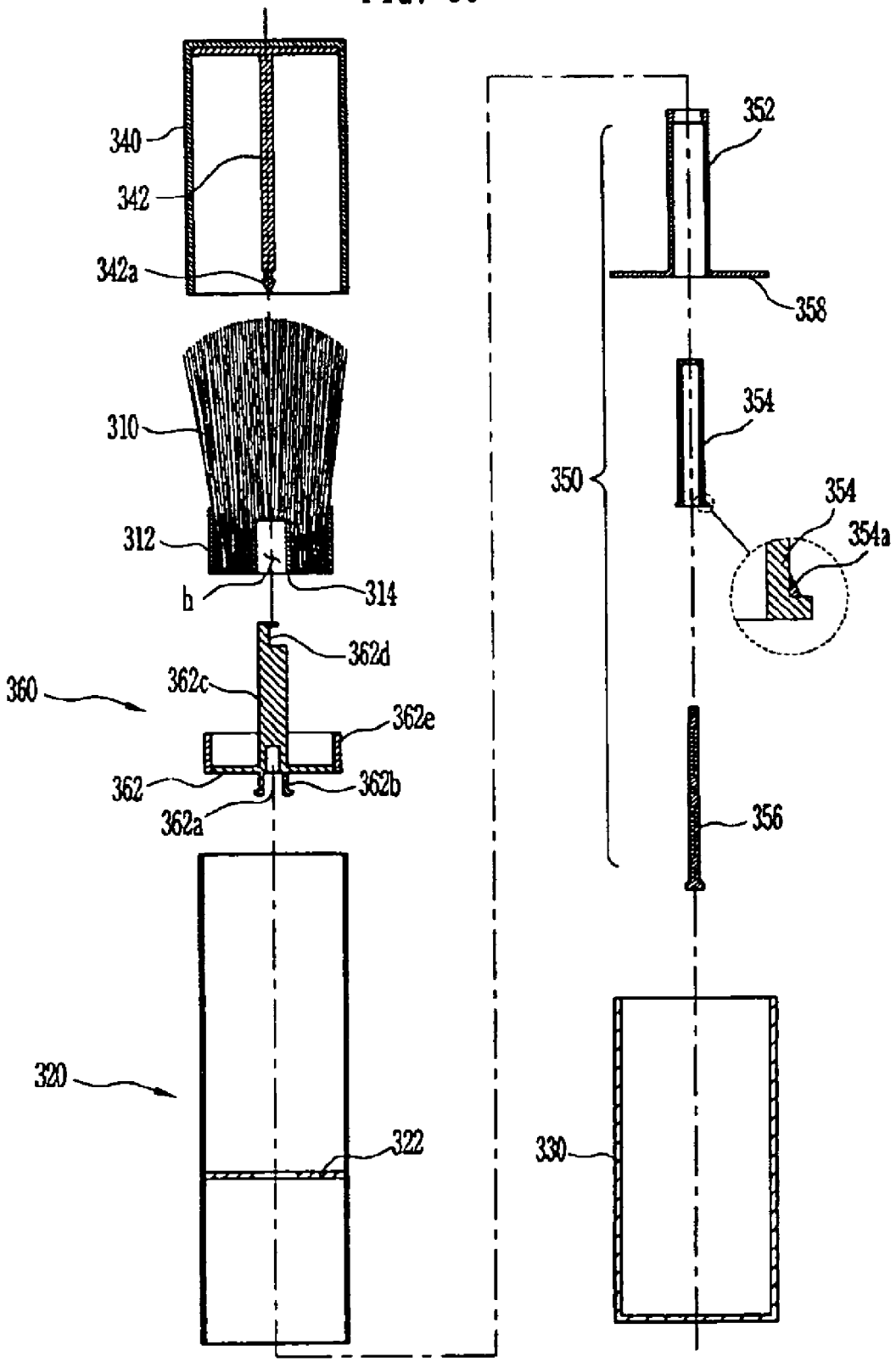
FIG. 30 is an exploded sectional view showing the cosmetic brush assembly according to a fourth embodiment of this invention.

Referring to FIG. 30, the cosmetic brush assembly according to the fourth embodiment of this invention is identically actuated with the cosmetic brush assembly according to the third embodiment of this invention except in that the structures of both the brush supporting structure and first cylindrical member is different from those of both the brush-supporting structure 260 and first cylindrical member 220 shown in FIG. 21.

That is, according to the fourth embodiment of this invention, the interior of the first cylindrical member 320 is provided with a disc 322 at a given position. The brush-supporting structure 360 has a barrier 362*e* extending upward from the edge of the circular plate 362. The barrier 362*e* act to grip the binder 312 of the brush 310 seated on the circular plate 362.

Figure 31:
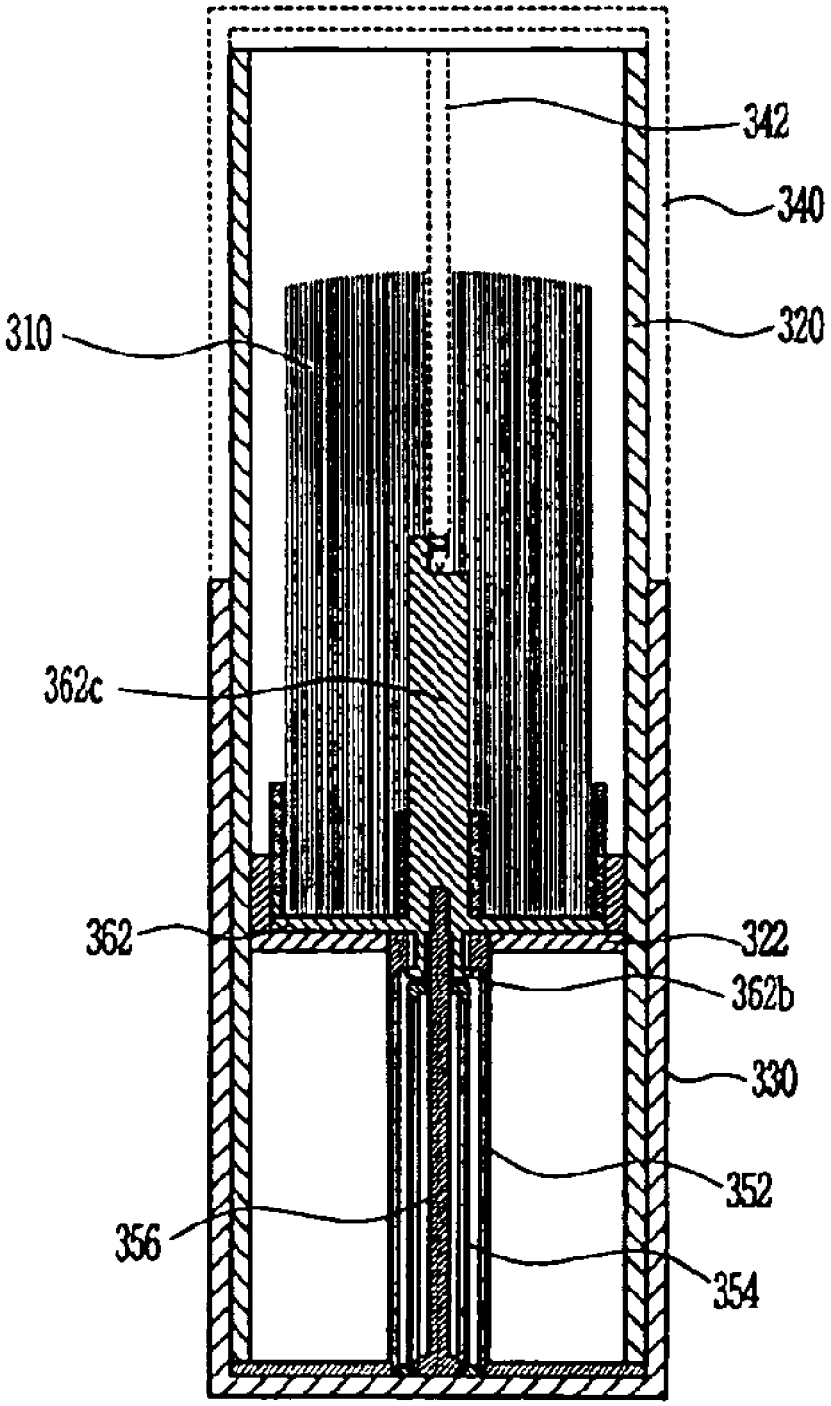
FIG. 31 is a sectional view showing the engaging state of the cosmetic brush assembly according to the fourth embodiment of the invention.
Figure 32:
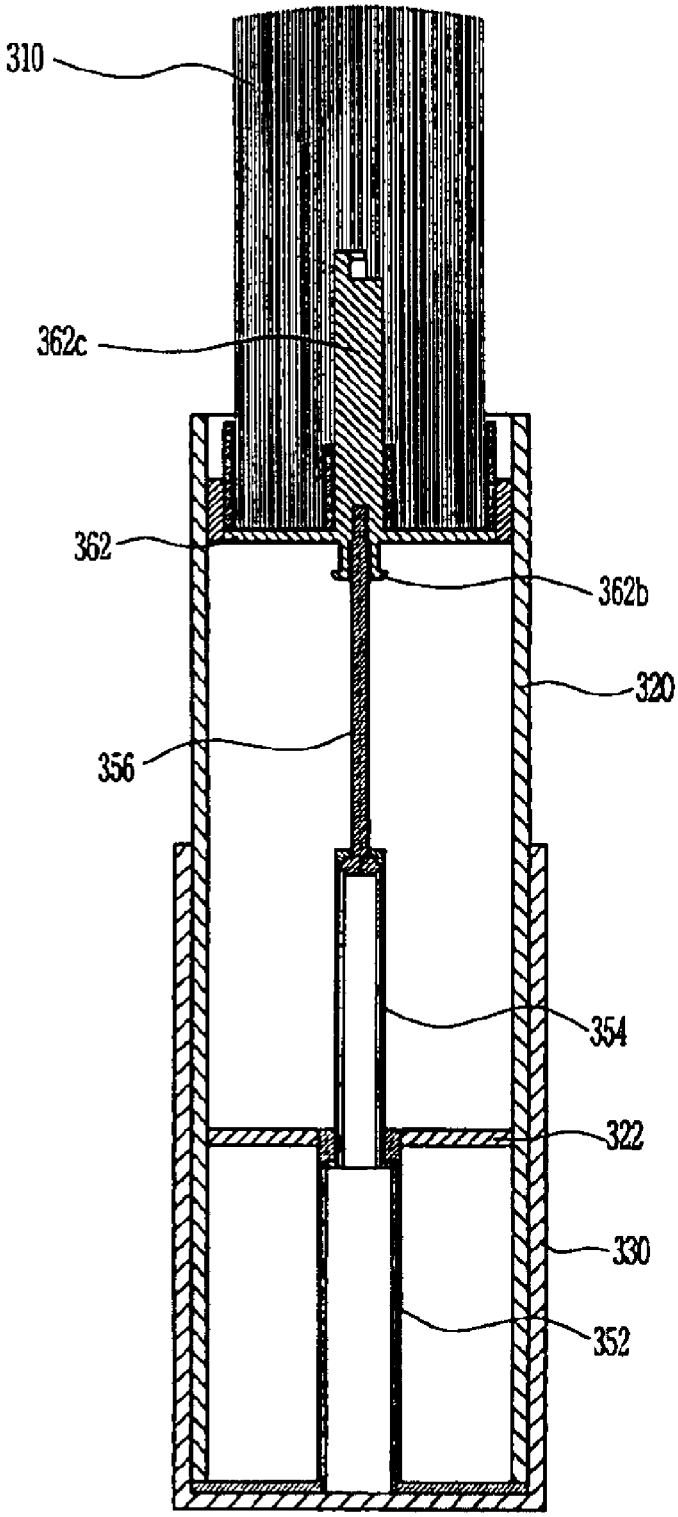
FIG. 32 is a sectional view showing the exposure state of the brush.
Figure 33:
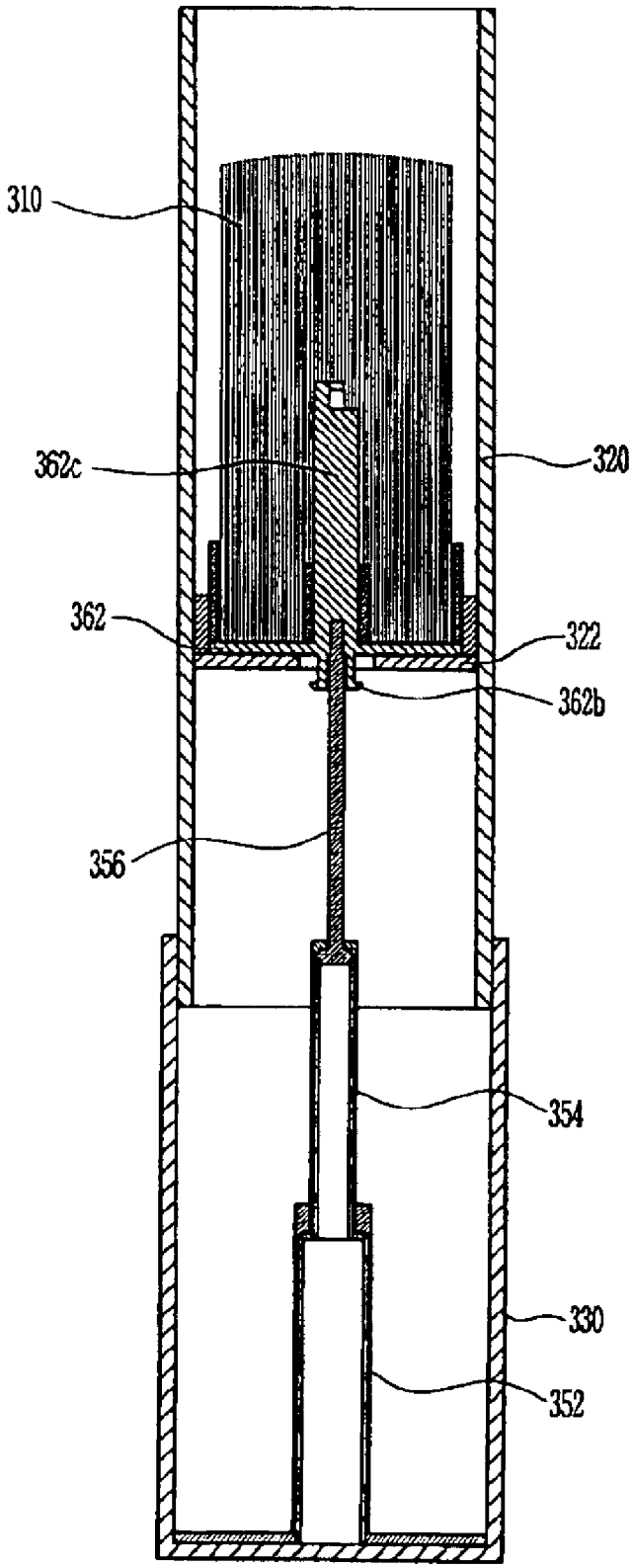
FIG. 33 is a sectional view showing that the brush is again retained in the cylindrical member.
Figure 34:
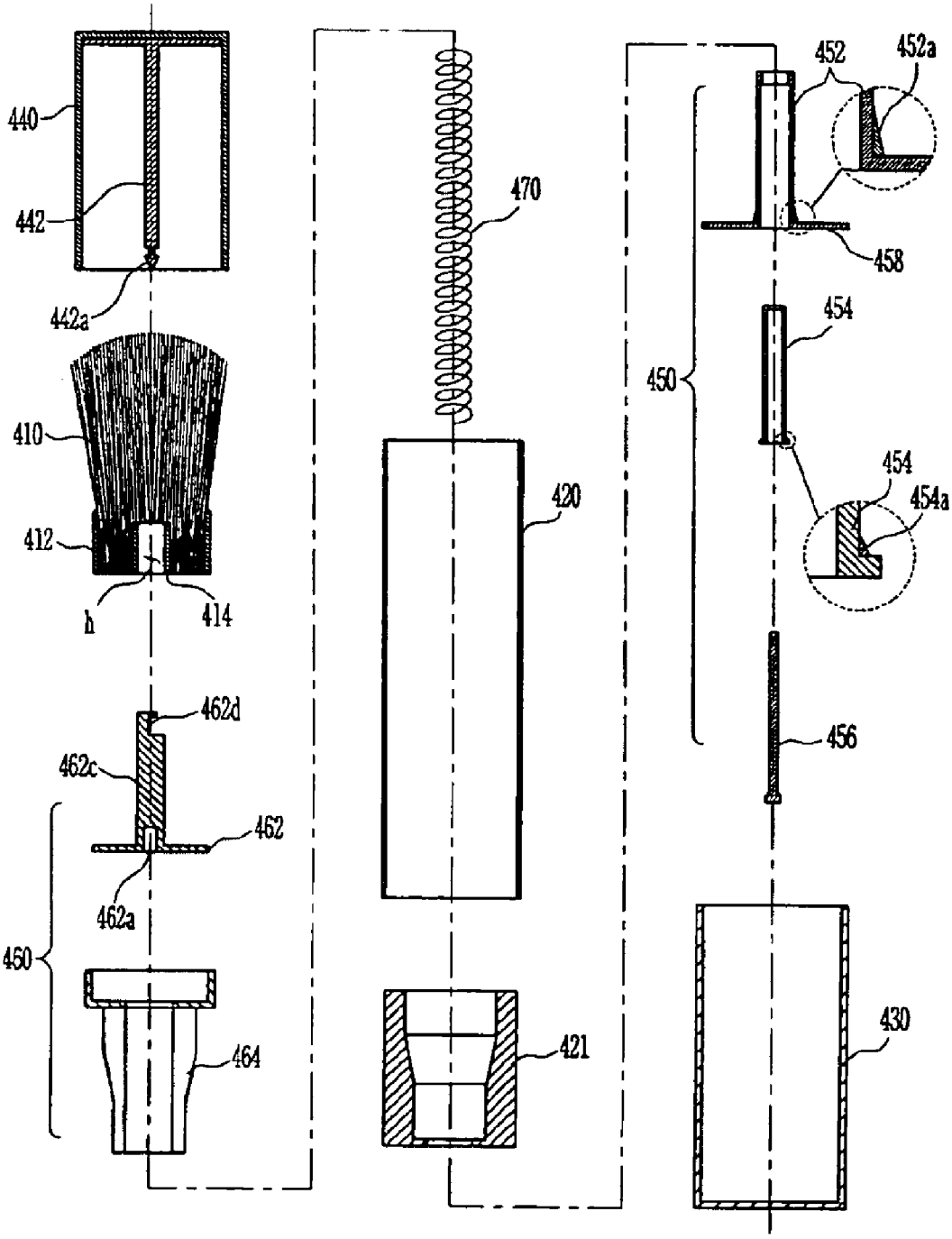
FIG. 34 is an exploded sectional view showing a cosmetic brush assembly according to the fifth embodiment of the invention.

Referring to FIGS. 31 to 33, the brush 310 is involved in the hollow portion of the first cylindrical member 320 and the protection cap 340 covers the upper portion of the first cylindrical member 320. At this state, the circular plate 362 of the brush supporting structure 360 is mounted on the disc 322 of the first cylindrical member 320. The outward projection 362*b* is press fitted into the gap g formed at the outermost segment 352 of the length variable member 350 through a hole formed between the disc 322. The coupling groove 362*d* of the upward extending member 362*c* extending through the penetration hole h formed under the brush 310 is strongly fitted with the lower end 342*a* of the pressing projection 342.

At this state, when the protection cap 340 is moved upward, the brush supporting structure 360 is also moved upward and the brush 310 is exposed to the outside of the first cylindrical member 320 as the length variable member 350 screw coupled into the groove 362*a* of the circular plate 362 is elongated. After the completely exposure of the brush 310, the protection cap 340 is separated from the first cylindrical member 320. The length variable member 350 is maintained to its maximum length since the bumps of the segments are tightly fitted with the opening.

In order to retain the exposed brush 310 into the first cylindrical member 320, the protection cap 340 covers the upper portion of the first cylindrical member 320 after the first cylindrical member 320 is pulled out upward. And, the protection cap 340 is moved downward to constrict the length variable member 350 to its smallest length. At this situation, the lower end 342*a* of the pressing projection 342 is tightly fitted with the coupling groove 362*d* of the upward extending member 362*c* and the outward projection 362*b* is also tightly fitted with the gap provided on the upper portion of the innermost segment 352.

Example 5

A cosmetic brush assembly according to the fifth embodiment of this invention will be explained in reference with the accompanying drawings, as follows.

A cosmetic brush assembly according to the fifth embodiment of this invention has a predetermined length first cylindrical member 420 of which both ends are open. The lower portion of the first cylindrical member 420 is received into a second cylindrical member 430 of which lower end portion is closed and the upper portion of the first cylindrical member 420 is covered with a protection cap 440.

The first cylindrical member 420 is projectably retained with a brush 410 of which lower portion is tightened by a binder 412 to become a binding portion. The center of the binding portion of the brush 410 is provided with a given-sized penetration hole h, in which a penetrating member 414 is installed.

The hollow portion of the first cylindrical member 420 is slidably involved with a brush-supporting structure 460 having a circular plate 462 seated with the brush 410 and a tubular body 464 supporting the circular plate 462 and a cylindrical guiding member 421 detachably coupling with the tubular body 464 of the brush-supporting structure 460.

The upper portion of the circular plate 462 is provided with an upward extending member 462*c* of which the lower portion is formed with a groove 642*a*, the upper end of the upward extending member 462*c* is provided with a coupling groove 462*d*. As shown in FIG. 8, the tubular body 464 comprises a mounting portion 464*a* on which the circular plate 462 is seated and a tubular portion 464*b* extending downward from the mounting portion 462*a*.

The mounting portion 464*a* is formed with an aperture communicating with the interior of the tubular portion 464*b*. The outer side of the tubular portion 464*b* extends vertically downward, continuously slants toward the inner side and further extends vertically downward. The tubular portion 464*b* has also a cutting-off portion extending vertically downward from the under of the mounting portion 464*a*. Since the width of the cutting-off portion is elastically variable, the tubular portion 464*b* may be inserted into the hollow portion of the cylindrical guiding member 421 or disengaged from it, as explained below.

That is, the interior of the guiding member 421 is corresponding to the outer surface of the tubular portion 464*b*. The relatively wide width 11 of the cutting-off portion is formed when the tubular portion 464*b* is disengaged from the guiding member 421, whereas the relatively narrow width 12 thereof is formed when the tubular portion 464*b* is engaged with the guiding member 421. The width-variation of the cutting-off portion results from the tight fit between the tubular portion 464*b* and the guiding member 421.

A length variable member 450 is provided through the interior of the tubular body 464 of both the brush-supporting structure 460 and the cylindrical guiding member 421. The length variable member 450 has a supporting disc 458 positioned between the bottom of the second cylindrical member 430 received with the first cylindrical member 420 and the lower surface of the guiding member 421. It is prefer to fix the supporting disc 458 onto the bottom of the second cylindrical member 430. The supporting disc 458 is provided with a cylindrical outermost segment 452 extending upward therefrom. An outer bump 452*a* is provided at the lower portion of the outermost segment 452 adjacent to the supporting disc 458. The outer bump 452*a* may be formed in the circular shape surrounding the lower portion of the outermost segment 452 or may be provided in a plural of the projections separated a given distance from each other. The outer bump 452*a* help the outermost segment 452 tightly fit with the hole formed at the lower portion of the guiding member 421 after the outermost segment 452 passes through the hole. The hollow portion of the outermost segment 452 is received with a plural of the segments 454, 456 which are inserted upward from the lower portion of the outermost segment and the diameter of which are different, respectively. The innermost segment 456 having the smallest diameter is positioned adjacent to the center of the length variable member 450. The innermost segment 456 has an engaging end portion coupling with the groove 462*a* of the circular plate 462.

In drawings, the engaging end portion of the innermost segment 456 is screw worked and couples with the groove 462*a*, however shape of the engaging end portion of the innermost segment is not limited to this. For example, the end portion may join the groove 462*a* with an adhesive. Further, only one middle segment 454 is positioned between the outermost and innermost segments 452, 456 in drawings. However, the number of the middle segment 454 is not limited to this. On the other hand, only the outermost and innermost segments 452, 456 may be provided without a middle segment.

Each of lower ends of the outermost and innermost segments 452, 456 is provided with a flange extending outward therefrom. Each of the upper ends of the segments except the innermost segment 456 is formed with an opening through which any segment positioned inside thereof may be pulled out upward. The flange acts the length variable member 450 to extend to its full length without the separation of the segments 454, 456. Further, a bump 454*a* having a slope inclined down outward is provided on the flange of the segment 454*a*. Likewise, a bump is provided on the flange of the segment 456. The bump help one segment tightly fit into the opening of other segment when the length variable member 450 is extended to its maximum length in order to maintain the extension state thereof.

An elastic member 470 surrounding the length variable member 450 is also provided in the interior of both the tubular body 464 of the brush-supporting structure and the guiding member 421 when the engaging end portion of the innermost segment 456 is inserted into the groove 462*a* of the circular plate 462. The both ends of the elastic member 470 contact with the lower surface of the circular plate 462 exposed through the aperture of the mounting portion 464*a* and the bottom surface of the guiding member 421, respectively. The elastic member 470 is constricted when the tubular body 464 of the brush-supporting structure 460 and the guiding member 421 is tightly fitted with each other, whereas the elastic member 470 extends when the tubular body 464 and the guiding member 421 are separated.

The protection cap 440 has a cylindrical structure being capable of covering the upper portion of the first cylindrical member 420. The upper interior of the protection cap is provided with a circular attaching plate, the attaching plate is provided with a pressing projection 442 which extends downward therefrom and separably engage with the coupling groove 462*d* of the brush-supporting structure 460. The end portion 442*a* of the pressing projection 442 has a sharp structure. The sharp structure prevents the crush of the brush when the protection cap covers the upper portion of the first cylindrical member 420.

The following description relates to the operation of the cosmetic brush assembly in accordance with the fifth embodiment of the present invention.

Figure 35:
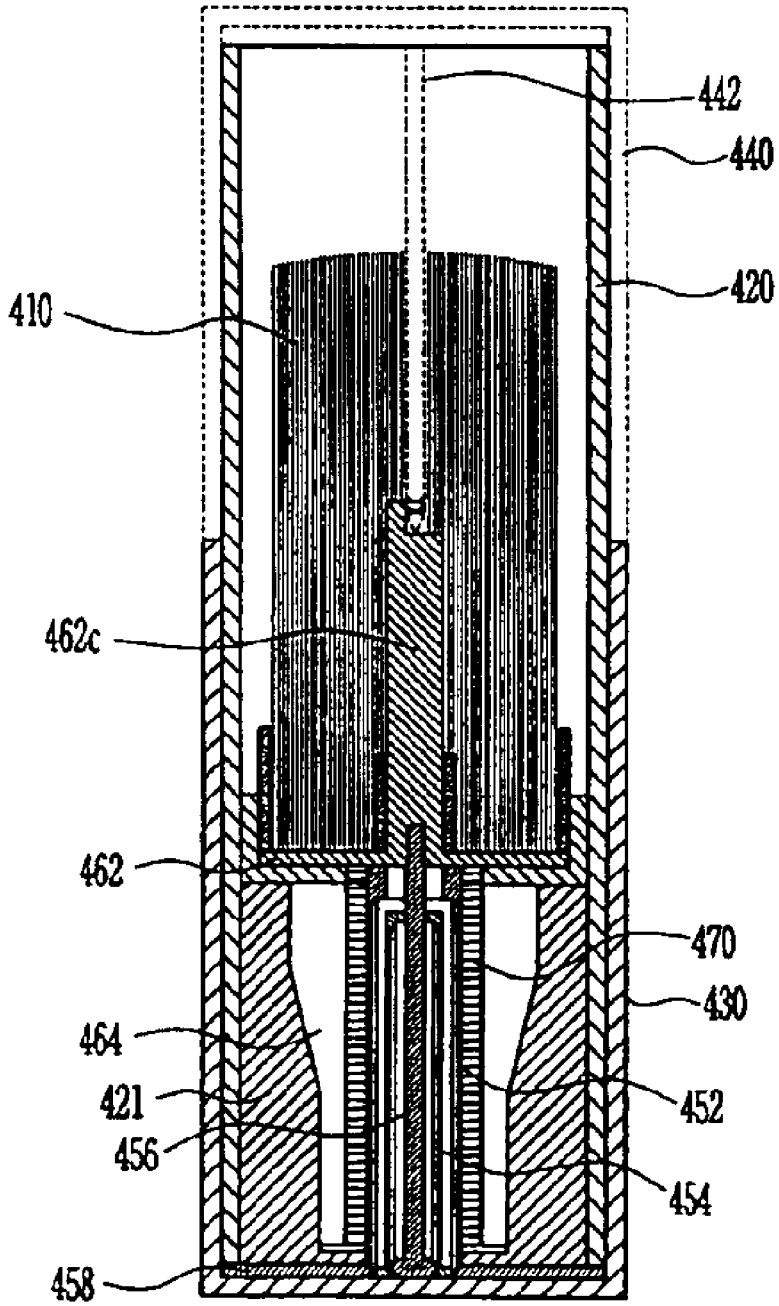
FIG. 35 is a sectional view showing the engaging state of the cosmetic brush assembly according to the fifth embodiment of the invention.

Referring to FIG. 35, the brush 410 is inserted into the hollow portion of the first cylindrical member 420. The protection cap 440 covers the upper portion of the first cylindrical member 420. The supporting disc 458 of the length variable member 450 is fixed on the bottom of the second cylindrical member 430. The hollow portion of the outermost segment 452 penetrating upward through the cylindrical guiding member 421 is provided with the middle segment 454 and the innermost segment 456 in turn. The elastic member 470 surrounding the length variable member 450 is constricted between the tubular body 464 of the brush-supporting structure 460 and the hollow portion of the guiding member 421. The lower portion of the first cylindrical member 420 is inserted into the hollow portion of the second cylindrical member 430. The lower inside of the first cylindrical member 420 is provided with the cylindrical guiding member 421.

Figure 41A:
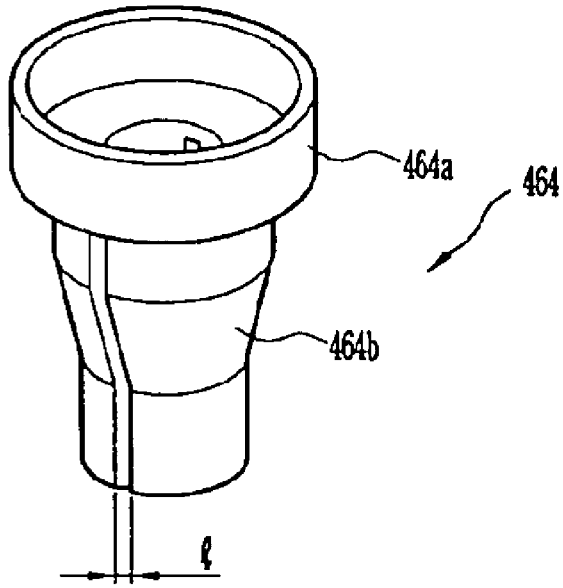
FIG. 41*a* is a perspective view showing the body of the brush-supporting structure separating from the cylindrical guiding member.
Figure 41B:
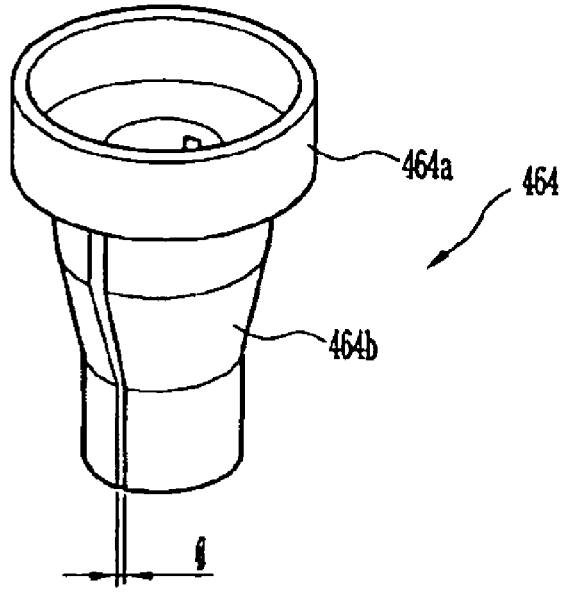
FIG. 41*b* is a perspective view showing the body of the brush-supporting structure engaging with the cylindrical guiding member.
Figure 42:
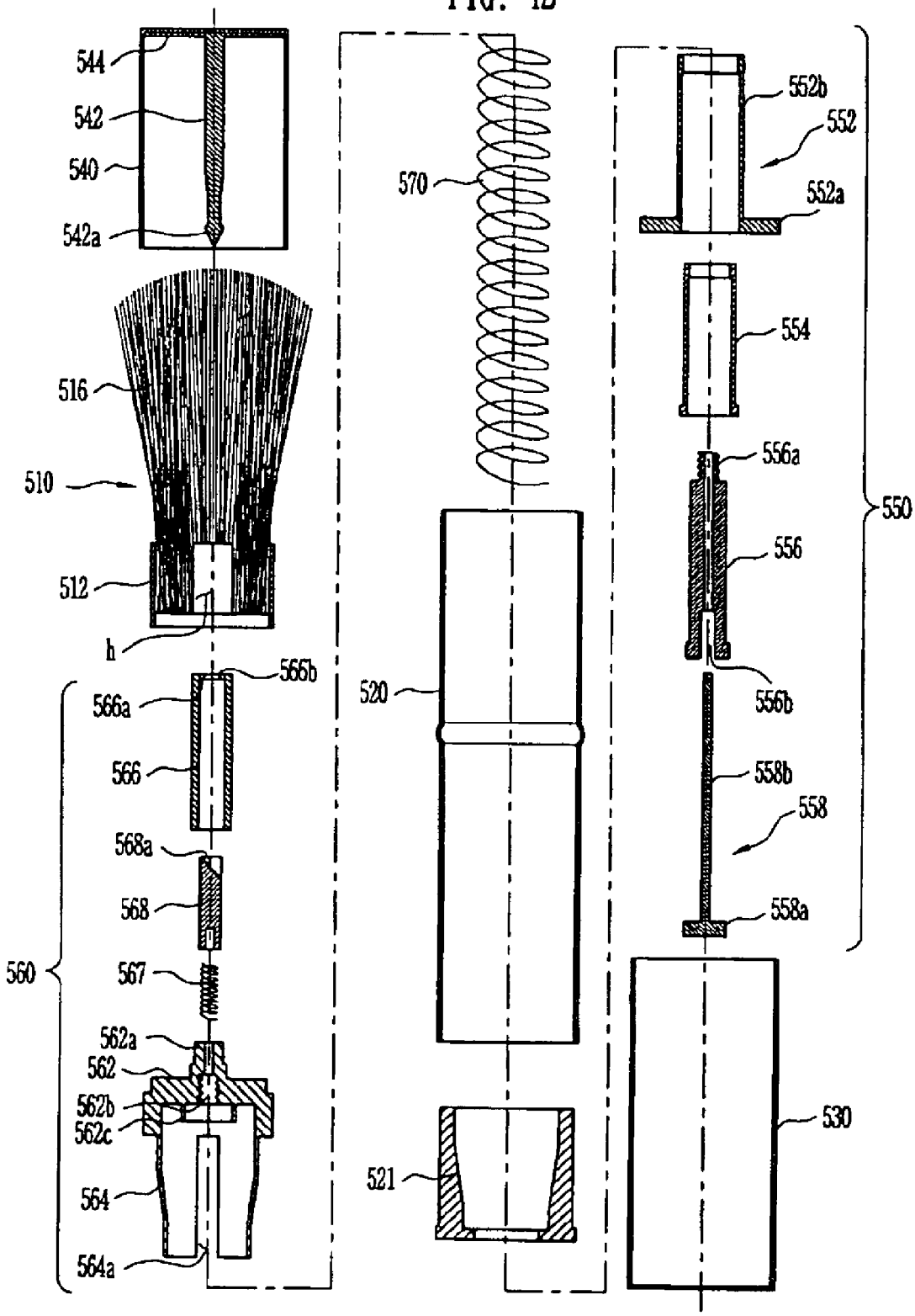
FIG. 42 is an exploded sectional view showing a cosmetic brush assembly according to the sixth embodiment of the invention.

When the tubular body 464 of the brush-supporting structure 460 tightly fits with the cylindrical guiding member 421, the width of the cutting-off portion formed in the tubular body 464 become in the narrow state (12; see to FIG. 41*b*).

The engaging end portion of the innermost segment 456 is coupled into the groove 462*a* of the circular plate 462 exposed through the aperture of the mounting portion 464*a*. The coupling groove 462*d* of the upward extending member 462*c* of the brush-supporting structure 460 is tightly fitted with the end portion of the pressing projection 442 provided in the protection cap 440. By the tight fit, the protection cap 440 is firmly connected with the first cylindrical member without voluntarily separation.

Now, the following description relates to the operation pulling out the brush member 410 inserted in the first cylindrical member 420.

Figure 36:
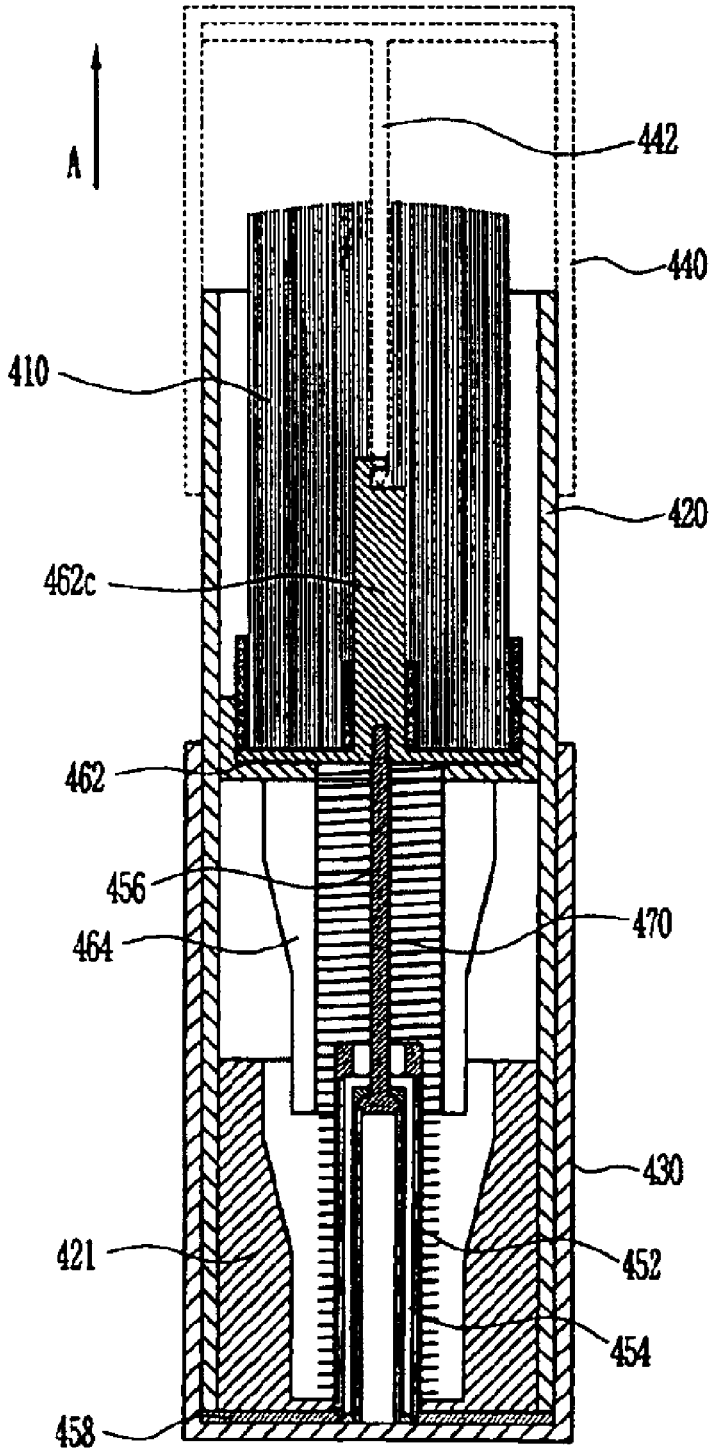
FIG. 36 is a sectional view showing that a protection cap is moved upward.
Figure 37:
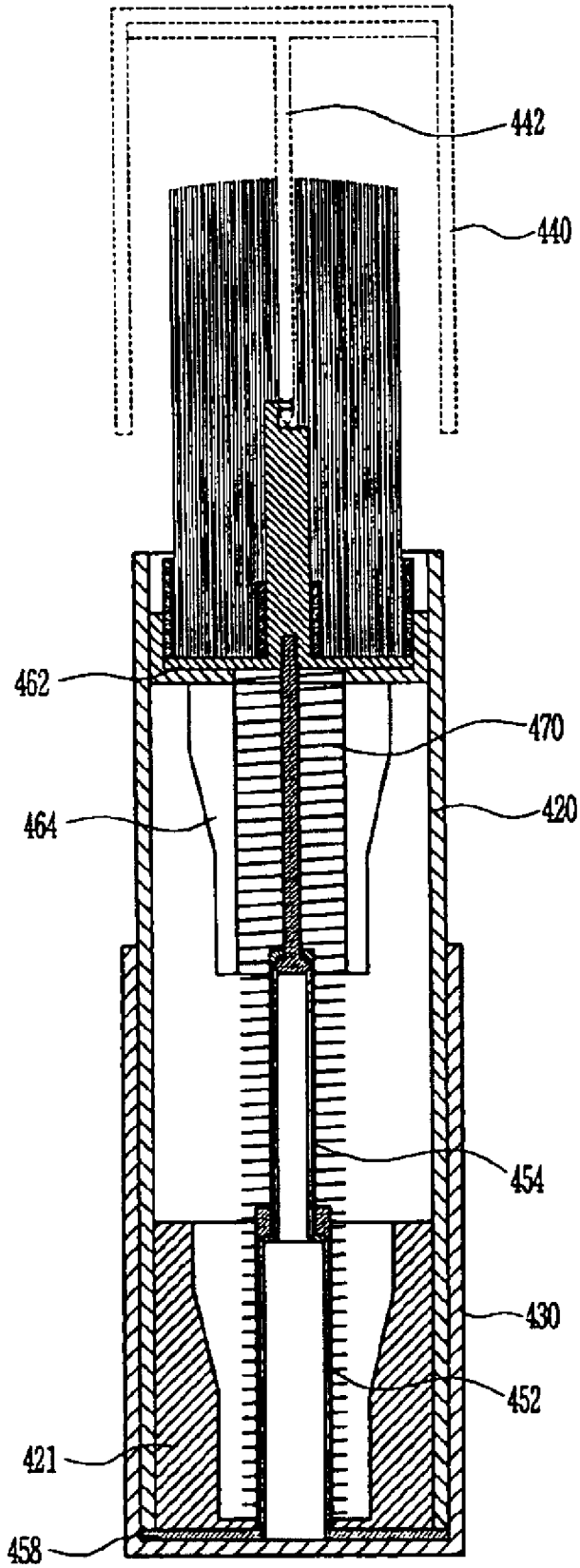
FIG. 37 is a sectional view showing that a brush member is completely exposed to the outside.

Referring to FIG. 36, when a user (not shown) moves the protection cap 440 in the direction of the arrow A after gripping the second cylindrical member 430, the tubular body 464 of the brush-supporting structure 460 is separated from the cylindrical guiding member 421 and then is moved upward because the pressing projection 442 is strongly coupled with the coupling groove 462*d* of the upward extending member 462*c* and the outer bump 452*a* provided at the lower portion of the outermost segment 452 is tightly mated with the aperture of the guiding member 421. The upward movement of the tube-type body 464 is more easily achieved due to the elasticity of the elastic member 470. Further, when the tubular body 464 is completely separated from the guiding member 421, the width of the cutting-off portion formed in the body 464 is maintained at maximum 11.

During the upward movement of the tubular body, the innermost segment 456 is moved upward along the hollow portion of the middle segment 454. After the upward movement of the innermost segment 456, the middle segment 454 is also moved upward along the hollow portion of the outermost segment 452.

And then, when the protection cap 440 is further moved upward so that the lower portion of the protection cap 440 is completely separated from the upper portion of the first cylindrical member 420 and the pressing projection 442 is also separated from the coupling groove 462*d* of the upward extending member 462*c*, the length variable member 450 is extended to its full length and the brush 410 is wholly exposed from the first cylindrical member 420.

Meanwhile, because the elastic member 470 elastically supports the circular plate 462 of the brush-supporting structure 460, the length variable member 450 is not constricted when the protection cap 440 is separated from the first cylindrical member 420 in the full extension state of the length variable member 450. Further, as a bump (not drawn) provided on the lower portion of the innermost segment 456 is tightly fitted with the opening of the middle segment 454 and the bump 454*a* provided on the lower portion of the middle segment 454 is also tightly fitted with the opening of the outermost segment 452, the contraction of the length variable member 450 is more effectively prevented.

The operation of reinserting the brush into the first cylindrical member 420 after the use of the brush will be explained, as follows.

Figure 38:
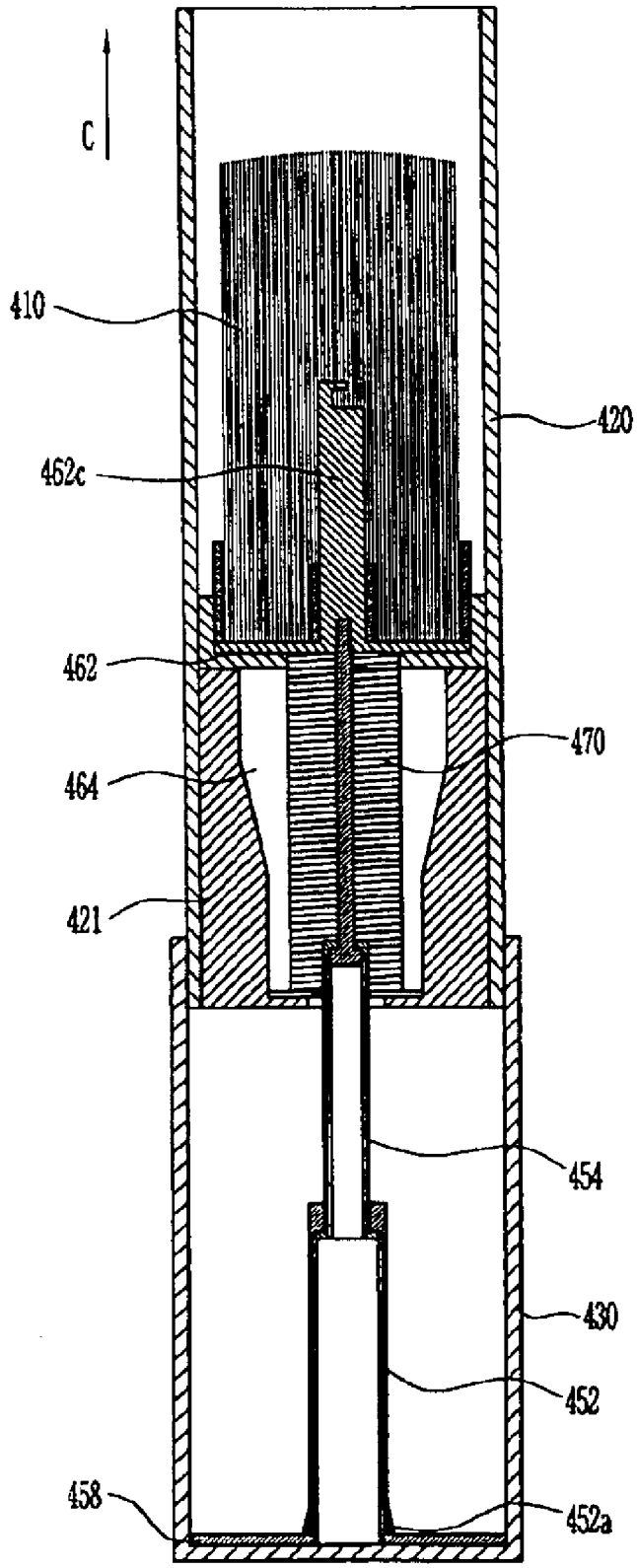
FIG. 38 is a sectional view showing that the brush member is retained in the cylindrical member.

Referring to FIG. 38, when the user (not shown) moves the first cylindrical member 420 in the direction of the arrow C after gripping the second cylindrical member, the cylindrical guiding member 421 is moved upward after its separation from the bump 452*a* of the outermost segment 452; and the brush 410 is held in the first cylindrical member 420. At this situation, since the supporting disc 458 of the length variable member 450 is fixed on the bottom of the second cylindrical member 430, the first cylindrical member 420 is moved upward until the upper end of the cylindrical guiding member 421 contacts to the lower surface of the mounting portion 464*a*.

Figure 39:
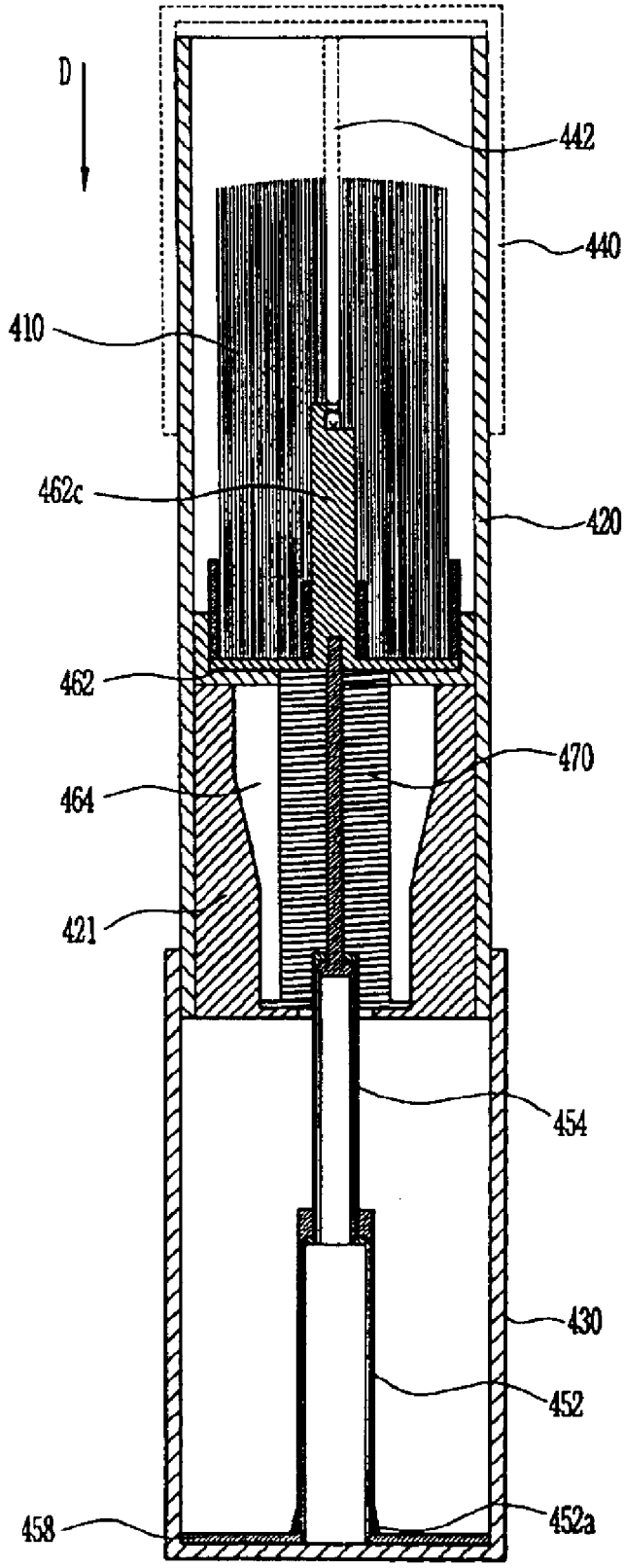
FIG. 39 is a sectional view showing the protection cap covers the upper portion of the cylindrical member.
Figure 40:
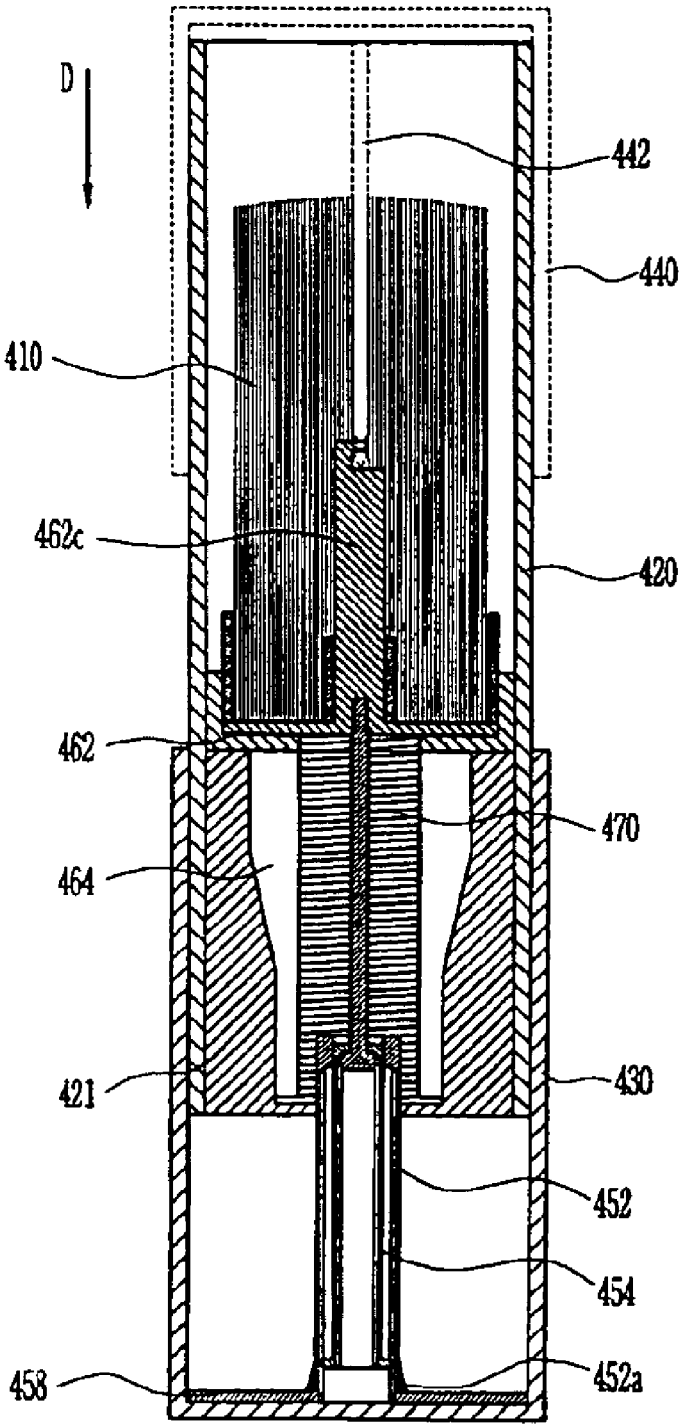
FIG. 40 is a sectional view showing that the protection cap moves downward.

And then, referring to FIGS. 39 and 40, the protection cap 440 covering the upper portion of the first cylindrical member 420 is moved in the direction of the arrow D. Further, when the upper portion of the first cylindrical member 420 contacts to the attaching plate provided inside of the protection cap 440, the pressing projection 442 is tightly fitted with the coupling groove 462*d* of the upward extending member 462*c*. If the protection cap 440 is further moved downward, the brush 410 is held in the hollow portion of the first cylindrical member 420 as the guiding member 421 is moved downward together with the first cylindrical member 420 and the brush-supporting structure 460.

When the tight fitting state of bumps of both the outermost segment 452 and middle segment 454 with the corresponding opening is removed, the elongated length of the elastic member is shrank as the length variable member 450 is constricted. And, when a force exerts on the protection cap 440 downward for constricting the length variable member 450 to its shortest length, the lower surface of the cylindrical guiding member 421 will be contacted onto the supporting disc 458 of the length variable member 450.

Referring to again FIG. 35, since the engaging end portion of the outermost segment 452 is inserted into the groove 462*a* of the circular plate 462 and the outer bump 452*a* is tightly fitted into the aperture of the cylindrical guiding member 421, the brush 410 is held in the insertion state into the hollow portion of the first cylindrical member 420.

Example 6

A cosmetic brush assembly according to the sixth embodiment of this invention will be explained in reference with the accompanying drawings, as follows.

A cosmetic brush assembly according to the sixth embodiment of this invention has a given-length first cylindrical member 520 of which both ends are open. The lower portion of the first cylindrical member 520 is received into a second cylindrical member 530 of which lower end portion is closed and the upper portion of the first cylindrical member 520 is covered with a protection cap 540.

The first cylindrical member 520 is projectably retained with a brush member 510 comprising a brush 516 of which lower portion is tightened by a binder 512 to become a binding portion. The center of the binding portion of the brush 516 is formed with a given-sized penetration hole h.

The hollow portion of the first cylindrical member 520 is slidably involved with a brush supporting structure 560 having a mounting portion 562 seated with the lower portion of the brush member 510 and a tubular body 564 extending downward from the mounting portion 562. The mounting portion 562 and the tubular body 564 may be integrally manufactured. The upper portion of the mounting portion 562 is provided with an upward projection 562*a* coupled with a cylindrical tube 566, which is capable of passing through the penetration hole h formed in the brush 516. The upper end portion of the tube 566 is formed with a penetration opening 566*b* having a locking step 566*a*. The interior of the tube 566 is movably provided with a cylindrical element 568 elastically supported by a spring 567. Preferably, the upper portion of the cylindrical element 568 is formed with a sloping surface.

The lower portion of the mounting portion 562 positioned in the interior of the tubular body 564 is formed with a groove 562*b*. The groove 562*b* is engaged with a coupling portion 556*a* of a coupling segment 556, which will be explained, as follows. The mounting portion 562 is formed with a hole communicating the groove 562*b* with the hollow portion of the cylindrical tube 566.

The lower portion of the first cylindrical member 520 is provided with a cylindrical guiding member 521 detachably coupling with the tubular body 564 of the brush supporting structure 560. Preferably, the tubular body 564 is tightly fitted with the cylindrical guiding member 521. The lower portion of the guiding member 521 is formed with an aperture through which an outermost segment 552*b* is capable of passing, which will be described in detail, as follows.

The outer side of the tubular body 564 extends vertically downward from the edge of the mounting portion 562, continuously slants toward the inner side, and then further extends vertically downward. The interior of the guiding member 521 is corresponding to the outer side of the tubular body 564. The tubular body 564 is formed with a cutting-off portion 564*a* extending vertically downward. Because of the cutting-off portion 564*a*, the tubular body 564 exhibits elasticity when being inserted into or separated from the guiding member 521. That is, the interior of the guiding member 521 is corresponding to the outer surface of the tubular body 564. The width of the cutting-off portion 564*a* formed when the tubular body 564 is disengaged from the guiding member 521 is relatively wider than that thereof formed when the tubular body 564 is engaged with the guiding member 521. The width-variation of the cutting-off portion 564*a* results from the tight fit between the tubular body 564 and the guiding member 521.

According to the preferable embodiment of this invention, an elastic member 570 is provided between the lower portion of the mounting portion 562 and the lower interior of the cylindrical guiding member 521.

A numerical reference 562*c* indicates a downward projection being coupling with an upper opening of the outermost segment 552*b* when the length variable member 550 is constricted to its shortest length.

The brush-supporting structure 560 is connected with the guiding member 521 via the length variable member 550. The length variable member 550 has a supporting member 552 comprising a supporting disc 552*a* positioned between the lower interior of the second cylindrical member 530 and lower exterior of the guiding member 521 and a cylindrical outermost segment 552*b* extending upward from the supporting disc 552*a*. The supporting disc 552*a* is attached to the lower interior of the second cylindrical member 530 by adhesives, et al.

The supporting disc 552*a* is formed with a hole communicating with the hollow portion of the outermost segment 552*b*. The interior of the outermost segment 552*b* is received with a middle segment 554 through the hole, which will be explained, as follows. However, any passage through which the middle segment is received in the interior of the outermost segment 552*b* is not limited to the opening.

An outer bump (not shown) is provided on the lower portion of the outermost segment 552*b* adjacent to the supporting disc 552*a*. The outer bump may be formed in the circular shape surrounding the lower portion of the outermost segment 552*b* or may be provided in a plural of the projections separated a given distance from each other. The outer bump help the outermost segment 552*b* tightly fitted with the aperture of the guiding member 521.

The interior of the outermost segment 552*b* is received with a cylindrical middle segment 554 of which both ends are open. The upper opening of the middle segment 554 is relatively larger than the lower opening thereof. The middle segment 554 is inserted into the interior of the outermost segment 552*b* via the hole of the supporting disc 552*a*.

The interior of the middle segment 554 is slidably received with a cylindrical coupling segment of which both ends are open. The upper portion of the coupling segment 556 is provided with a coupling portion engaging with the groove 562*b* of the mounting portion 562 and the lower portion thereof is provided with a cutout portion cut in the vertical direction. The coupling segment 556 is longer than the middle segment 554, preferably than the outermost segment 552*b*. Thus, as explained below, the upper portion of the coupling segment 556 is exposed to the outside via the upper opening of the outermost segment 552*b* when the length variable member 550 is constricted into its smallest length.

The interior of the coupling segment 556 is slidably provided with an innermost segment 558 comprising a horizontal element 558*a* transversely positioned in the cutout portion 556*b* and a perpendicular element 558*b* extending upward from the horizontal element 558*a* and penetrating through the upper opening of the coupling segment 556. When the coupling portion 556*a* of the coupling segment 556 is coupled with the groove 562*b* of the mounting portion 562, the upper portion of the perpendicular element 558*b* protrudes into the interior of the cylindrical tube 566 through the hole formed the mounting portion 562. The upper portion of the perpendicular element 558*b* is engaged with the lower portion of the cylindrical element 568.

As a result, when the cylindrical element 568 moves in the ups and downs direction in the cylindrical tube 566, the innermost segment 558 may be moved in the identical direction with the movement of the cylindrical element. The length of the horizontal element 558*a* is held to be larger than the diameter of the upper opening of the middle segment 554. Thus, when the length variable member 550 is elongated to its maximum length, the coupling segment 556 moves as a length as the height of the cutout portion of the coupling segment 556 because the horizontal element 558*a* is engaged with the interior of the upper opening of the middle segment 554.

In drawings, the coupling portion of the coupling segment 556 is screw worked and couples with the groove 562*b*, however shape of the coupling portion of the coupling segment is not limited to this. For example, the coupling portion may join the groove 562*b* with an adhesive. Further, only one middle segment 554 is positioned between the outermost and coupling segments 552*b*, 556 in drawings. However, the number of the middle segment 554 is not limited to this. On the other hand, the coupling segment 556 may be directly involved in the outermost segment 552*b* without a middle segment.

Each of lower ends of the middle and coupling segments 554, 556 is provided with a flange extending outward therefrom. The flange acts the length variable member 550 to extend to its full length without the separation of the segments 554, 556. Further, a bump (not shown) having a slope inclined down outward is provided on the flange of the segments 554, 556. The bump help one segment tightly fit into the opening of other segment when the length variable member 550 is extended to its maximum length in order to maintain the extension state thereof.

In case that the engaging end portion of the engaging segment 556 received in the outermost segment 552*b* is inserted into the groove 562*b* of the mounting portion 562, an elastic member 570 provided in the hollow portion of both the tubular body 564 of the brush-supporting structure 560 and the guiding member 521 is surrounding the length variable member 550. The elastic member 570 is constricted when the tubular body 564 of the brush-supporting structure 560 and the guiding member 521 is tightly fitted with each other, whereas the elastic member 570 extends when the tubular body 564 and the guiding member 521 are separated from each other.

The protection cap 540 has a cylindrical structure being capable of covering the upper portion of the first cylindrical member 520. The upper interior of the protection cap is provided with a circular attaching plate 544, which is provided with a pressing projection 542 extending downward therefrom. The pressing projection 542 has an insertion end portion 542*a* being capable of penetrating through the penetration opening 566*b* of the cylindrical tube 566 after passing the brush 516. The insertion end portion 542*a* has a conical structure or pyramidal structure in order to prevent the crush of the brush when it is passing the brush 516. The upper portion of the insertion end portion 542*a* is provided with a step portion being capable of coupling with the locking step 566*a* provided on the top of the cylindrical tube 566 when it is penetrating the penetration opening 566*b*.

As described below, the pressing projection 542 may be manufactured with an elastic material to be biased into one side in the interior of the cylindrical tube when the upward force of the cylindrical element 568 exerts on the insertion end portion passing the penetration opening 566*b*. As the result of the bias, the step portion of the insertion end portion 542*a* may be tightly fitted with the locking step 566*a*.

The following description relates to the operation of the cosmetic brush assembly in accordance with the sixth embodiment of the present invention.

Figure 43:
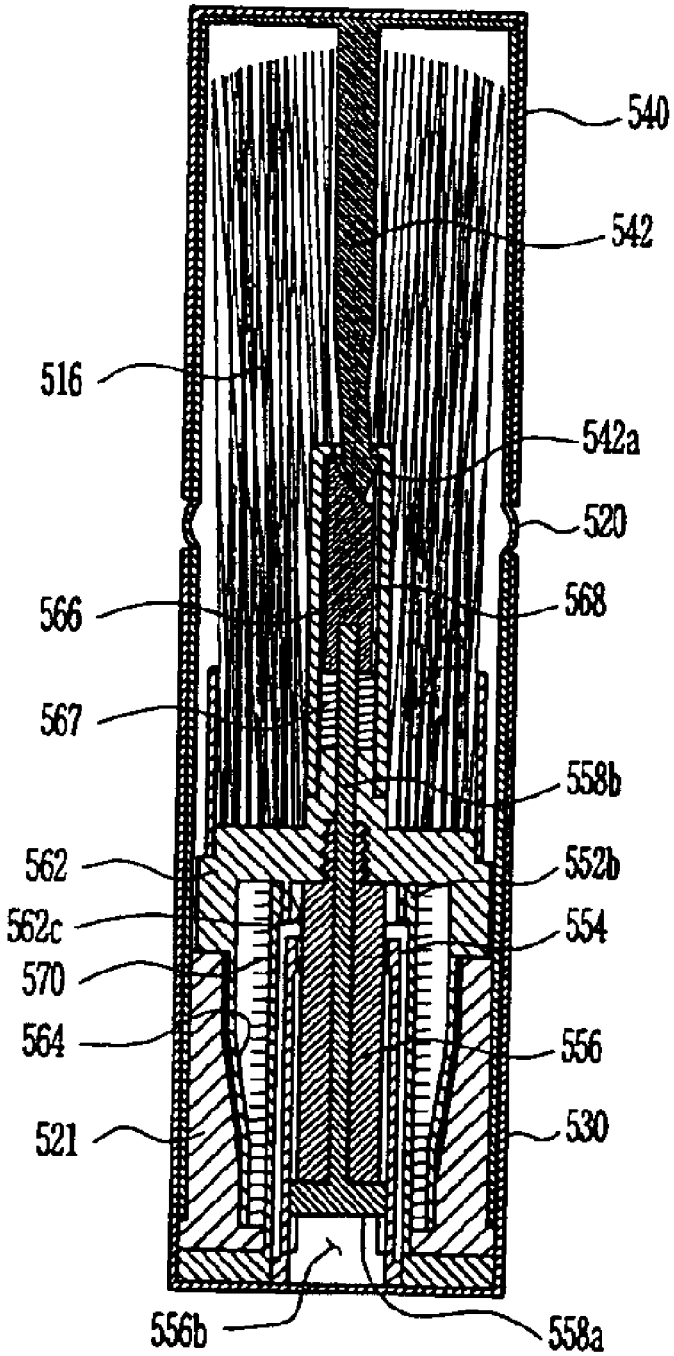
FIG. 43 is a sectional view showing the engaging state of the cosmetic brush assembly according to the sixth embodiment of the invention.

Referring to FIG. 43 showing the assembled state of the cosmetic brush assembly according to the sixth embodiment of this invention, the brush member 510 is received into the hollow portion of the first cylindrical member 520. The protection cap 540 covers the upper portion of the first cylindrical member 520. The lower portion of the first cylindrical member 520 is inserted into the second cylindrical member 530. The supporting disc 552*a* of the length variable member 550 is fixed on the bottom of the second cylindrical member 530. The hollow portion of the outermost segment 552*b* penetrating upward through the cylindrical guiding member 521 positioned in the lower interior of the first cylindrical member 520 is provided with the middle segment 554, the coupling segment 556 and the innermost segment 558 in turn. At this state, the coupling portion 556*a* of the coupling segment 556 is engaged into the groove 562*b* of the mounting portion 562.

The elastic member 570 surrounding the length variable member 550 is constricted in the hollow portion of both the tubular body 564 of the brush-supporting structure 560 and the guiding member 521 when the tubular body 564 of the brush-supporting structure 560 is tightly fitted with the guiding member 521. At this state, the width of the cutting-off portion 564*a* formed in the tubular body 564 is widely maintained.

Meanwhile, the pressing projection 542 provided in the protection cap 540 is biased aside in the cylindrical tube 566 by the upward action force of the cylindrical element exerted with the elastic force of the spring 567, resulting in that the step portion provided on the insertion end portion of the pressing projection 542 is coupled with the locking step 566*a* provided in the upper portion of the cylindrical tube 566. As the result, the protection cap 540 is firmly gripped so as not to be voluntarily separated from the first cylindrical member 520.

Now, the following description relates to the operation pulling out the brush member 510 involved in the first cylindrical member 520.

Figure 44:
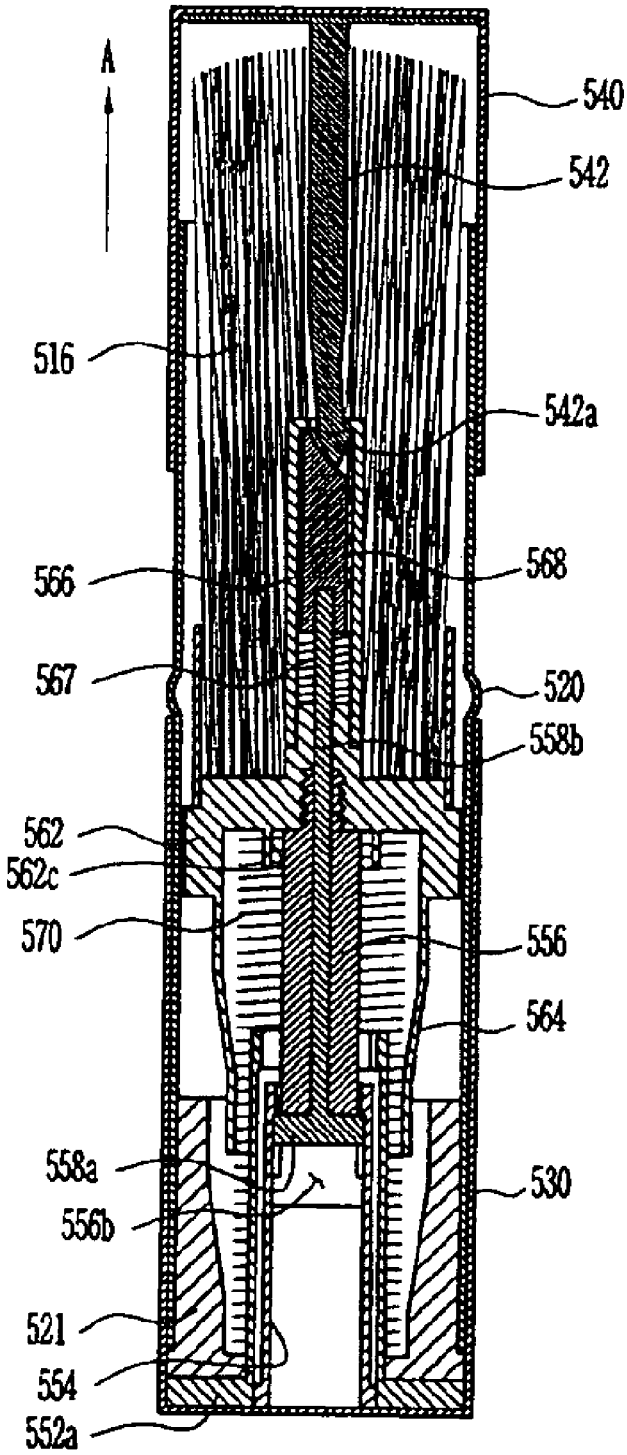
FIG. 44 is a sectional view showing that a protecting cap is moved upward.

Referring to FIG. 44, when a user (not shown) moves the protection cap 540 in the direction of the arrow A after gripping the second cylindrical member 530, the tubular body 564 of the brush-supporting structure 560 is separated from the cylindrical guiding member 521 and then is moved upward since the step portion of the insertion end portion 542*a* is strongly coupled with the locking step 566*a*. As a result, the length variable member 550 is elongated.

The middle segment 554 moves upward along the interior of the outermost segment 552*b*, and the coupling segment 556 also moves upward along the interior of the middle segment 554. At this time, the coupling segment 556 moves upward until the horizontal element 558*a* of the innermost segment 558 positioned on the upper portion of the cutout portion 556*b* of the coupling segment 556 contacts with the upper opening of the middle segment 554.

The upward movement of the brush-supporting structure 560 is more easily achieved due to the elasticity of the elastic member 570. And, when the tubular body 564 is completely separated from the guiding member 521, the width of the cutting-off portion formed in the tubular body 564 is maintained at its maximum length.

Figure 45:
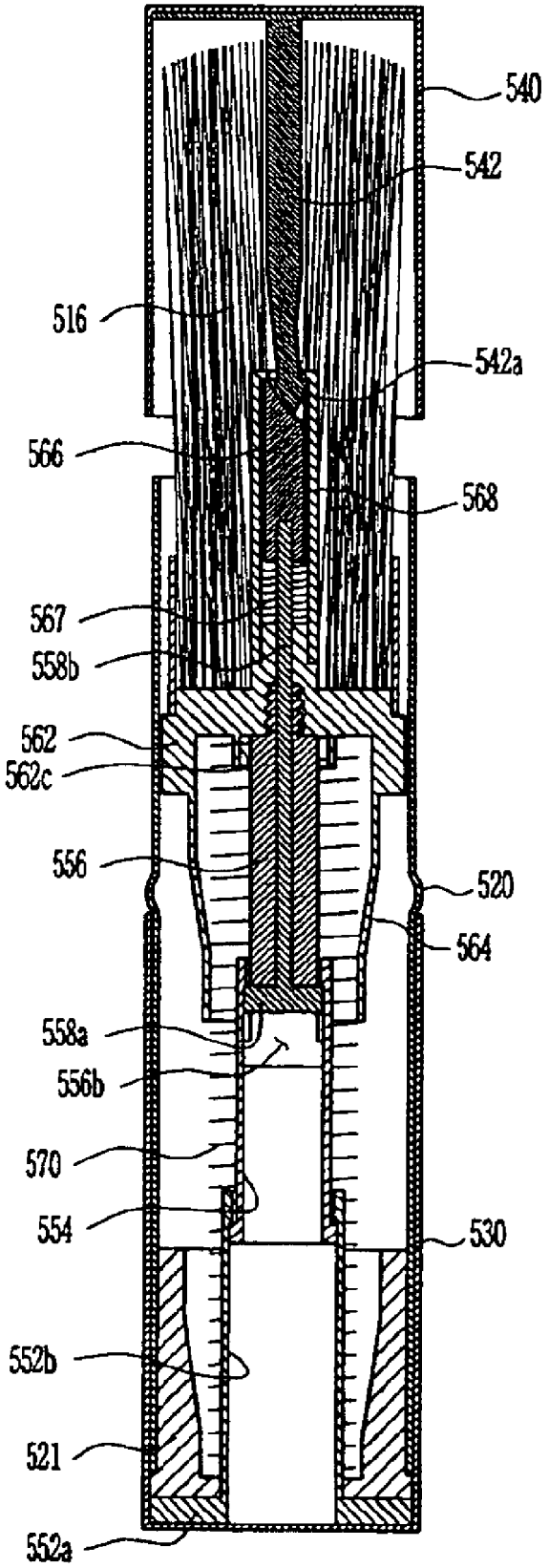
FIG. 45 is a sectional view showing that a length variable member is elongated to its maximum length.

FIG. 45 is a view showing that the protection cap 540 is pulled out upward when the length variable member 550 is elongated to its maximum length. The brush 516 is completely drawn out from the first cylindrical member 520. The pressing projection 542 positioned in the interior of the cylindrical tube 566 is biased aside by the upward force of the cylindrical element 568. The horizontal element 558*a* of the innermost segment 558 is positioned at the top of the cutout portion 556*b* of the coupling segment 556.

Figure 46:
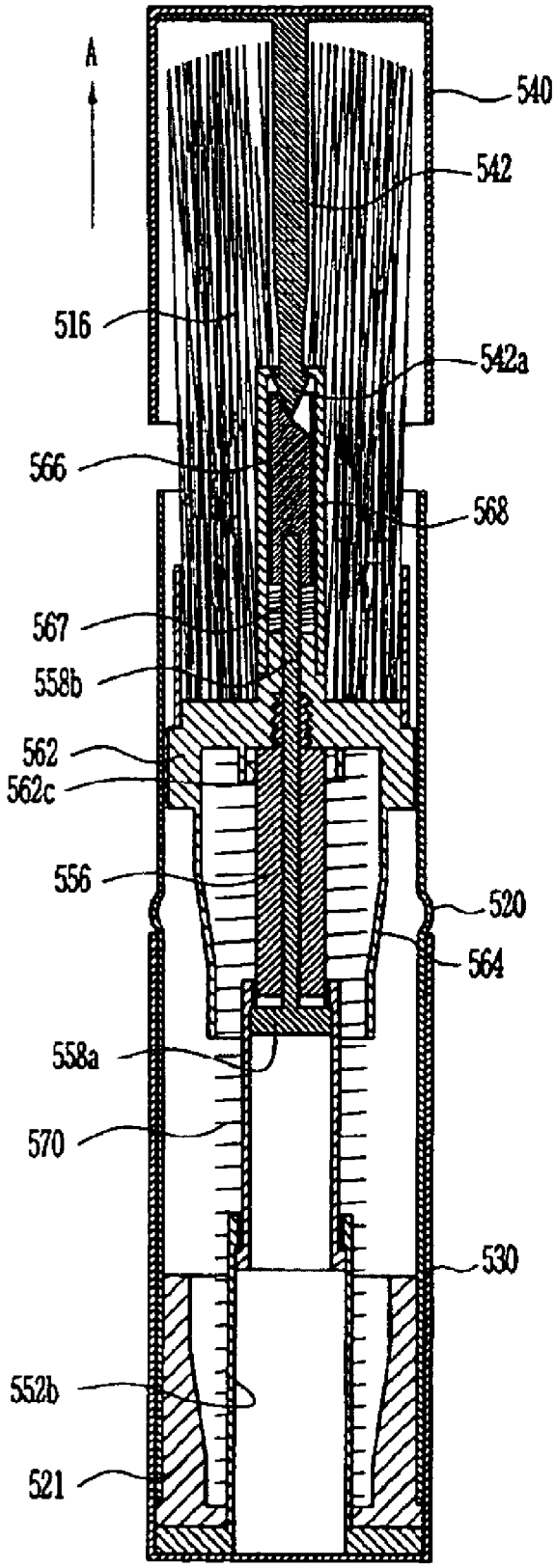
FIG. 46 is a sectional view showing that an insertion end of a pressing projection is about to separate from that a penetration hole.

And then, the cylindrical tube 566 is moves in the same direction as the upward movement of the protection cap 540 because the step portion of the insertion end portion 542*a* is coupled with the locking step 566*a*, as shown in FIG. 46. At this state, although the mounting portion 562 and the coupling segment 556 inserted into the groove 562*b* of the mounting portion 562 are also moved in the same direction as upward movement of the cylindrical tube 566, the innermost segment 558 is suspended because the horizontal element 558*a* of the innermost segment 558 is caught by the upper opening of the middle segment 554. As a result, the upper end of the cylindrical element 568 engaged with the innermost segment 558 is separated from the locking step 566*a* to compress the spring 567 as the cylindrical tube 566 moves upward. As a result, as the upward force of the cylindrical element 568 to the pressing projection 542 is diminished, the pressing projection 542 may be easily separated from the penetration opening 566*b* to revert to its upright state.

Figure 47:
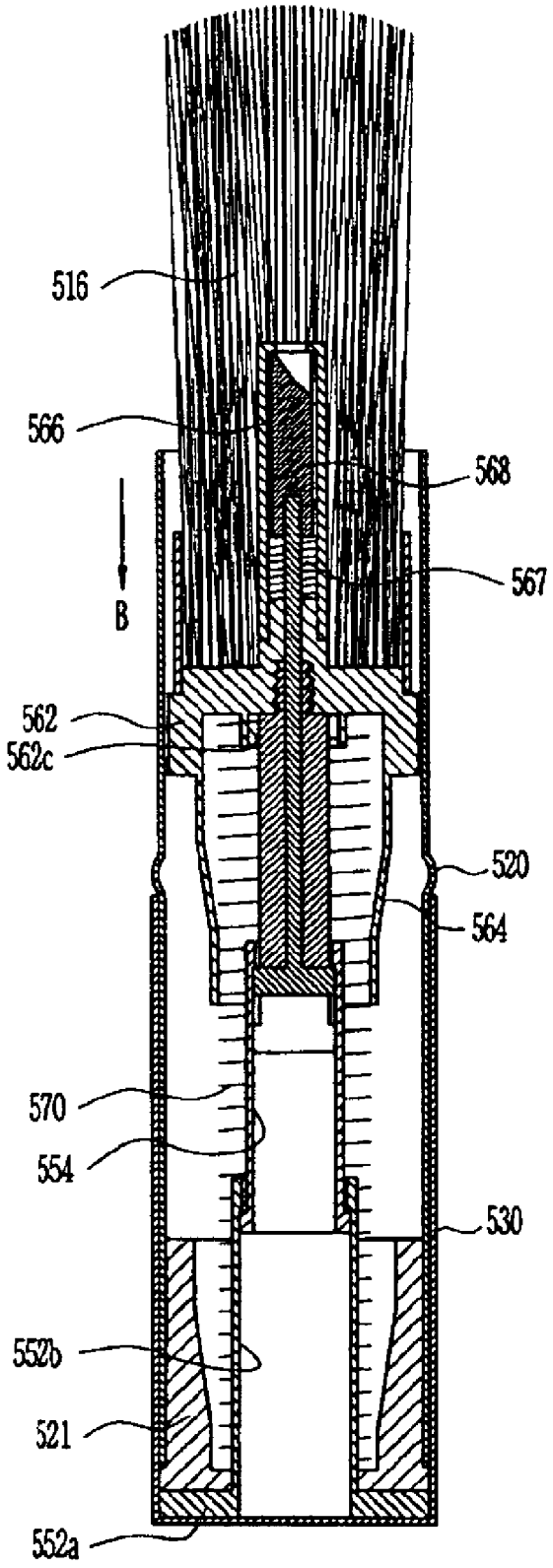
FIG. 47 is a sectional view showing a brush is completely exposed to the outside.

Referring to FIG. 47, when the protection cap 540 is completely separated, the cylindrical tube 566 moves in the direction of arrow B and the coupling segment 556 also moves in the same direction until the upper end portion of the cylindrical element comes in contact with the locking step 566*a* by the restoring force of the spring 567. At this state, the horizontal element 558*a* is positioned at the top of the cutout portion 556*b*.

The operation of reinserting the brush into the first cylindrical member 520 after the use of the brush 516 will be explained, as follows.

Figure 48:
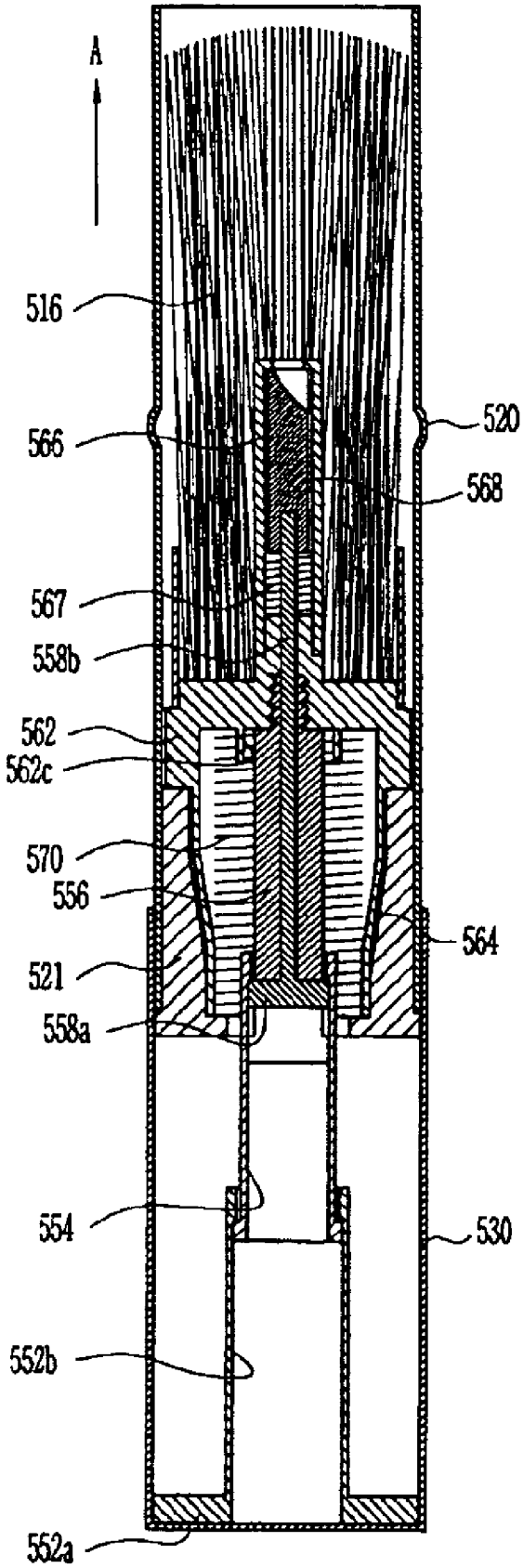
FIG. 48 is a sectional view showing that the brush is again retained in a first cylindrical member.

Referring to FIG. 48, when the user (not shown) moves the first cylindrical member 520 in the direction of the arrow A after gripping the second cylindrical member 530, the cylindrical guiding member 521 is moved upward after its separation from the supporting disc 552*a* of the supporting member 552; and the brush member 510 is held in the first cylindrical member 520. At this situation, since the supporting disc 552*a* of the supporting member 552 is fixed on the bottom of the second cylindrical member 530, the length variable member 550 is elongated to its maximum length. And, the first cylindrical member 520 is moved upward until the upper end of the cylindrical guiding member 521 comes in contact with the lower surface of the tubular body 564. The upward movement of the cylindrical guiding member constricts the elastic member 570.

Figure 49:
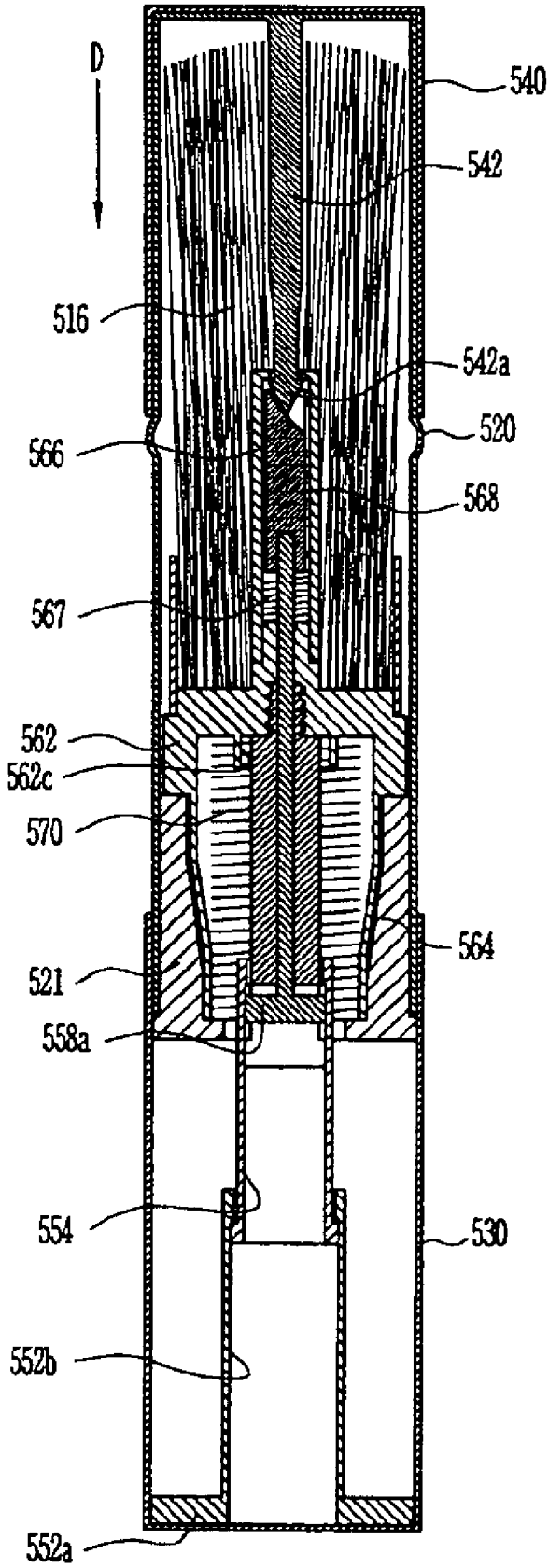
FIG. 49 is a sectional view showing that the protection cap is covering on the upper portion of the first cylindrical member
Figure 50:
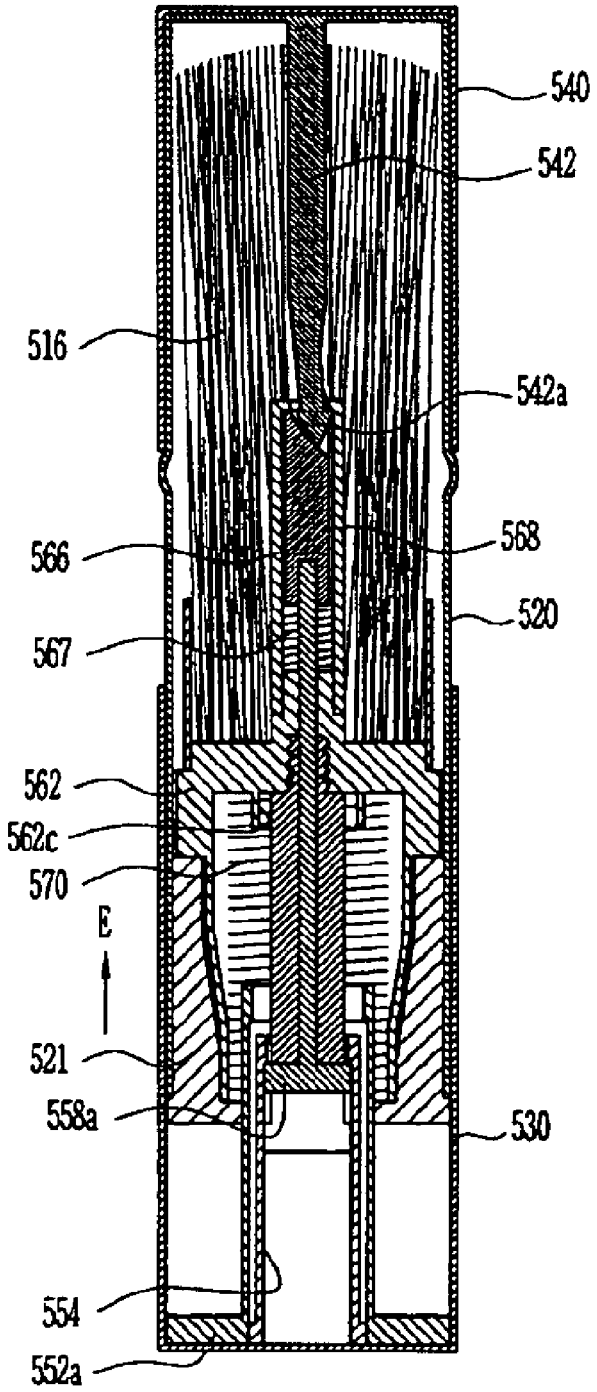
FIG. 50 is a sectional view showing that the insertion end of the pressing projection is inserted into the penetration hole of an upward extending member and a second cylindrical member is moved upward.
Figure 51:
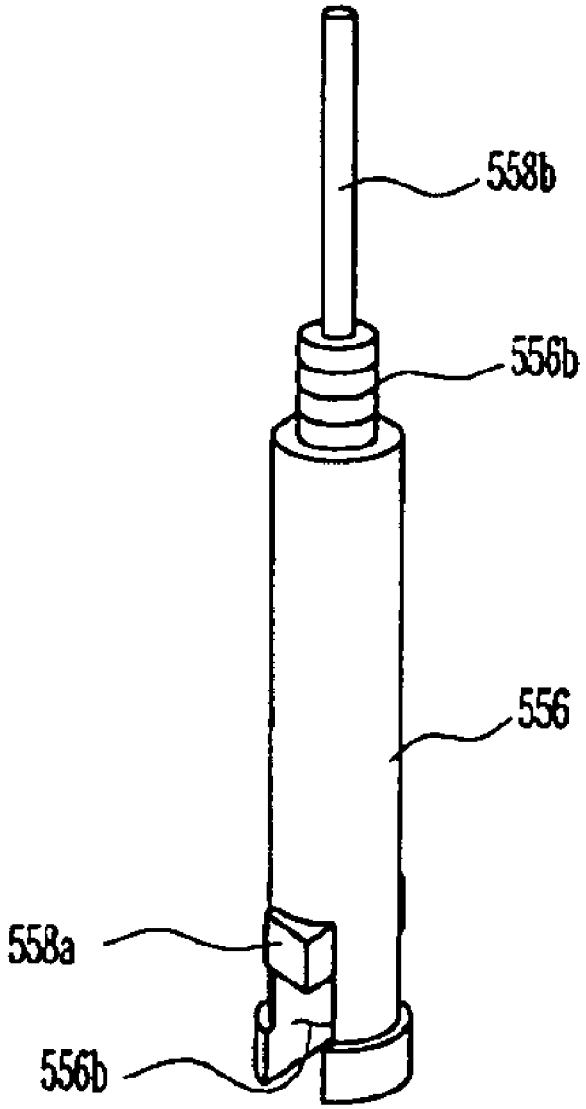
FIG. 51 is a perspective view showing the engagement state between a coupling segment and an inmost segment of the length variable member.
Figure 52:
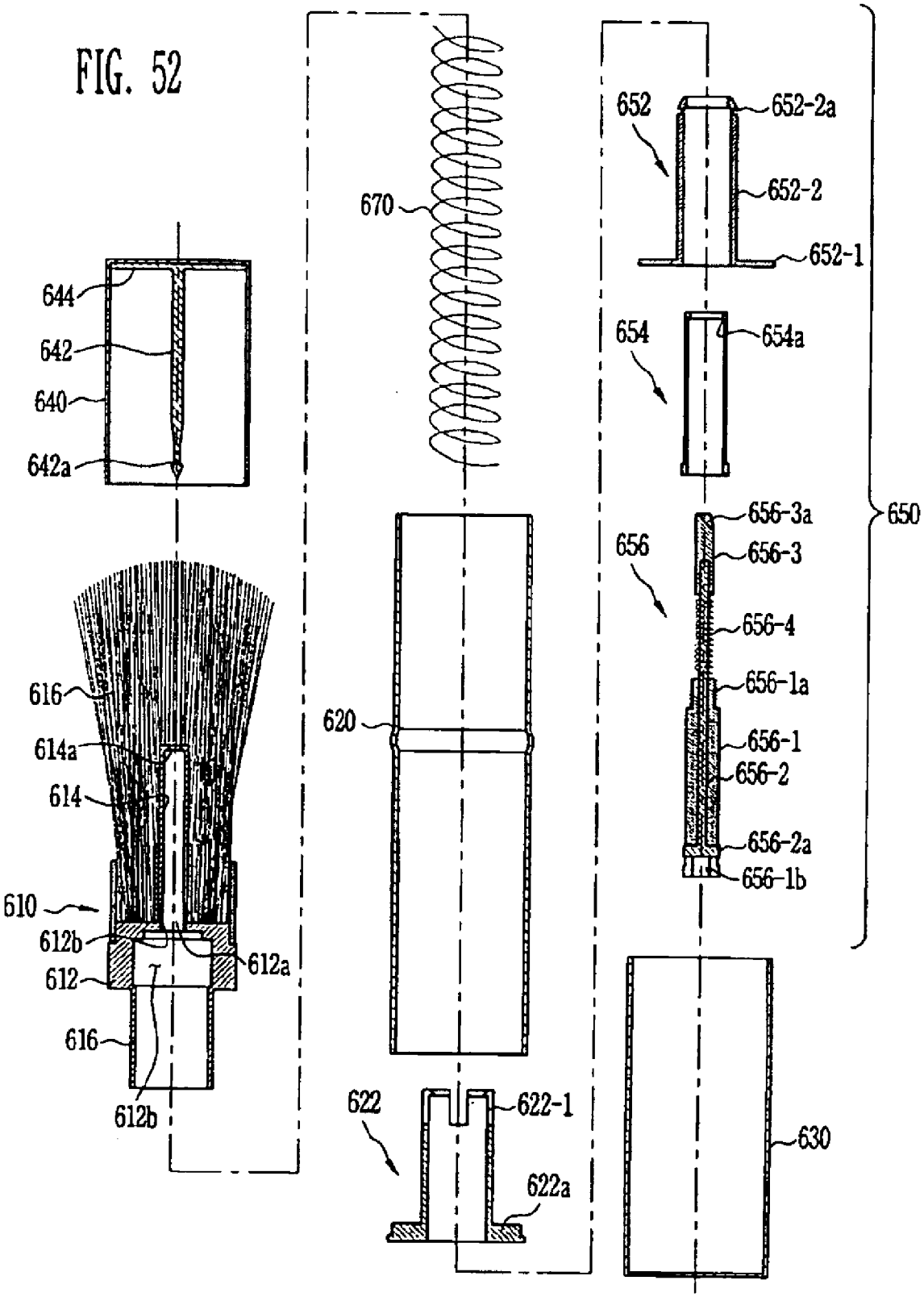
FIG. 52 is an exploded sectional view showing a cosmetic brush assembly according to the seventh embodiment of the invention.

And then, referring to FIGS. 49 and 50, the protection cap 540 covering the upper portion of the first cylindrical member 520 is moved in the direction of the arrow D. When the protection cap 540 is moved downward until the upper end portion of the first cylindrical member 520 contacts with the attaching plate 544 of the protection cap 540, the insertion end portion of the pressing projection 542 exerts a force downward on the upper surface of the cylindrical element after its passing through penetration opening. At this state, the pressing projection 542 is biased aside along the sloping surface of the cylindrical element. And then, the step portion is caught with the locking step 566*a* and the pressing projection 542 is kept with its biased state due to the upward force of the cylindrical element 568 exerting upward resulting from the elastic force of the spring 567 after the step portion of the insertion end portion 542*a* passes through the penetration opening 566*b*.

The length variable member 550 becomes constricted to its shortest length as the second cylindrical member 530 moves in the direction of arrow E.

Thus, the cosmetic brush assembly has a minimal length as shown in FIG. 43, the brush member 510 is received into the first cylindrical member 520, the length variable member 550 is constricted to its minimum length, and the insertion end portion of the pressing projection 542 is positioned in the interior of the cylindrical tube.

Example 7

A cosmetic brush assembly according to the seventh embodiment of this invention has a hollow first cylindrical member 620 of which both ends are open. The lower portion of the first cylindrical member 620 is received into a second hollow cylindrical member 630 of which lower end portion is closed and the upper portion of the first cylindrical member 620 is covered with a protection cap 640.

The hollow portion of the first cylindrical member 620 is slidably received with a brush supporting structure 610 which has a body 612 with brush 616 provided on its upper portion. The lower portion of the brush 616 is provided with a binding portion tightened by a binder, and the center of the binding portion is formed with a given-sized penetration hole. A hollow upward extending member 614 passes through the penetration hole and then is buried into the brush 616. The upward extending member 614 is integrally manufactured with the body 612. The upper end of the upward extending member 614 is formed with a penetration opening 614*a* of which the interior has a locking step. The lower portion of the body 612 is formed with a coupling aperture 612*a* into which a coupling portion 656-1*a* of a coupling segment 656-1 of a length-variable member is engaged, which will be explained below. Also, the lower portion of the body 612 is provided with a tubular body 616 extending downward therefrom and being open at the lower part. The penetration opening 614*a* and the coupling aperture 612*a* are communicated each other via the hollow portion of the upward extending member 614.

The lower portion of the body 612 is formed with a given-sized receiving space 612*b*. The transverse diameter of the receiving space 612*b* is larger than that of the tubular body 616. As explained below, this results in preventing the brush supporting structure 610 from projecting upward due to the elastic force of a elastic member 670 when convex elastic pieces 622-1 provided on the upper portion of a cylindrical guiding member passes through the tubular body 616 and then is positioned in the receiving space 612*b*.

The lower portion of the first cylindrical member 620 is provided with a cylindrical guiding member 622 of which both end is open. The cylindrical guiding member 622 comprises a base 622*a* fixedly coupled with the lower end of the first cylindrical member 620 and a cylinder extending upward from the base 622*a*. The upper portion of the cylinder is provided with convex elastic pieces 622-1 being separated each other by a cutting-off portion and having an inner projection. The outer diameter of the convex elastic pieces 622-1 is larger than that of the cylinder.

A length variable member 650 penetrates the cylinder of the guiding member 622 to connect with the body 612 of the brush supporting structure 610. The length variable member 650 has a cylindrical outermost segment 652 which is integrally made with a supporting disc 652-1 fixed on the inner bottom of the second cylindrical member 630 into which the first cylindrical member 620 is received and a cylindrical body 652-2 extending upward from the supporting disc 652-1. The cylindrical body 652-2 is capable of sliding along the interior of the cylindrical guiding member 622. The upper periphery of the cylindrical body 652-2 is formed with a circular groove 652-2*a* with which the inner projection of the elastic pieces 622-1 provided on the upper portion of the cylinder is coupled. The inner side of the upper end of the outermost segment 652 is provided with a locking projection being capable of preventing the disengagement of segments penetrating the cylindrical body 652-2 upward, which will be explained, below.

The supporting disc 652-1 is formed with hole communicating with the hollow portion of the cylindrical body 652-2, the interior of the cylindrical body 652-2 is received with a middle segment 654 via the hole, which will be explained, as follows. Both ends of the middle segment are open. The upper opening of the middle segment 654 is relatively smaller than the lower opening thereof, thereby an innermost segment 656 penetrating the middle segment 654 may be prevented from its upward disengagement.

The innermost segment 656 has a penetrating coupling segment 656-1 of which the upper portion is provided with a coupling portion 656-1*a* inserted into the coupling aperture provided in the body 612 of the brush supporting structure 610 and both ends are open. The penetrating coupling segment 656-1 is slidably received in the interior of the middle segment 654. The lower portion of the coupling segment 656-1 is provided with a cutout portion 656-1*b* cut in the vertical direction. The coupling segment 656-1 is longer than the middle segment 654, preferably than the cylindrical body 652-2. Thus, as explained below, the upper portion of the coupling segment 656-1 is exposed to the outside via the upper opening of the cylindrical body 652-2 when the length variable member 650 is constricted into its smallest length.

The interior of the coupling segment 656-1 is slidably provided with a connection member comprising a horizontal element 656-2*a* transversely positioned in the cutout portion 656-1*b* and a perpendicular element 656-2 extending upward from the horizontal element 656-2*a*. The perpendicular element 656-2 has a length to be exposed to the outside via the upper opening of the coupling segment 656-1. The upper portion of the perpendicular element 656-2 protruding through the upper opening of the coupling segment 656-1 is provided with a cylindrical member 656-3, a spring 656-4 is provided between the upper end of the perpendicular clement 656-2 and the lower end of the cylindrical member 656-3. The horizontal element 656-2*a* of the connection member is positioned on the upper of the cutout portion 656-1*b* by the elastic of the spring 656-4.

Thus, when the coupling portion 656-1*a* of the coupling segment 656-1 is engaged with the coupling aperture of the body, the cylindrical member 656-3 is slidably positioned in the interior of the upward extending member. Preferably, a slant surface 656-3*a* is provided on the upper portion of the cylindrical member 656-3*a*. The slant surface 656-3*a*, as explained below, does not disturb the insertion of the pressing projection of the protection cap 640 through a penetration opening 614*a* of the upward extending member 614.

The transverse length of the horizontal element 656-2*a* is small so as to be capable of sliding in the middle segment 654. But, it is larger than the diameter of the upper opening of the middle segment 654. Thus, when the length variable member 650 is elongated to its maximum length, the horizontal element 656-2*a* is engaged with the interior of the upper opening of the middle segment 654.

In drawings, although the coupling portion 656-1*a* of the coupling segment 656-1 is screw worked and it couples with the coupling aperture 612*a*, the coupling type between the coupling portion 656-1*a* and the coupling aperture 612*a* is not limited to this. Further, only one middle segment 654 is positioned between the outermost and innermost segments 652 and 656 in drawings, however the number of the middle segment 654 is not limited to this. On the other hand, the coupling segment 656-1 may be directly involved in the outermost segment 652 without any middle segment.

Each of lower ends of the middle and innermost segments 654, 656 is provided with a flange (not shown) extending outward therefrom. The flange engages with the upper openings of the segments 654, 656, respectively to act the length variable member 650 to extend to its full length without the separation of the segments 654, 656. Further, a bump (not shown) having a slope inclined down outward is provided on the flange of the segments 654, 656. The bump help one segment tightly fit into the opening of other segment when the length variable member 650 is extended to its maximum length in order to maintain the extension state thereof.

Furthermore, an elastic member 670 is provided between the body 612 of the brush supporting structure 610 and guiding member 622 in the first cylindrical member 620. When the coupling portion 656-1*a* of the coupling segment 656-1 received in the cylindrical body 652-2 is engaged in coupling aperture 612*a* of the body 612, the elastic member 670 is surrounding the length variable member 650. The elastic member 670 is constricted when the length variable member 650 shrinks to its shortest length, whereas the elastic member 670 extends when the length variable member 650 elongates to its maximum length.

The protection cap 640 has a cylindrical structure being capable of covering the upper portion of the first cylindrical member 620. The upper interior of the protection cap 640 is provided with a circular attaching plate 644, which is provided with a pressing projection 642 extending downward therefrom. The pressing projection 642 has an insertion end portion 642*a* being capable of penetrating through the penetration opening 614*a* of the upward extending member 614 after passing through the brush 616. The insertion end portion 642*a* may have a conical structure or pyramidal structure in order to prevent the crush of the brush when it is passing the brush 616. The insertion end portion 642*a* is provided with a step portion being capable of mating when it is penetrating the penetration opening 614*a*.

The following description relates to the operation of the cosmetic brush assembly in accordance with the seventh embodiment of the present invention.

Figure 55:
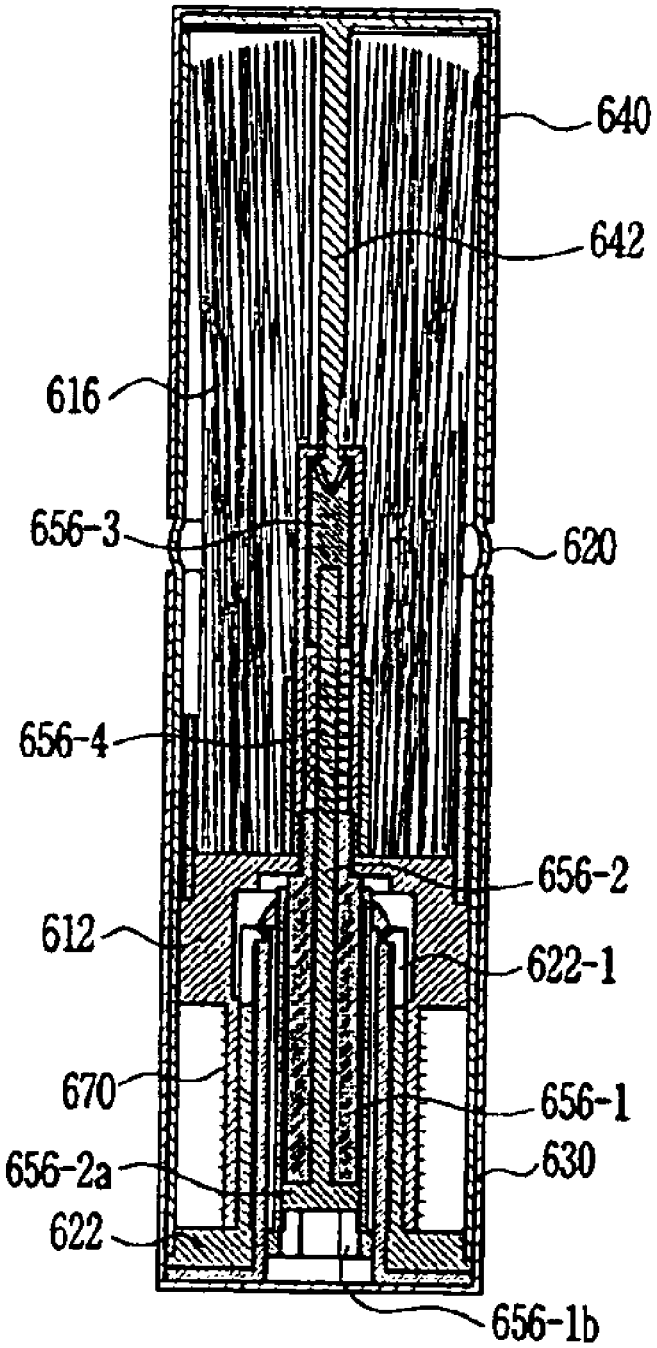
FIG. 55 is a sectional view showing the engaging state of the cosmetic brush assembly according to the seventh embodiment of the invention.

Referring to FIG. 55 showing the assembled state of the cosmetic brush assembly according to the seventh embodiment of this invention, the brush supporting structure 610 is received into the hollow portion of the first cylindrical member 620 and the brush 616 provided in the body 612 of the brush supporting structure 610 is also positioned in the hollow portion of the first cylindrical member 620. The protection cap 640 covers the upper portion of the first cylindrical member 620 and the insertion end portion 642*a* of the pressing projection 642 is inserted and fixed in the penetration opening 614*a*. The lower portion of the first cylindrical member 620 is inserted into the second cylindrical member 630 and the length variable member 650 holds its shortest length.

The supporting disc 652-1 of the length variable member 650 is fixed on the bottom of the second cylindrical member 630. The coupling portion 656-1*a* of the coupling segment 656-1 is engaged into the coupling aperture 612*a* of the body 612. The interior of the cylindrical body 652-2 the outermost segment 652 penetrating upward through the cylindrical guiding member 622 positioned in the lower interior of the first cylindrical member 620 is provided with the middle segment 654 and the innermost segment 656 in turn. The convex elastic pieces 622-1 of the guiding member 622 of which the inner projection engages with the groove 652-2*a* of the cylindrical body 652-2 penetrates through the interior of the tubular body 616 and then is positioned in the receiving space 612*b* provided in the lower portion of the body.

In state that the coupling portion 656-1*a* of the coupling segment 656-1 engages with the coupling aperture 612*a* of the body 612, the cylindrical member 656-3 provided on the upper portion of the perpendicular element 656-2 which penetrates the coupling segment 656-1 is positioned in the interior of the upward extending member 614 and elastically supported by the spring 656-4. The elastic member 670 surrounding the length variable member 650 is constricted.

Since the convex elastic pieces 622-1 is positioned in the receiving space 612*b*, the brush supporting structure 610 is prevented from upward projecting by the elastic of the elastic member 670. Also, since the inner projection provided in the upper portion of the elastic pieces 622-1 engages with the groove 252-2*a* of the cylindrical body 652-2, the length variable member 650 is prevented from elongating. Thus, the cosmetic brush assembly according to this invention is maintained in its shortest length.

Now, the following description relates to the operation pulling out the brush 616 involved in the first cylindrical member 620.

Figure 56:
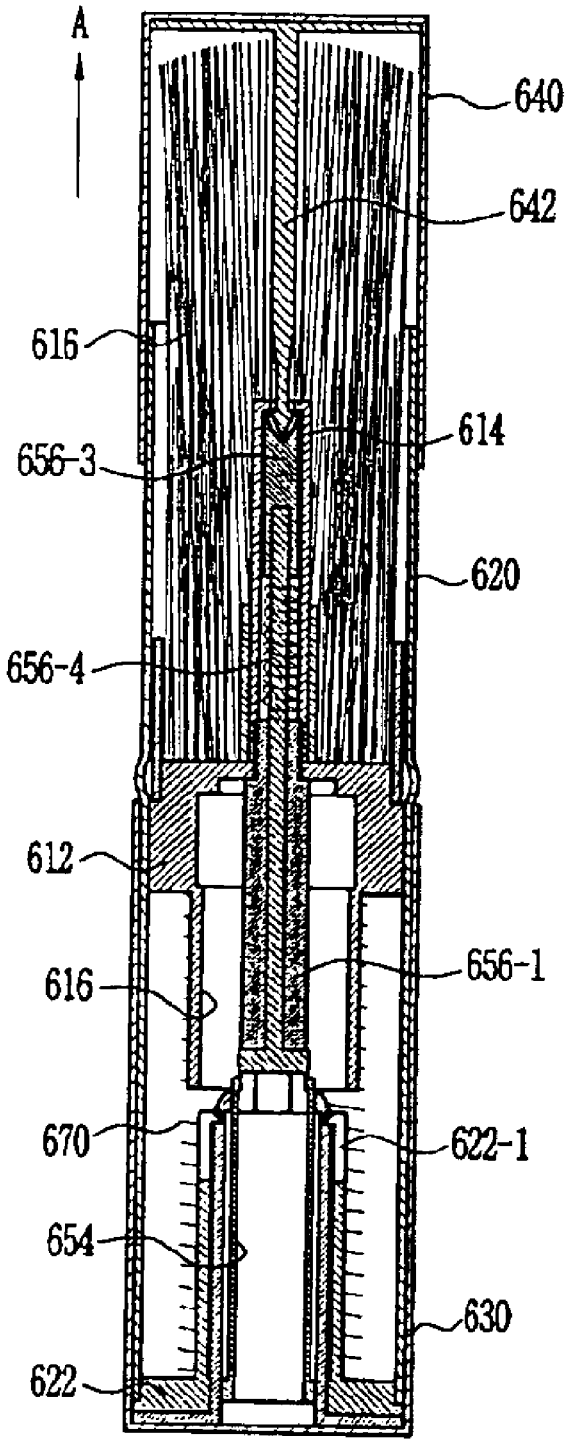
FIG. 56 is a sectional view showing that a protecting cap is moved upward.

Referring to FIG. 56, when a user (not shown) moves the protection cap 640 in the direction of the arrow A after gripping the second cylindrical member 630, the tubular body 616 of the brush-supporting structure 210 is slid along the outer surface of the cylinder of the guiding member 622 and then separated from the guiding member 622 since the step portion of the insertion end portion 642*a* is strongly coupled with the locking step 214*a*. As the brush supporting structure 610 moves upward, the length variable member 650 elongates and the brush 616 penetrates through the upper opening of the first cylindrical member 620. The upward movement of the brush supporting structure 610 is more easily achieved due to the elasticity of the elastic member 670.

And, as the coupling segment 656-1 of which the coupling portion 656-1*a* engages with the coupling aperture 612*a* of the body 612 moves upward, the middle segment 654 also moves upward along the interior of the cylindrical body 652-2. The upward movement of the coupling segment 656-1 is accomplished until the horizontal element 656-2*a* positioned on the upper end of the cutout portion 656-1*b* of the coupling segment 656-1 contacts to the upper opening 254*a* of the middle segment 654.

Figure 57:
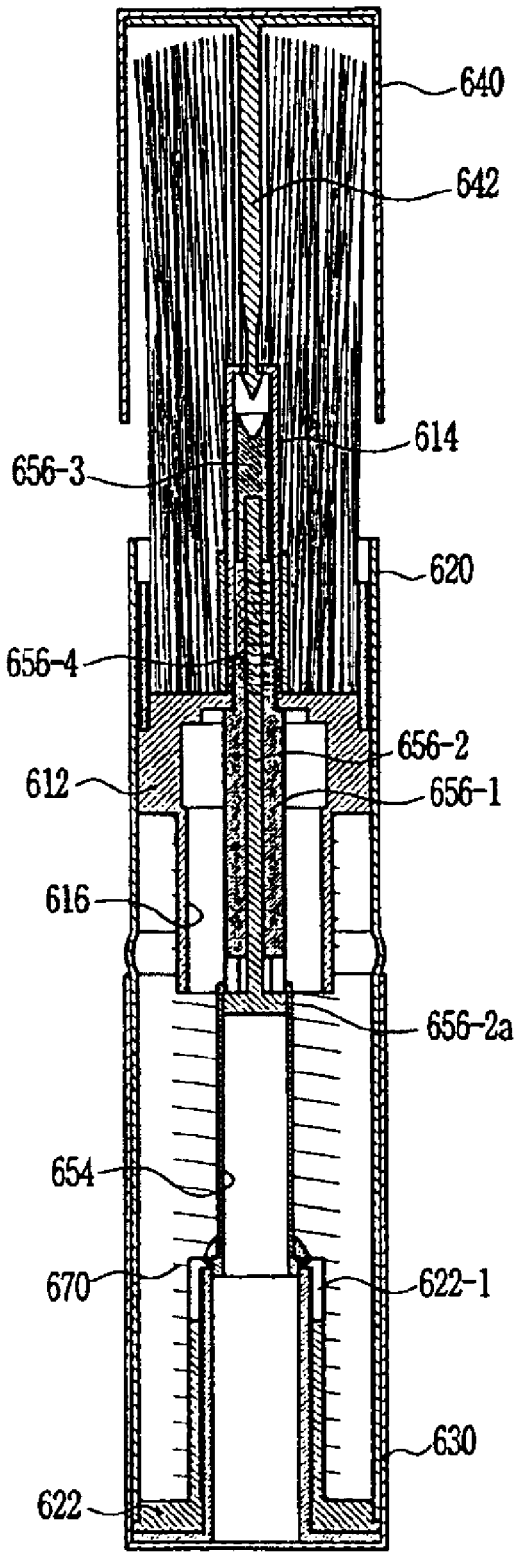
FIG. 57 is a sectional view showing that a length variable member is elongated to its maximum length.

FIG. 57 is a view showing that the protection cap 640 is pulled out upward until the length variable member 650 is elongated to its maximum length. The brush 616 is completely drawn out from the first cylindrical member 620, however the insertion end portion 642*a* of the pressing projection 642 is hold in the penetration opening of the upward extending member 614 in its insertion. The horizontal element 656-2*a* of the connection member is positioned at the top of the cutout portion 656-1*b* of the coupling segment 656-1. The elastic member 670 elongates to its maximum length.

And then, when the protection cap 640 is further moved upward, the upward extending member 614 is also moved in the same direction since the step portion of the insertion end portion is inserted in the penetration opening. At this time, the coupling segment 656-1 of which the coupling portion 656-1*a* engages into the coupling aperture 612*a* of the body 612 moves in the same direction together with the upward movement of the upward extending member 614, however the horizontal element 656-2*a* of the connection member is suspended because the horizontal element 656-2*a* of the connection member is caught by the upper opening of the middle segment 654.

As a result, the horizontal element 656-2*a* moves downward along the cutout portion 656-1*b* and the upper end of the cylindrical member 656-3 provided on the upper portion of the perpendicular element 656-2 is separated from the insertion end portion 642*a*, the spring 656-4 is compressed as the upward extending member 614 moves upward. Thus, as the upward force of the cylindrical member 656-3 to the insertion end portion 642*a* is diminished, the pressing projection 642 may be easily separated from the penetration opening 614*a*.

Figure 58:
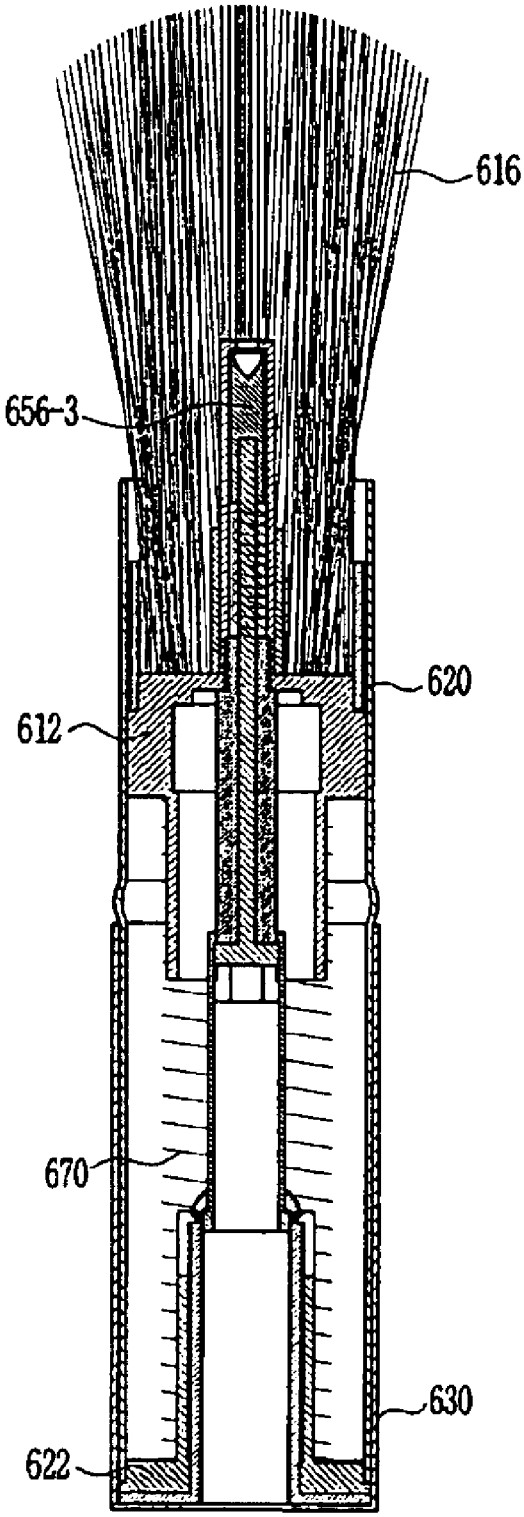
FIG. 58 is a sectional view showing a brush is completely exposed to the outside.

Referring to FIG. 58, when the protection cap 640 is completely separated, the cylindrical member 656-3 moves upward along the upward extending member 614 by the restoring force of the spring 656-4 until the upper end portion of the cylindrical member comes in contact with the locking step of the penetration opening 614*a*. At this state, the perpendicular element 656-2 moves in the same direction. The horizontal element 656-2*a* is positioned at the top of the cutout portion 656-1*b*.

The operation of reinserting the brush 616 into the first cylindrical member 620 after the use of the brush 616 will be explained, as follows.

Figure 59:
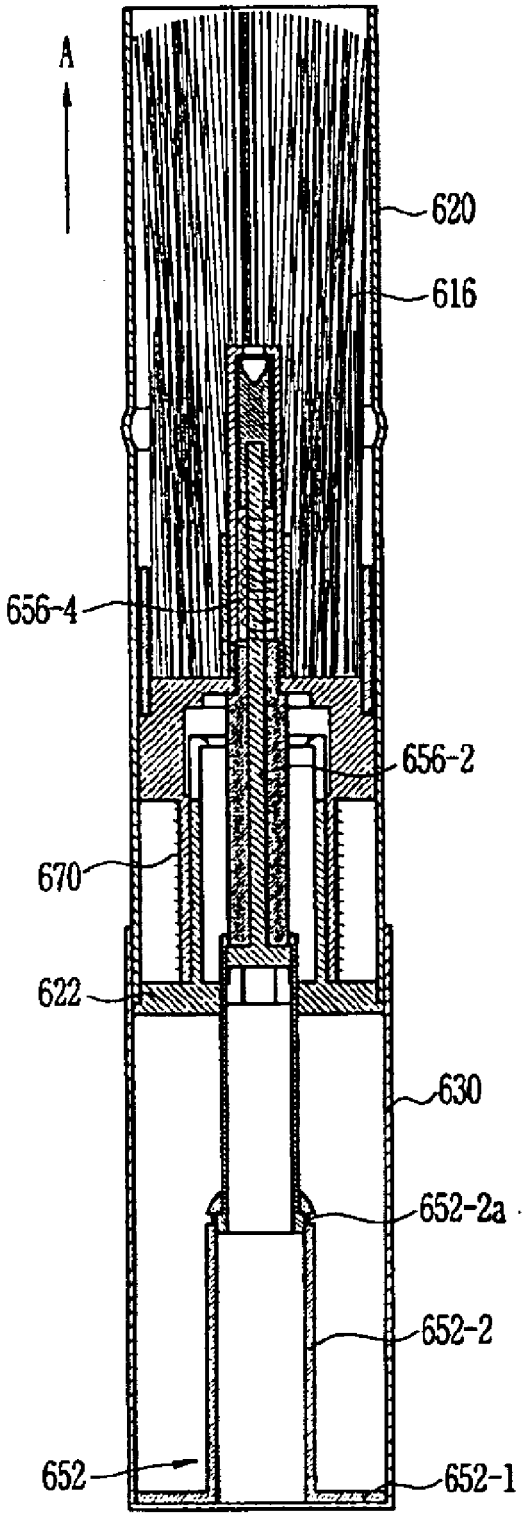
FIG. 59 is a sectional view showing that the brush is again retained in a first cylindrical member.

Referring to FIG. 59, when the user (not shown) moves the first cylindrical member 620 in the direction of the arrow A after gripping the second cylindrical member 630, the cylindrical guiding member 622 moves upward after the inner projection of the elastic pieces 622-1 is separated from the groove 252-2*a* of the cylindrical body 652-2. The guiding member 622 moves upward until the elastic pieces 622-1 is positioned in the receiving space 612*b* of the body 612. As a result, the brush 616 is involved in the first cylindrical member 620. The length variable member 650 is elongated to its maximum length. And, the elastic member 670 is constricted.

Figure 60:
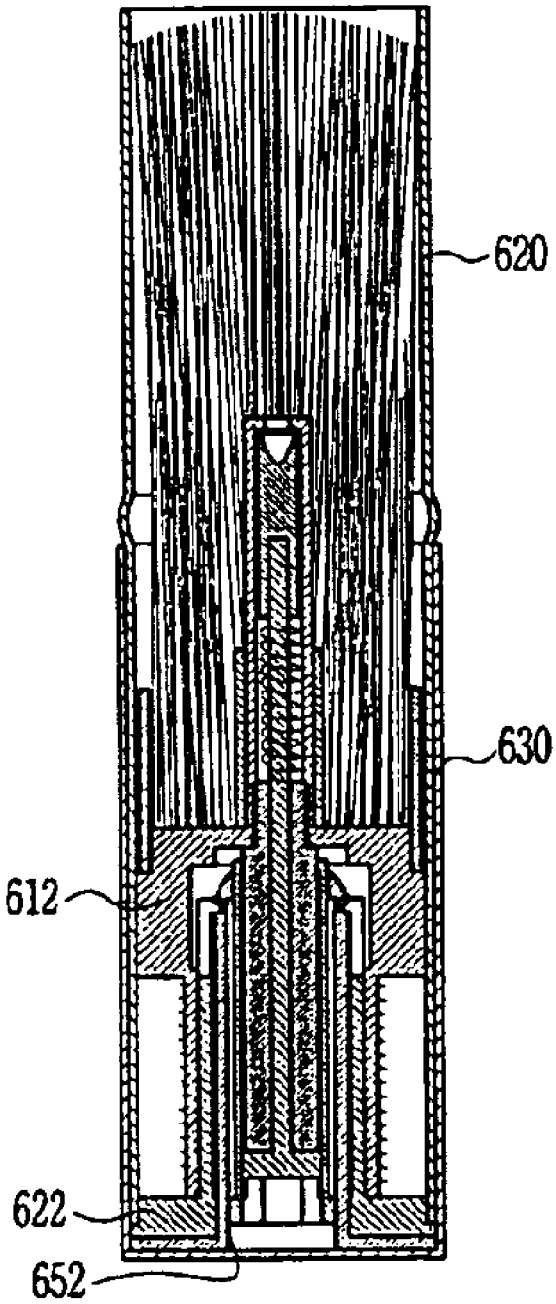
FIG. 60 is a sectional view showing that a second cylindrical member is moved upward.
Figure 61:
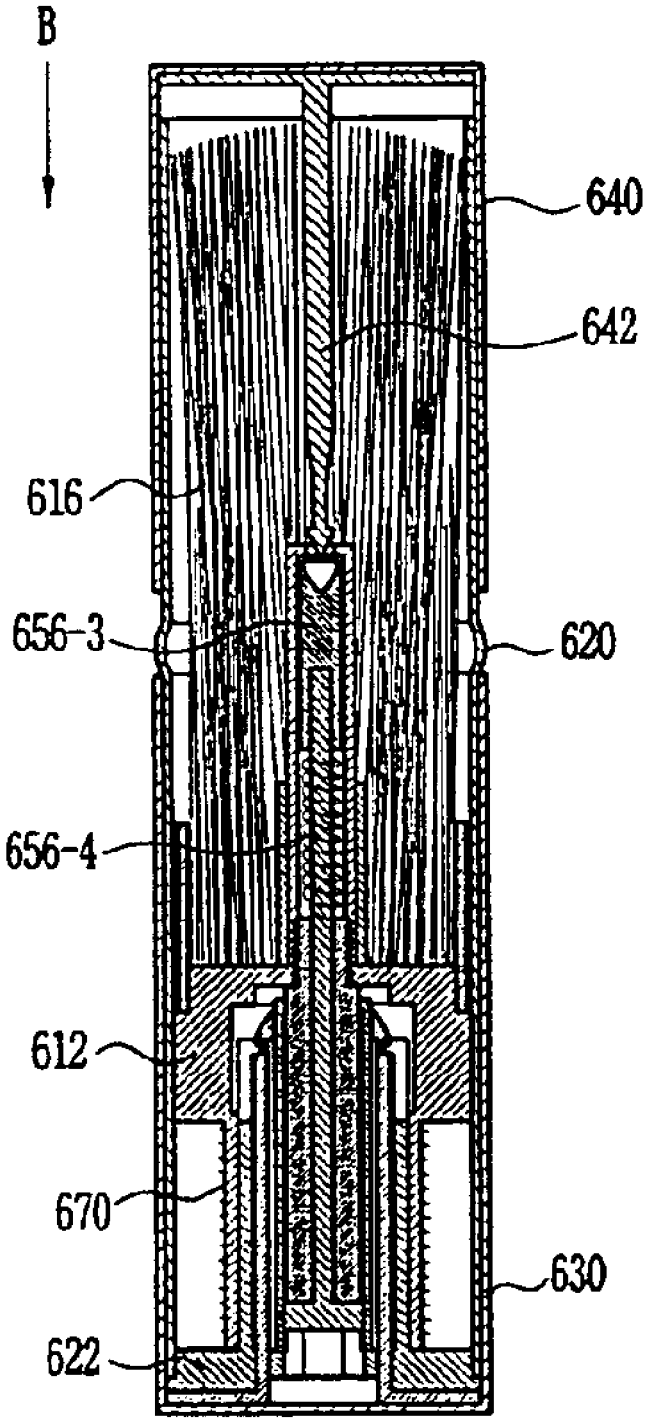
FIG. 61 is a sectional view showing that the protection cap is covering on the upper portion of the first cylindrical member.
Figure 62:
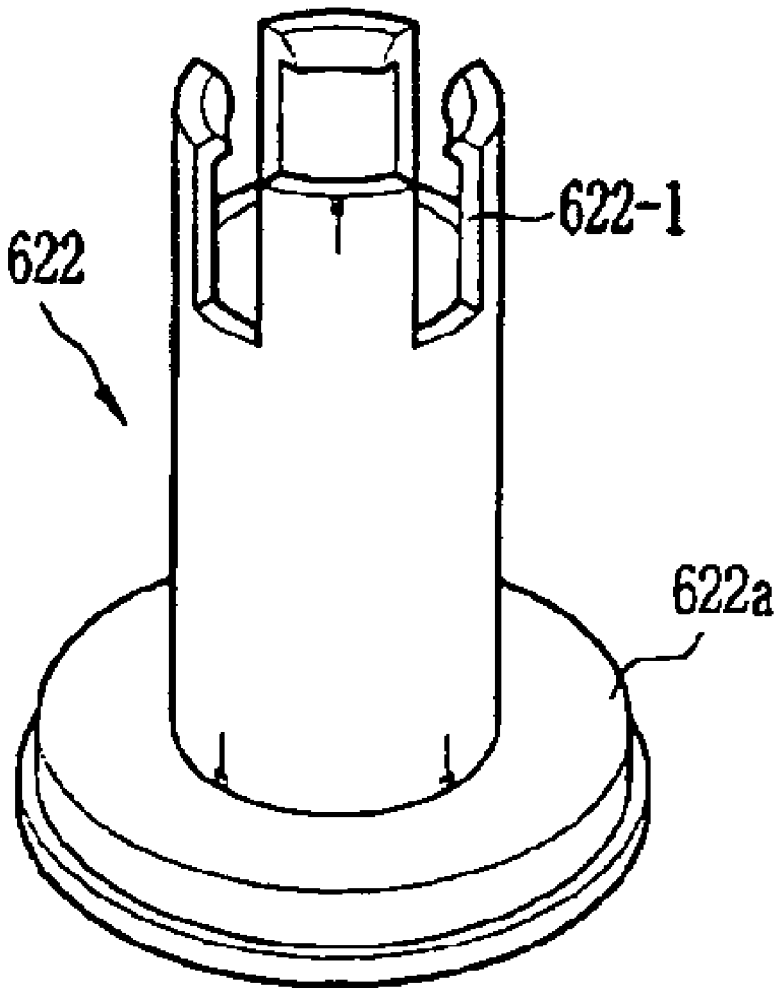
FIG. 62 is a perspective view of a guiding member of the cosmetic brush assembly according to the seventh embodiment of the invention.

And then, referring to FIGS. 60 and 61, the length variable member 650 shrinks to its shortest length as the second cylindrical member 630 moves upward along the first cylindrical member 620. And, the cylindrical body 652-2 of the outermost segment also moves upward along the interior of the cylindrical of the guiding member 622 until the inner projection of the elastic pieces 622-1 is engaged with the groove 252-2*a*.

And then, the protection cap 640 covering the upper portion of the first cylindrical member 620 is moved in the direction of the arrow B. When the protection cap 640 is moved downward until the upper end portion of the first cylindrical member 620 contacts with the attaching plate 644 of the protection cap 640, the insertion end portion 642*a* of the pressing projection 642 exerts a force downward on the upper surface of the cylindrical member 656-3 after its passing through penetration opening 614*a* of the upward extending member 614. At this state, the pressing projection 642 is slid along the slant surface 656-3*a* of the cylindrical member 656-3. And, the step portion of the insertion end portion 642*a* is caught with the penetration opening 614*a* due to the upward force of the cylindrical member 656-3 exerting upward resulting from the elastic force of the spring 656-4 after the step portion of the insertion end portion 642*a* passes through the penetration opening 614*a*.

Figure 53:
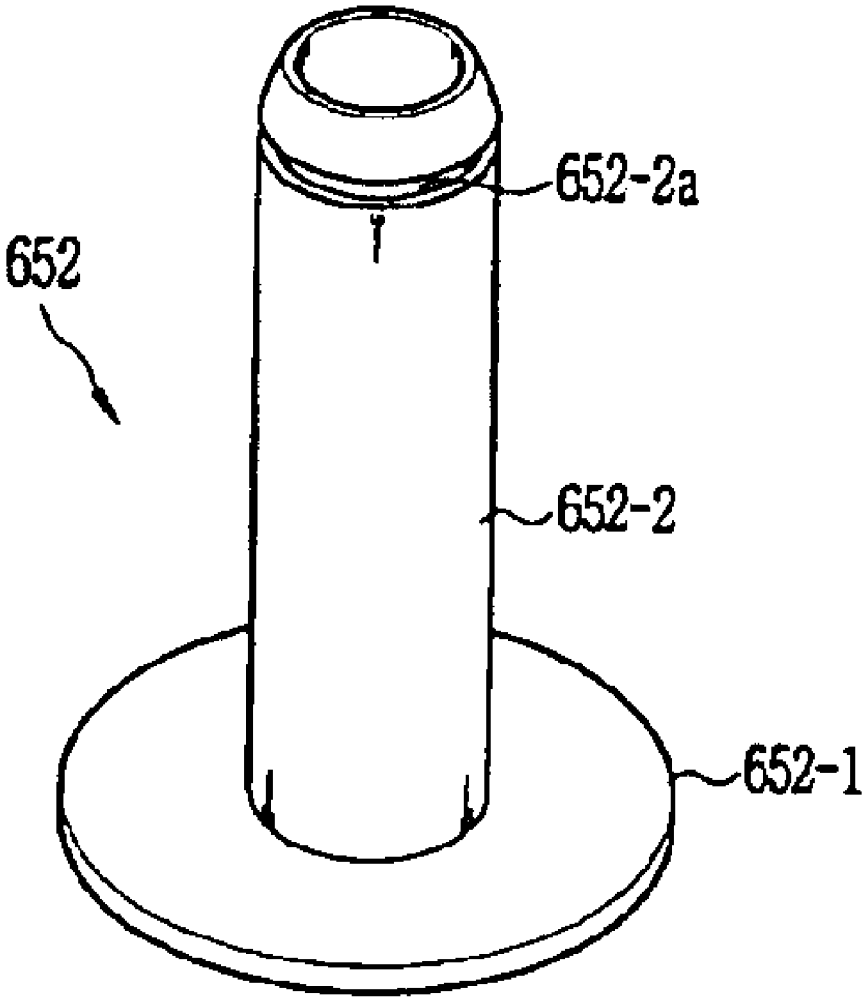
FIG. 53 is a perspective view of an outermost segment of a cosmetic brush assembly according to the seventh embodiment of the invention.
Figure 54:
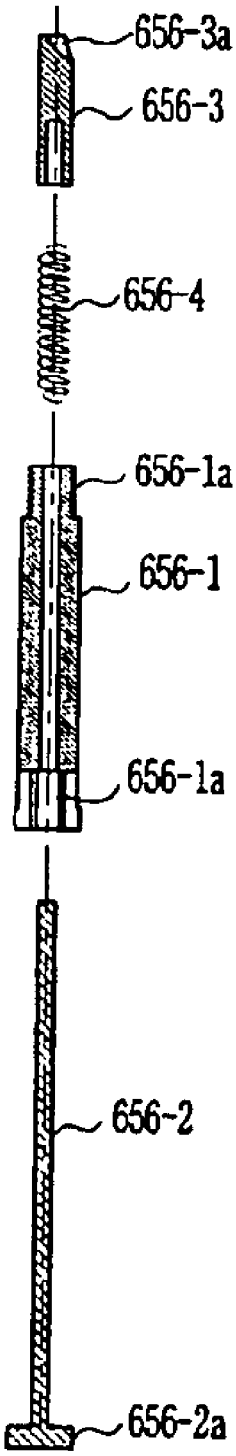
FIG. 54 is an exploded sectional view of a length variable member of the cosmetic brush assembly according to the seventh embodiment of the invention.

Thus, the cosmetic brush assembly according to the seventh embodiment of this invention has a shortest length as shown in FIG. 53, the brush 616 is received in the first cylindrical member 620, the length variable member 650 is constricted to its minimum length, and the insertion end portion 642*a* of the pressing projection 642 is positioned in the interior of the upward extending member 614.

According to this invention, the brush retained in the first cylindrical member is exposed outside by simple actuation, especially since the exposed brush can be used without the change of the total length of the cylindrical member, it is convenience to use the brush.

According to this invention, it is capable to prevent the separation of the protection cap from the first cylindrical member and the brush is easily pulled out from the first cylindrical member by the separation action of the protection cap since the coupling groove of the brush supporting structure retained in the first cylindrical member and outward projection is tightly fitted with the gap of the length variable member.

Additionally, as the tubular body of the brush-supporting structure is tightly fitted with the cylindrical guiding member and the outer bump of the outermost segment is also tightly fitted with the aperture of the cylindrical guiding member, the brush inserted into the first cylindrical member is prevented to expose outside and the brush is easily pulled out from the first cylindrical member by the separation action of the protection cap.

Further, according to this invention, the brush member received in the first cylindrical member may be easily exposed to the outside by the movement of the protection cap. Further, the insertion end portion of the pressing projection may be easily separated from the cylindrical tube because the cylindrical element is slid in the cylindrical tube by the elastic force of the spring.

Further, it is capable of preventing the exposure of the brush owing to the careless treatment to the brush protection cap.

Although the above description is made with the cosmetic brush assembly, it may be also applicable to lipstick with the identical effect.

While the present invention has been described with reference to a preferred embodiment, the description is illustrative of the invention and is not to be construed as limiting the invention. Various modifications may occur to those skilled in the art without departing from the true sprit and scope of the invention as defined by the appended claims.

What is claimed is:

1. A cosmetic brush assembly comprising;

a first member of which both ends are open, the first member is fixedly installed with a guiding member;

a brush supporting structure slidably received in the first member, the brush supporting structure has a body provided with brush at its upper portion and formed with a hole and an upward extending member extending upward from the body to the brush and having a hollow portion which communicates with the hole and an upper opening;

a second member into which the lower portion of the first member is slidably received;

a protection cap covering the upper portion of the first member and having a pressing projection separably engaging into the upper opening of the upward extending member; and a length variable member having a supporting disc and a plurality of segments, the supporting disc is fixed on the inner bottom of the second member to be positioned in the lower portion of the guiding member and the segments are connected each other and are extended to the upward extending member;

wherein, the plurality of segments comprises an outermost segment, and a coupling segment, the outermost segment is engaged with the supporting disc and separably engaged with the guiding member, the coupling segment is slidably received in the outermost segment and has a coupling portion engaging with the brush supporting structure, the upper end of the length variable member positioned in the upward extending member is provided with a cylindrical member elastically supported by a spring.

2. A cosmetic brush assembly according to claim 1, wherein the upper portion of the guiding member is provided with elastic pieces having inner projection, the periphery of the segment connected with the supporting disc is provided with a groove, the groove is separably engaged with the inner projection.

3. A cosmetic brush assembly according to claim 2, wherein the elastic pieces has a convex structure.

4. A cosmetic brush assembly according to claim 1, wherein the lower portion of the body is formed with a receiving space positioned with the elastic pieces.

5. A cosmetic brush assembly according to any one of claims 1–4, further comprising an elastic member positioned between the brush supporting structure and the guiding member.

* * * * *